US010871273B2

(12) United States Patent
Sonneman et al.

(10) Patent No.: US 10,871,273 B2
(45) **Date of Patent: *Dec. 22, 2020**

(54) LIGHTING SYSTEM

(71) Applicant: Contemporary Visions, LLC, Larchmont, NY (US)

(72) Inventors: Robert A. Sonneman, Mamaroneck, NY (US); Christian N. Garnett, Mount Kisco, NY (US)

(*) Notice: Subject to any disclaimer, the term of this patent is extended or adjusted under 35 U.S.C. 154(b) by 0 days.

This patent is subject to a terminal disclaimer.

(21) Appl. No.: 16/374,144

(22) Filed: Apr. 3, 2019

(65) Prior Publication Data

US 2019/0368703 A1 Dec. 5, 2019

Related U.S. Application Data

(62) Division of application No. 16/248,407, filed on Jan. 15, 2019.

(Continued)

(51) Int. Cl.
*F21S 4/00* (2016.01)
*F21V 21/00* (2006.01)

(Continued)

(52) U.S. Cl.
CPC ..... *F21V 15/01* (2013.01); *F21S 8/06* (2013.01); *F21S 8/061* (2013.01); *F21V 3/00* (2013.01);

(Continued)

(58) Field of Classification Search
CPC .... F21S 8/06; F21S 8/061; F21S 8/066; F21S 8/068; F21V 17/00; F21V 17/04; F21V 17/08; F21V 23/00; F21V 23/003; F21V 23/004; F21V 23/06; F21V 29/74; F21Y 2115/10

(Continued)

(56) References Cited

U.S. PATENT DOCUMENTS 5,113,329 A * 5/1992 Lin ..... F21S 2/00 362/219
6,186,645 B1 * 2/2001 Camarota ..... F21S 8/032 362/240

(Continued)

FOREIGN PATENT DOCUMENTS

CN 101619826 A 1/2010

OTHER PUBLICATIONS

ISA/US, PCT International Search Report and Written Opinion dated Apr. 11, 2019 issued in PCT International Application No. PCT/US19/13661.

*Primary Examiner* — Jason M Han
(74) *Attorney, Agent, or Firm* — Gottlieb, Rackman & Reisman, P.C.

(57) ABSTRACT

A lighting system may include a plurality of suspenders and a beam configured to provide light in at least one direction. The suspenders may structurally support the beam from a ceiling and may provide electrical power and dimming control signals to the beam. The beam may include a plurality of light engines for emitting light. The light engines may be single sided or dual sided, and may transmit electrical power among each other. The dual sided light engines may emit light upwardly and downwardly from the beam, and the single sided light engines may emit light downwardly.

10 Claims, 75 Drawing Sheets

Related U.S. Application Data

(60) Provisional application No. 62/679,406, filed on Jun. 1, 2018.

(51) Int. Cl.

| | |
|---|---|
| ***F21V 15/01*** | (2006.01) |
| ***F21V 21/08*** | (2006.01) |
| ***F21V 7/00*** | (2006.01) |
| ***F21S 8/06*** | (2006.01) |
| ***F21V 29/74*** | (2015.01) |
| ***F21V 17/04*** | (2006.01) |
| ***F21V 23/00*** | (2015.01) |
| ***F21V 23/06*** | (2006.01) |
| ***F21V 3/00*** | (2015.01) |
| ***H05B 45/10*** | (2020.01) |
| ***H05B 47/185*** | (2020.01) |
| *F21Y 115/10* | (2016.01) |

(52) U.S. Cl.

CPC ..... *F21V 7/00* (2013.01); *F21V 17/04* (2013.01); *F21V 21/0832* (2013.01); *F21V 23/001* (2013.01); *F21V 23/002* (2013.01); *F21V 23/003* (2013.01); *F21V 23/007* (2013.01); *F21V 23/06* (2013.01); *F21V 29/74* (2015.01); *H05B 45/10* (2020.01); *H05B 47/185* (2020.01); *F21Y 2115/10* (2016.08)

(58) Field of Classification Search

USPC ..... 362/249.02, 800

See application file for complete search history.

(56) References Cited

U.S. PATENT DOCUMENTS

| | | | | |
|---|---|---|---|---|
| 6,769,785 | B1 | 8/2004 | Herst et al. | |
| 6,932,495 | B2 * | 8/2005 | Sloan ..... | F21V 21/0808 362/294 |
| 8,373,362 | B2 | 2/2013 | Chemel et al. | |
| 9,097,411 | B2 | 8/2015 | Guilmette | |
| 2008/0123340 | A1 | 5/2008 | McClellan | |
| 2010/0118538 | A1 | 5/2010 | Kay | |
| 2011/0317421 | A1 | 12/2011 | So | |
| 2013/0107524 | A1 | 5/2013 | Anderson et al. | |
| 2015/0362149 | A1 | 12/2015 | Dau et al. | |

* cited by examiner

LIGHTING SYSTEM

CROSS-REFERENCE TO RELATED APPLICATIONS

This patent application is a divisional of U.S. patent application Ser. No. 16/248,407, filed on Jan. 15, 2019, which in turn claims priority to U.S. Patent Application No. 62/679,406, filed on Jun. 1, 2018, the disclosures of which are hereby incorporated by reference herein in their entireties as part of the present disclosure.

FIELD OF THE INVENTION

The present invention relates to a lighting system, and more particularly to a lighting system having various configurations.

BACKGROUND OF THE INVENTION

Lighting systems come in a variety of sizes and shapes. Lighting fixtures are grouped together to from a lighting system for illuminating a particular area. The lighting fixtures, or luminaires, are typically horizontally aligned structures which can be attached to the ceiling, can be embedded in the ceiling, or can be suspended from the ceiling. A lighting fixture typically includes a fluorescent bulb and a reflector above the bulb for reflecting light downwardly.

Oftentimes, a venue is remodeled or its purpose changes. For example, a coffee shop may relocate the serving area to another portion of the venue, a clothing store may be reconfigured as an electronics store, etc. In such cases, the lighting needs of the respective venues may change according to the remodeling process.

For example, the serving area of a coffee shop needs to be well lit. When the serving area is relocated, the lighting system may need to be reconfigured to provide additional light at the new location of the serving area. However, current lighting systems are difficult to reconfigure.

As can be appreciated, the lighting fixtures that existed at the former location of the serving area cannot easily be transferred to the new location. Whether attached, embedded, or suspended from the ceiling, each lighting structure needs to be independently detached from its prior location and be reattached to the new location. In addition, the electrical connections of the lighting structures need to be disconnected and the wiring must be re-routed to the new location for each respective lighting structure, further complicating the reconfiguration process.

Thus, the reconfiguration of existing lighting systems is labor-intensive and costly.

SUMMARY OF THE INVENTION

A lighting system according to the present invention can be easily installed and reconfigured as needed. The lighting system includes a plurality of beams suspended from the ceiling that are configured to emit light. The beams are connected to each other by connectors, which are structures that are attached to the ceiling through their respective wires, cables, rods, etc.

Some of the connectors are configured to be connected to two or more beams. Thus, one connector can be used to suspend a plurality of beams from the ceiling through one wire, cable or rod. Accordingly, the lighting system of the present invention has a simplified structural connection scheme.

In addition, the connectors provide electrical connectivity between the beams. For example, when a first beam is supplied with electrical power from a power source, all the other beams in the lighting system may obtain power from the first beam through their respective connectors. Thus, the electrical connection scheme of the lighting system may be simplified by doing away with the need to provide a separate electrical power cable from the ceiling for each beam.

The beams can be selectively connected to and disconnected from the connectors. Thus, the lighting system can be easily reconfigured by having additional beams added, having beams removed, or having beams relocated due to the flexible connection scheme afforded by the connectors.

In addition, the beams may be used to provide illumination above and below the lighting system. For example, the beams may have light sources configured to direct light upwardly, e.g., toward the ceiling (uplights), and light sources configured to direct light downwardly, e.g., toward the floor (downlights). According to the present invention, the uplights and downlights at each location along the beam may be powered by and/or attached to a single light engine. Thus, the beam can be made very thin.

Since the same light engine can power and/or mount an uplight and a downlight, there is no need to have a beam with one section for housing the light engines and driving circuits for the uplights, and a separate section for housing light engines and drivers for the downlights (e.g., a beam with an H-like cross section). Thus, the beam construction can be simplified. For example, a beam according to the present invention may have a box-like cross-section (or a U-section with a cover plate), to accommodate the light engines.

Further, the uplights and downlights may be controlled independently of each other. For example, the uplights and downlights may be switched on and off and may be dimmed independently of each other.

According to an exemplary embodiment of the present invention, a lighting system includes a beam configured to provide illumination, a first connector configured to be selectively coupled to a first end of the beam, a second connector configured to be selectively coupled to a second end of the beam, opposite to the first end, and first and second suspenders configured to suspend the beam from a supporting structure.

Each of the first and second suspenders may have a first end configured to be connected to the supporting structure and a second end configured to be connected to a respective one of the first and second connectors. At least one of the first and second suspenders is configured to provide electrical power to the beam.

The beam may include a plurality of light engines including a first light engine and a second light engine, each of the first and second light engines having a first side including a first light source and a second side including a second light source for providing illumination in at least two different directions.

The beam may further include a first driving circuit configured to drive the first light sources and a second driving circuit configured to drive the second light sources.

According to an exemplary embodiment of the present invention, a lighting system includes a first beam including a first set of light sources and a second set of light sources for generating light, a second beam configured to generate light, a plurality of suspenders configured to suspend the first and second beams from a supporting structure, and a plurality of connectors connecting the first and second beams with the plurality of suspenders for suspending the first and second beams from the supporting structure.

A first connector of the plurality of connectors structurally and electrically connects the first and second beams to each other.

The beam may further include a plurality of light engines, each of which configured to provide power to at least one light source from the first set of light sources and at least one light source from the second set of light sources, a first driving circuit connected to the plurality of light engines for driving the first set of light sources, and a second driving circuit connected to the plurality of light engines for driving the second set of light sources.

According to an exemplary embodiment of the present invention, a lighting system includes a plurality of suspenders suspended from a supporting structure, at least one of the suspenders including electrical wiring and in connectivity with a power supply, a plurality of beams arranged in a plane, each of the beams including at least one power cable sourced from the electrical wiring of the at least one suspender, and a plurality of connectors, each of the connectors structurally connecting at least one beam end with the supporting structure through a respective suspender, and at least one of the connectors providing both electrical and structural connectivity between two or more beams.

At least one of the beams includes dual-sided light engines configured to emit light from different sides of the at least one beam. Each dual-sided light engine may be powered by separate driving circuits.

BRIEF DESCRIPTION OF THE DRAWINGS

The above and other features of the present invention will become more apparent by describing in detail exemplary embodiments thereof in conjunction with the accompanying drawings, in which:

FIG. 40 is a perspective view illustrating a lighting system according to an embodiment.

DETAILED DESCRIPTION OF THE EMBODIMENTS OF THE PRESENT INVENTION

Figure 1A:
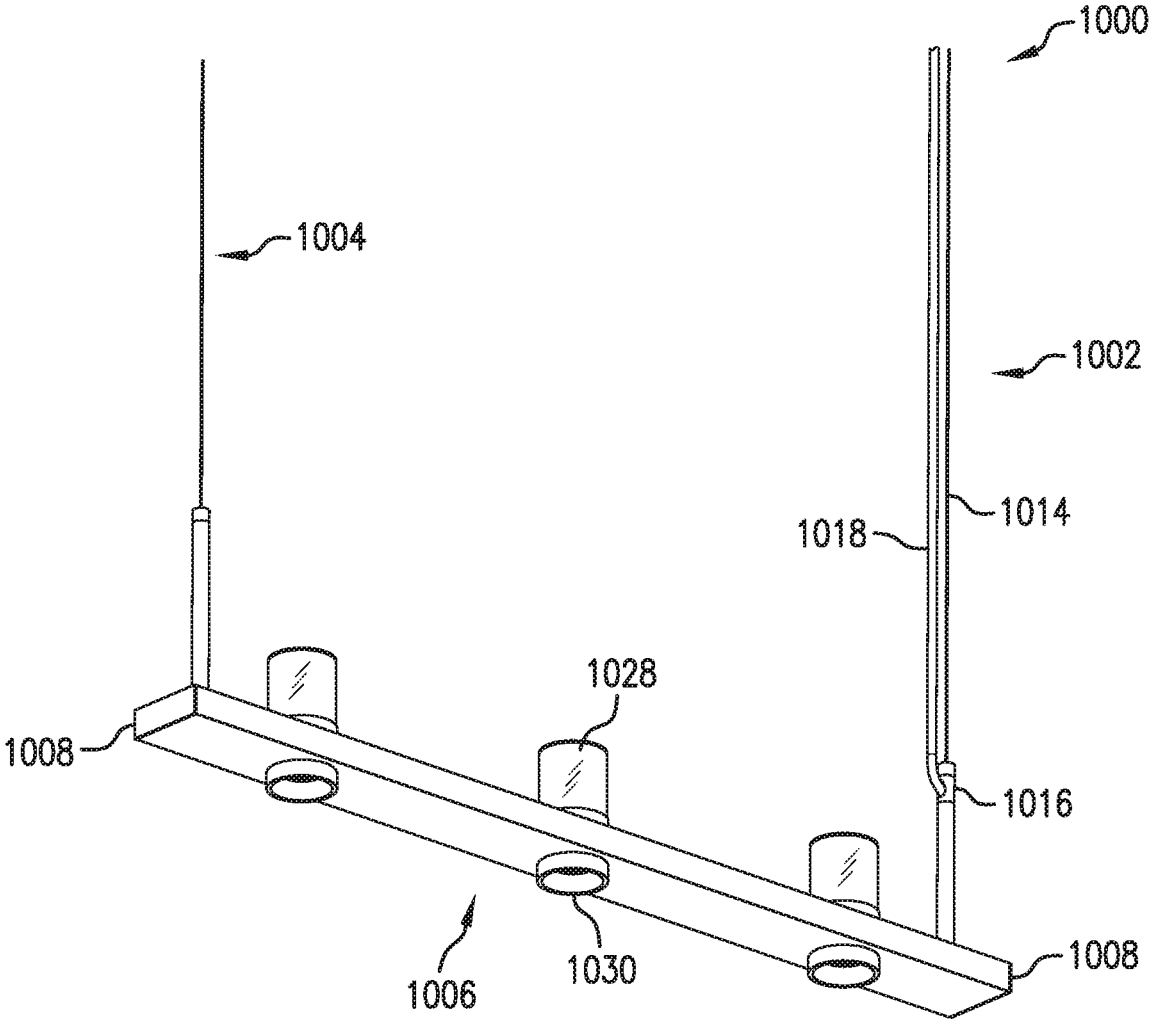
FIG. 1A is a perspective view illustrating a lighting system according to an exemplary embodiment of the present invention.

Exemplary embodiments of the present invention will be described more fully hereinafter with reference to the accompanying drawings. The present invention may, however, be embodied in different forms and should not be construed as being limited to the embodiments set forth herein. Like reference numerals may refer to like elements throughout the specification. The sizes and/or proportions of the elements illustrated in the drawings may be exaggerated for clarity.

When an element is referred to as being connected to another element, intervening elements may be disposed therebetween. In addition, elements, components, parts, etc., not described in detail with respect to a certain figure or embodiment may be assumed to be similar to or the same as corresponding elements, components, parts, etc., described in other parts of the specification.

Figure 1B:
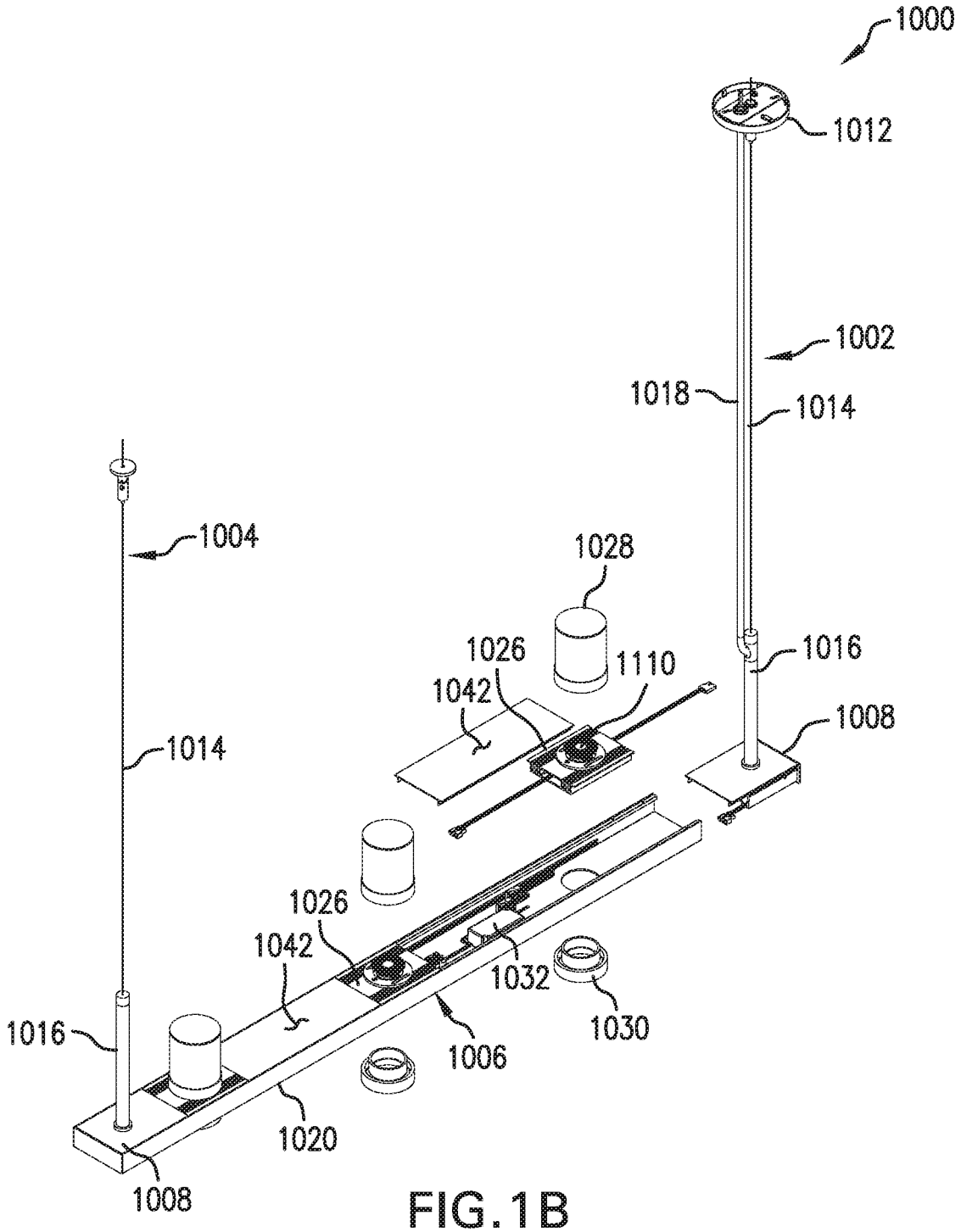
FIG. 1B is an exploded perspective view illustrating an upper side of the lighting system of FIG. 1A.
Figure 1C:
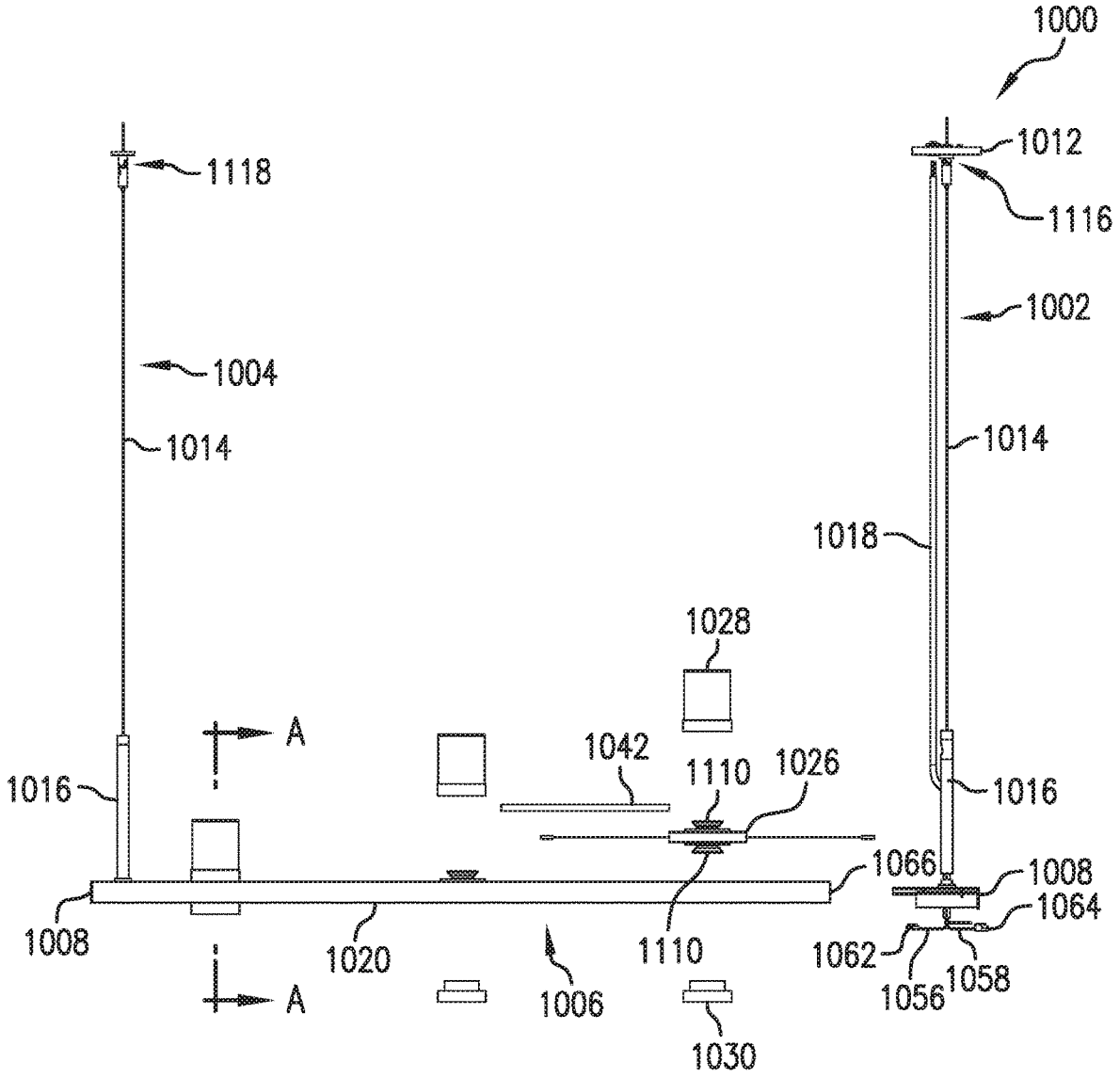
FIG. 1C is an exploded side elevational view of the lighting system of FIG. 1A.

FIGS. 1A-1C illustrate a lighting system 1000 according to an exemplary embodiment of the present invention. Referring to FIGS. 1A-1C, the lighting system 1000 may include a first suspender 1002, a second suspender 1004, a beam 1006, and a plurality of connectors 1008.

Referring to FIGS. 1B-1C, the first suspender 1002 may have a first end configured to be attached to a supporting structure, for example a truss, a beam, a concrete slab, a wooden slab, etc., located above the area intended to be lit, and a second end configured to be selectively connected to one of the connectors 1008. The supporting structure may be referred to as a ceiling for convenience of description.

Referring to FIG. 1C, the first end of the first suspender 1002 may have a hinged mechanism 1116 allowing the first suspender 1002 to be plumb even when connected to a non-horizontal ceiling.

Referring to FIGS. 1B-1C, the second suspender 1004 may have a first end configured to be attached to the ceiling, and a second end configured to be selectively connected to the other connector 1008.

Referring to FIG. 1C, the first end of the second suspender 1004 may have a hinged mechanism 1118 allowing the second suspender 1004 to be plumb even when connected to a non-horizontal ceiling.

The beam 1006 is configured to emit light, and may be selectively connected to the plurality of connectors 1008 for structural support. Thus, the beam 1006 may be suspended from the ceiling through the connectors 1008 and the suspenders 1002 and 1004 to a desired elevation in order to provide illumination.

The beam 1006 may be aligned horizontally or substantially horizontally by adjusting the respective lengths of the first and second suspenders 1002 and 1004 accordingly. Alternatively, the beam 1006 may be configured to have a non-horizontal alignment.

Figure 2A:
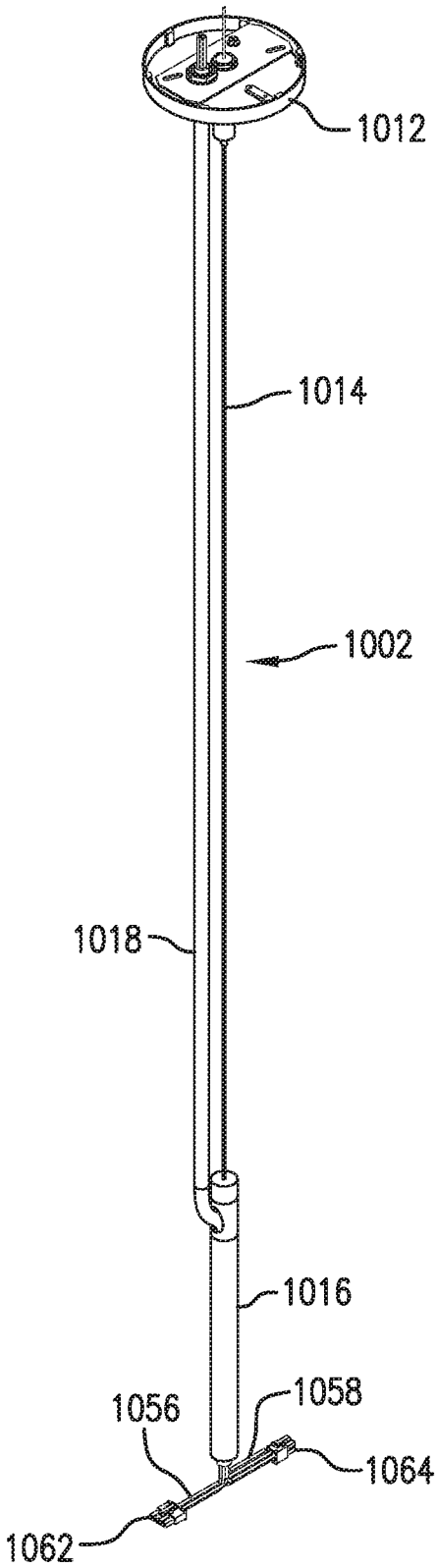
FIGS. 2A-2D illustrate various suspenders according to exemplary embodiments.

FIG. 2A illustrates the suspender 1002 according to an embodiment. Referring to FIGS. 2A, 1B-1C, the first end of the first suspender 1002 may include a base (or canopy) 1012 configured to be attached to the ceiling, a structural cable or rod 1014 (cable, for brevity) connected to the base 1012, a hollow member 1016 connected to the cable 1014, and a plurality of electrical wires bundled together into a cable 1018 (see FIG. 5).

Referring to FIG. 2A, the base 1012 may be configured to be connected to the ceiling through various fastening mechanisms, for example, thorough an expansion screw, expansion bolt, adhesive, welding, etc.

Referring to FIGS. 1B-1C and 2A, the cable 1014 may be a tension cable supporting at least a portion of the weight of the lighting system 1000. The cable 1014 may be made of a metal, rope, etc., suitable for resisting tensile forces. The rope may be made of a polymer material, for example, nylon, polyester, Kevlar, polyvinyl chloride (PVC), etc.

Referring to FIGS. 1B-1C, the hollow member 1016 is connected to the cable 1014 on one end, and to one of the connectors 1008 on the other end.

The hollow member 1016 may be made of the same materials as the cable 1014, and may be, for example, a metal pipe, e.g., an aluminum or steel pipe, a PVC, pipe, etc.

Referring to FIGS. 1C and 2A, the cable 1018 may be inserted into the hollow member 1016 and may extend through the hollow member 1016 and through the first connector 1008 (see FIG. 1C) to provide electrical power to the beam 1006, as will be described below in further detail.

Figure 2B:
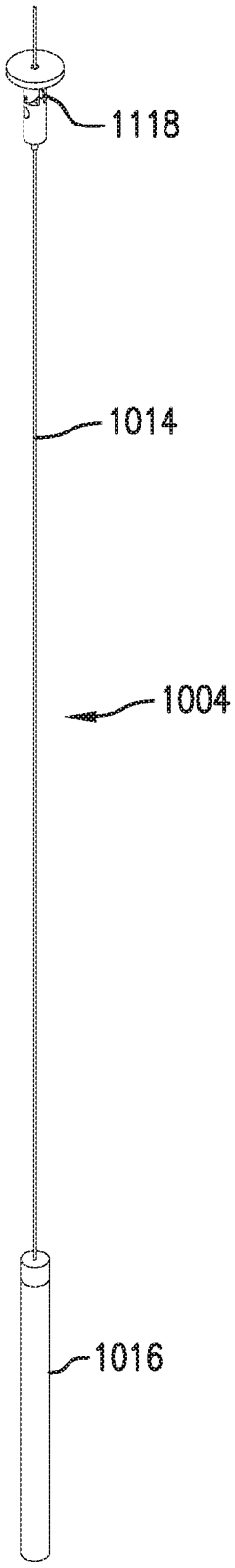

FIG. 2B illustrates the second suspender 1004 according to an embodiment. Referring to FIG. 2B, the second suspender 1004 may be at least partially similar to the first suspender 1004. For example, the second suspender 1004 may also include a cable 1014 and a hollow member 1016, similar to the first suspender 1002.

Referring to FIGS. 1B and 2B, the second suspender 1004 may omit the base 1012 at its first end, but the first end of the second suspender 1004 may include the same fastening mechanism or a similar fastening mechanism as that provided on the first end of the first suspender 1002 for connection to the ceiling, for example, an expansion screw or bolt. Thus, the first end of the second suspender 1004 may be attached to the ceiling in the same way as the first suspender 1002.

Referring to FIGS. 1B-1C, the hollow member 1016 of the second suspender 1004 may be attached to its respective cable 1014 and to one of the connectors 1008 in the same way as the hollow member 1016 of the first suspender 1002 is connected to its respective cable 1014 and connector 1008.

Figure 2C:
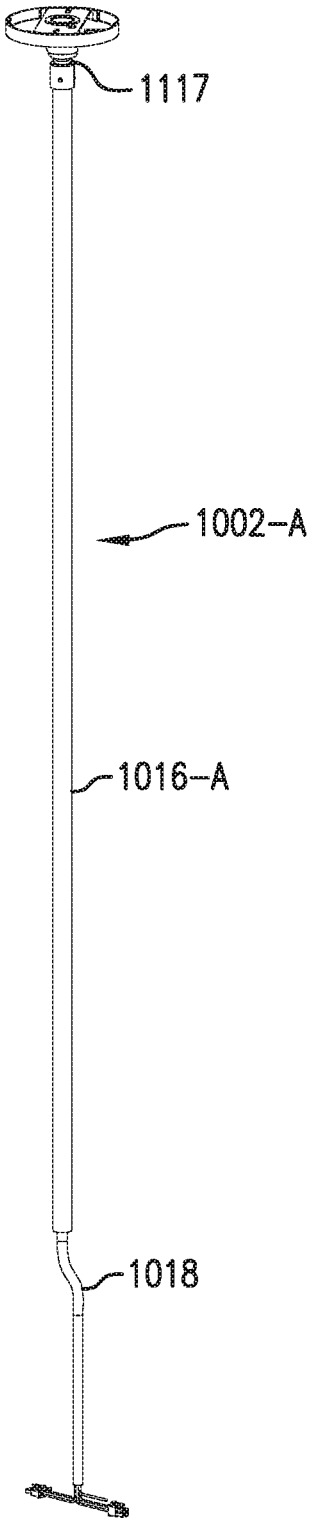

FIG. 2C illustrates a third suspender 1002-A, which is an alternate embodiment of the first suspender 1002. Referring to FIG. 2C, the third suspender 1002-A may include a hollow member 1016-A with a ball joint mechanism 1117, allowing the hollow member 1016-A to be plumb even when connected to a non-horizontally aligned ceiling. Referring still to FIG. 2C, the hollow member 1016-A may extend from the ceiling and may include a cable 1018 extending inside of the hollow member 1016-A. The cable 1018 of the third suspender 1002-A may be the same as the cable 1018 of the first suspender 1002. The hollow member 1016-A of FIG. 2C may be connected to the ceiling and to one of the connectors 1008 for supporting the weight of the beam 1006.

Figure 2D:
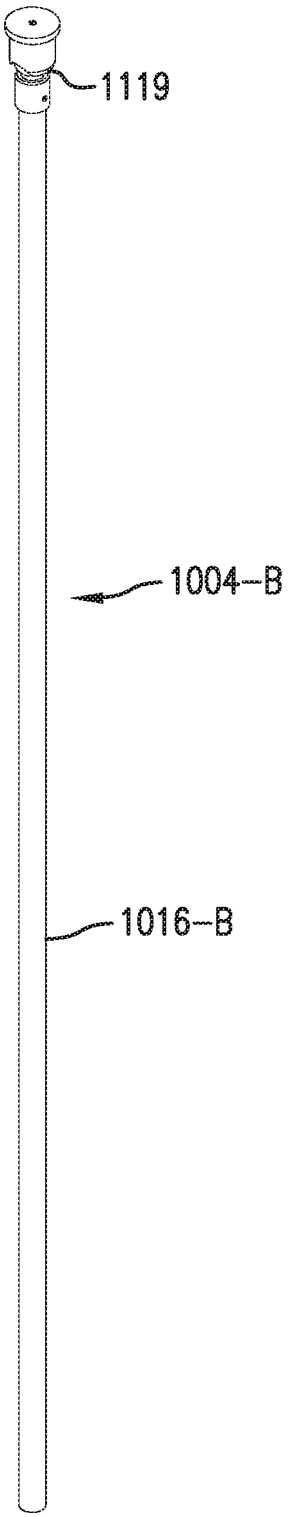

FIG. 2D illustrates a fourth suspender 1004-B, which is an alternate embodiment of the second suspender 1004. Referring to FIG. 2D, the fourth suspender 1004-B may include a hollow member 1016-B with a ball joint mechanism 1119. A first end of the hollow member 1016-B, adjacent to the ball joint mechanism 1119, may be connected to the ceiling. A second end of the hollow member 1016-B may be connected to one of the connectors 1010 for supporting the weight of the beam 1006.

It is understood that the first to fourth suspenders 1002, 1004, 1002-A and 1004-B may be variously configured as needed to support the weight of the lighting system 1000, to set the alignment of the lighting system 1000, and to provide electrical power to the lighting system 1000.

Referring to FIGS. 1B-1C, the beam 1006 may include a housing 1020, a plurality of light engines 1026, a plurality of lenses 1110, a plurality of casings or trims (referred to as "casings" for brevity) 1028, a plurality of casings 1030, a first driving circuit 1032 (shown in FIG. 1B), a second driving circuit 1034 (shown in FIG. 3), and a plurality of cover plates 1042.

Figure 3:
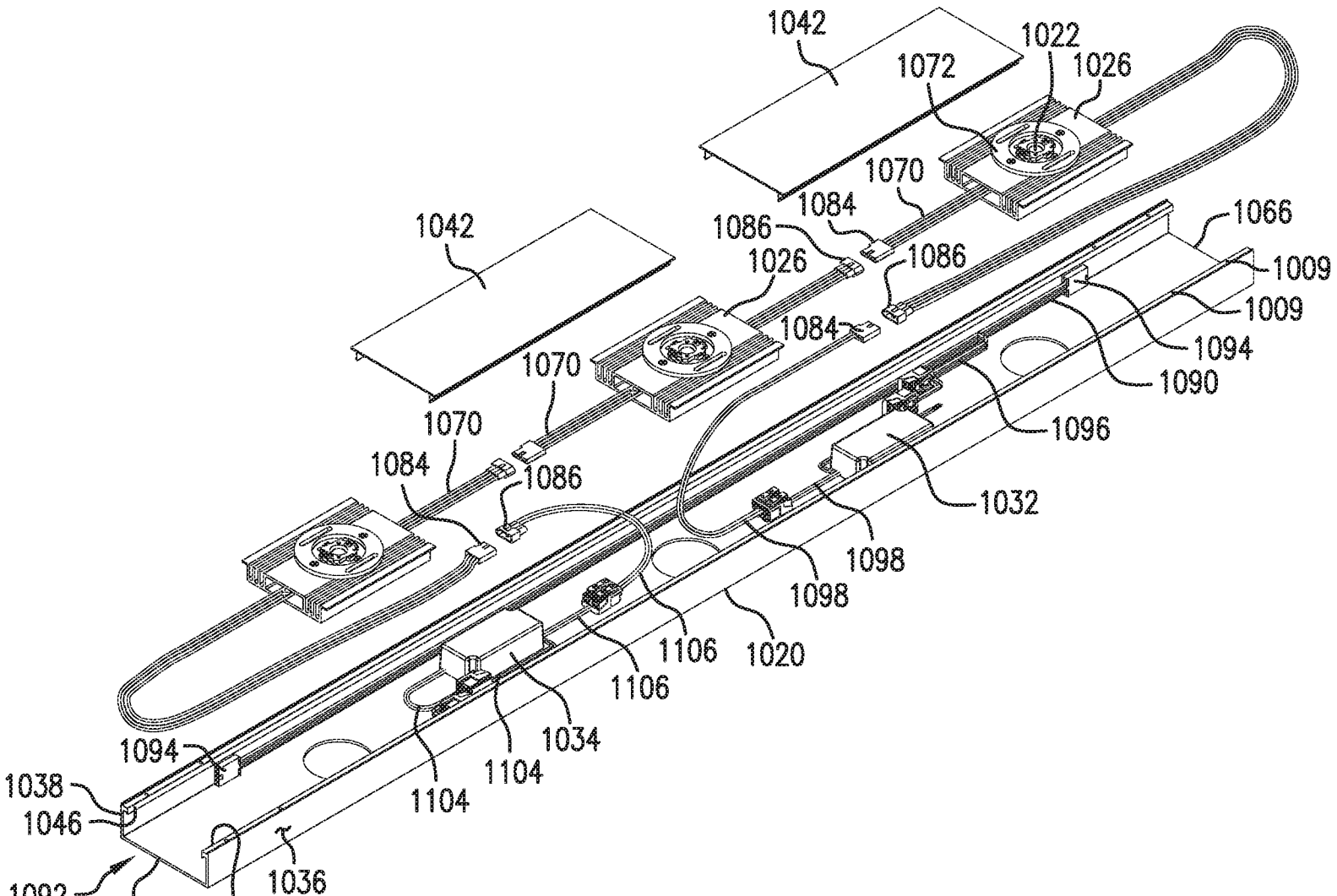
FIG. 3 is an exploded perspective view illustrating the beam of FIG. 1A according to an embodiment.

Referring to FIG. 3, the housing 1020 of the beam 1006 may be made of a metal, plastic, or other material suitable for supporting the weight of the beam 1006 and the weight of the components included in the beam 1006. For example, the beam 1006 can be made of a lightweight metal such as aluminum, or an aluminum alloy. Thus, the housing 1020 can be made strong and light. In an embodiment, the beam 1006 is made of extruded aluminum.

Figure 1D:
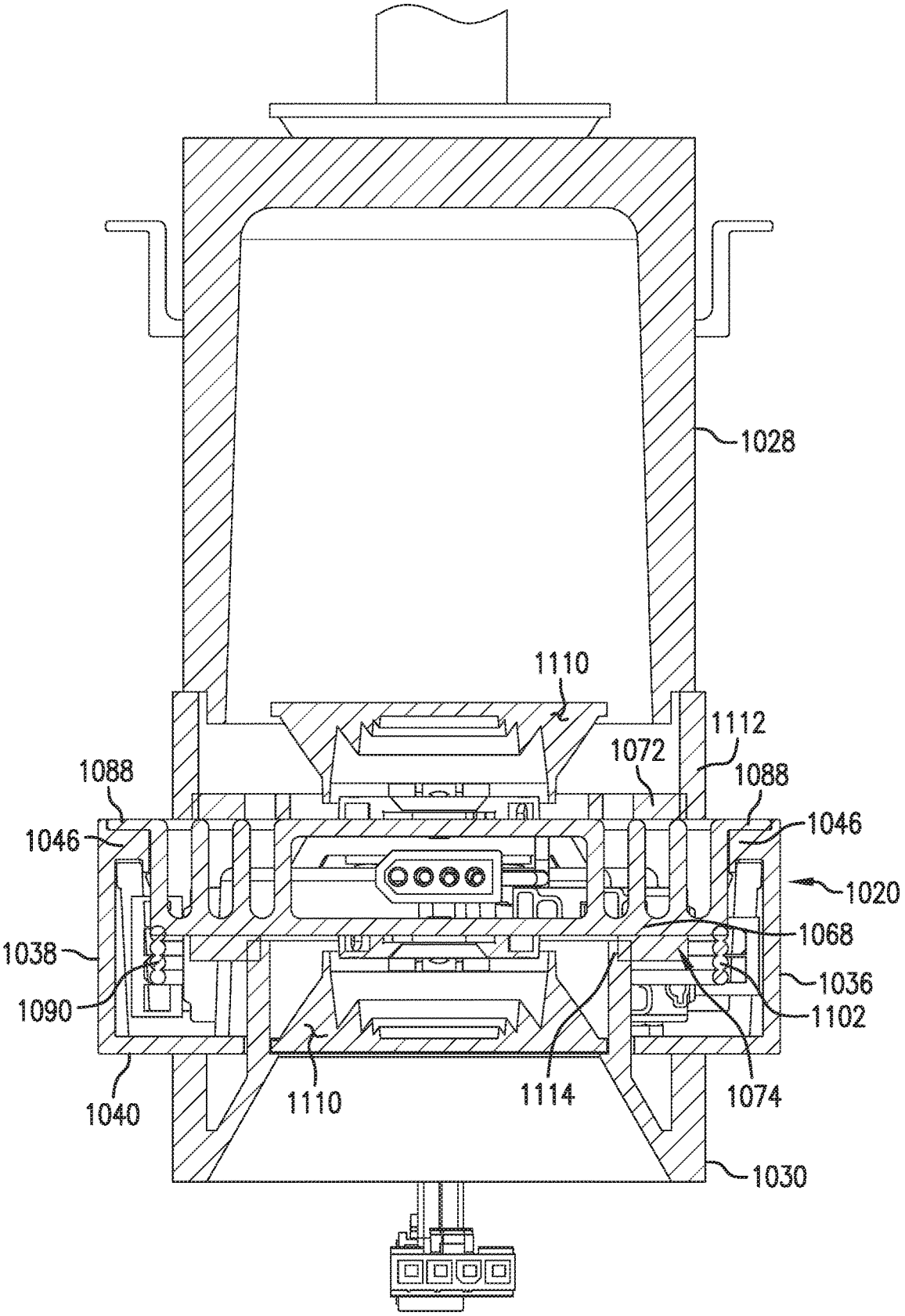
FIG. 1D is a cross-sectional view taken along line A-A of FIG. 1C.

Referring to FIGS. 1D and 3, the housing 1020 may have a U-like cross-section having a first sidewall 1036, a second sidewall 1038 opposite to the first sidewall 1036, and a third sidewall 1040, or bottom sidewall, connecting the first and second sidewalls 1036 and 1038 to each other. As shown in FIGS. 1D and 3, the first and third sidewalls 1036 and 1038 may each have a rail 1046, for example, an L-shaped rail 1046, extending along the length of the beam 1006. The rails 1046 are configured to selectively couple the beam 1006 with the cover plates 1042 (shown in FIGS. 1B and 3), and to selectively couple the beam 1006 with the connectors 1008 such that the beam 1006 can be suspended through the first and second suspenders 1002 and 1004.

Figure 8:
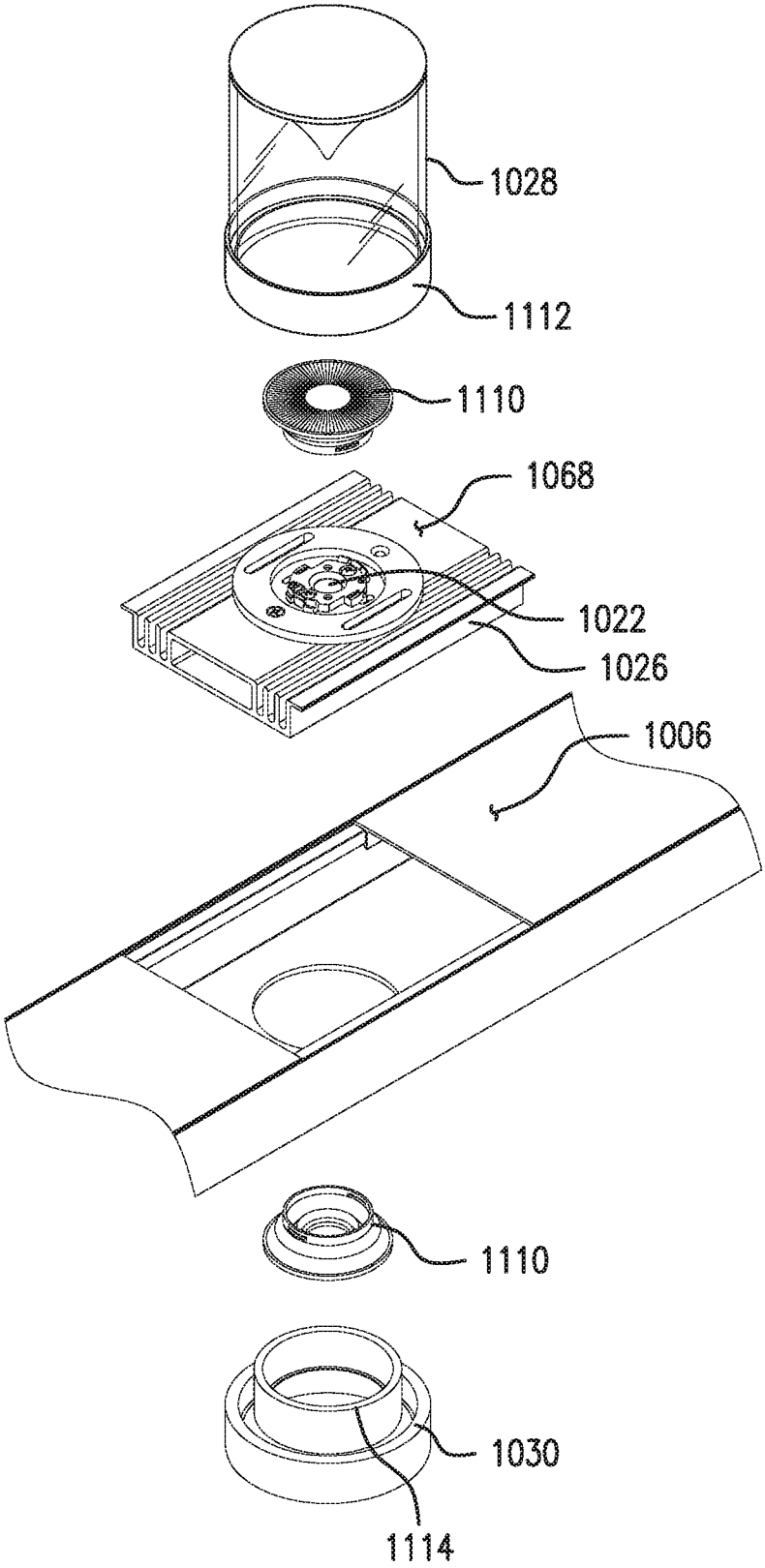
FIG. 8 is an exploded perspective view illustrating a light engine, lenses and casings according to an embodiment.

Each light engine 1026 is configured to generate light. Referring to FIG. 8, each of the light engines 1026 may include a body 1068, a light source 1022 (see FIG. 8, FIG. 6C also shows the light source 1022 under one of the lenses 1110) disposed on a first side (e.g., the upper side) of the body 1068 for providing illumination upwardly, a light source 1024 (shown in FIG. 6C) disposed on a second side (e.g., the bottom side) of the body 1068 for providing illumination downwardly, a connection ring 1072 (see FIGS. 6A and 6C) disposed on the first side of the body 1068, a connection ring 1074 (see FIGS. 6B-6C) disposed on the second side of the body 1068, and a cable 1070 (see FIGS. 6A-6C) extending through the body 1068. The first and second sides of the body 1068 may be opposite to each other.

Figure 6A:
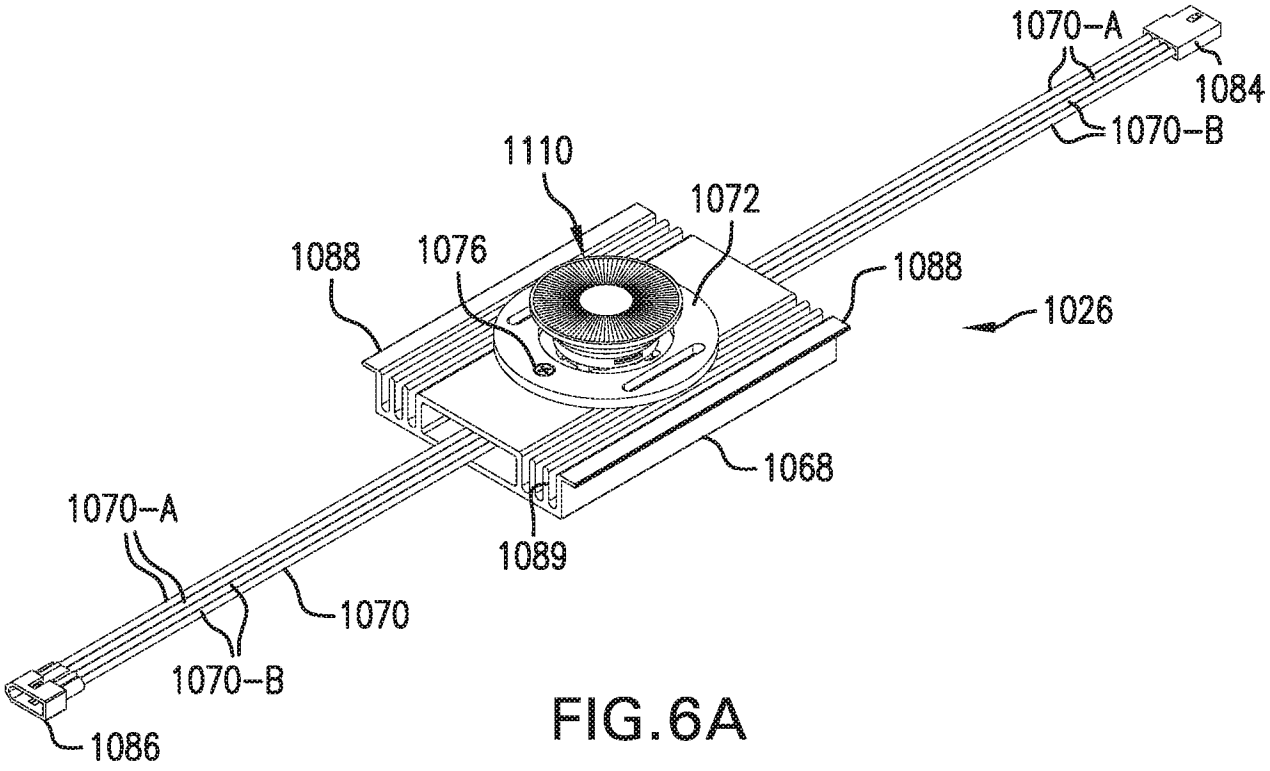
FIGS. 6A-6B are respectively top and bottom perspective views illustrating a light engine according to an exemplary embodiment.
Figure 6B:
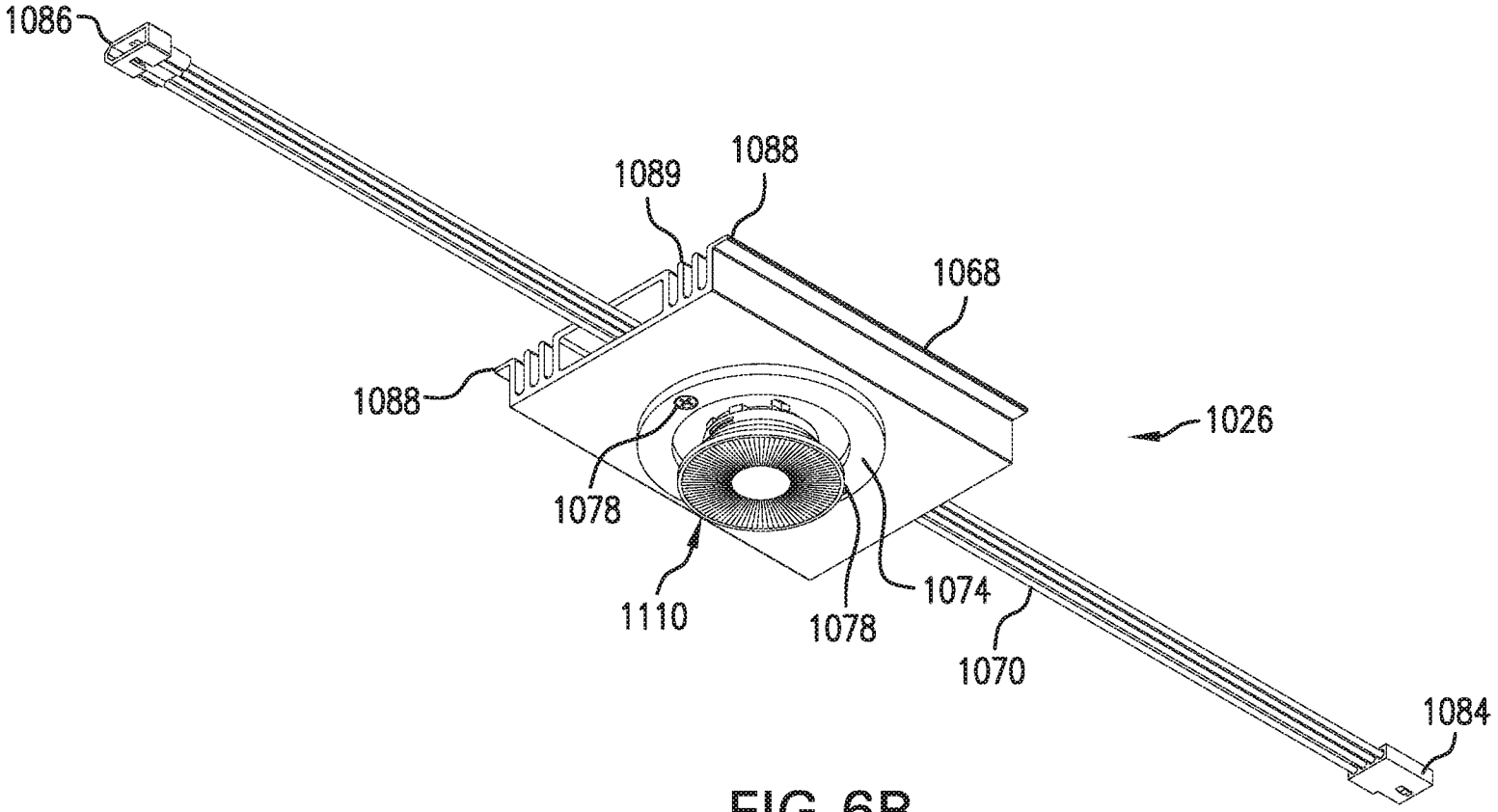
Figure 6C:
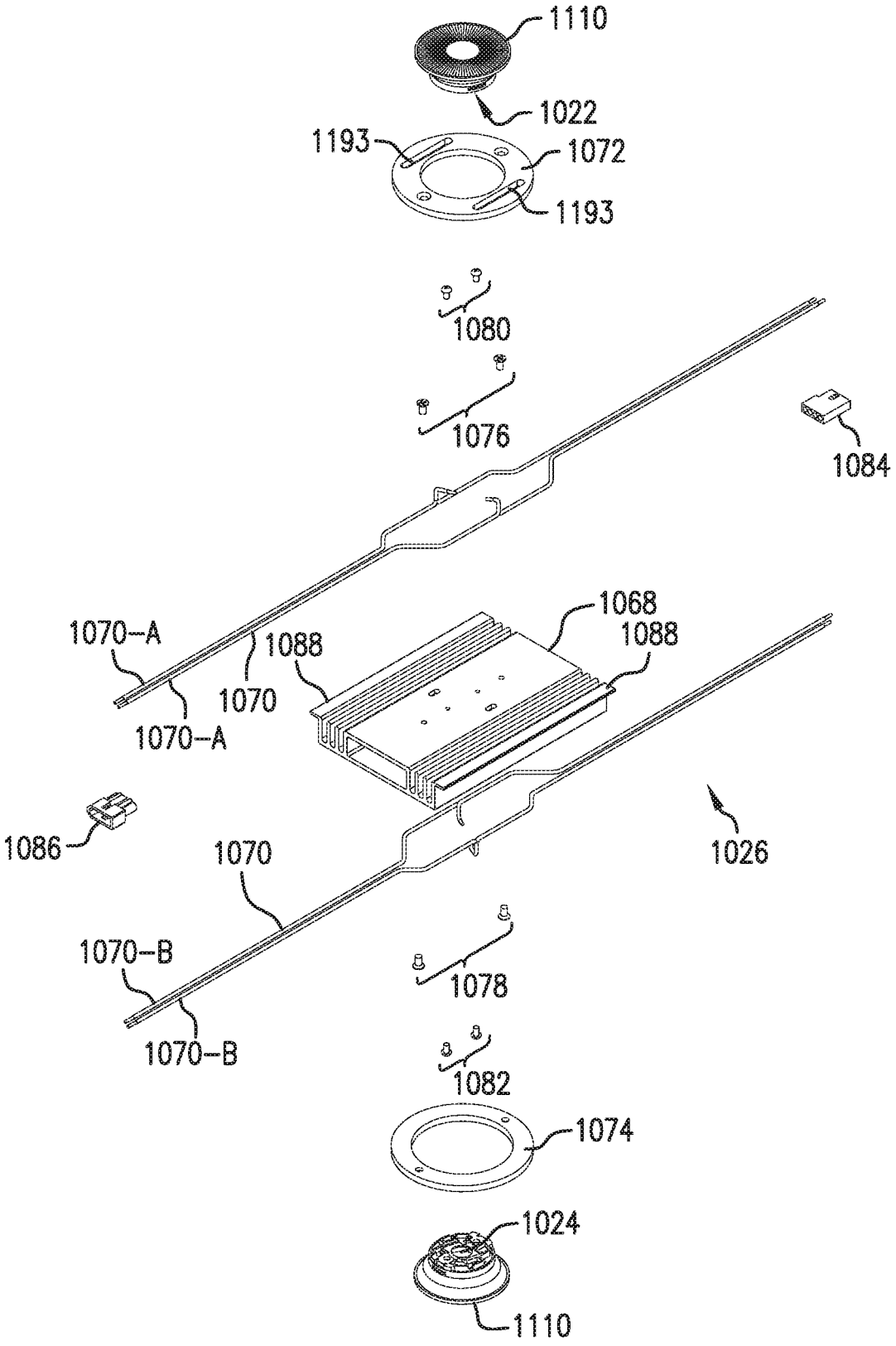
FIG. 6C is an exploded perspective view illustrating the light engine of FIGS. 6A-6B.

The body 1068 may be made of a metal, plastic, etc. As shown in FIGS. 6A-6C, the body 1068 may have fins 1089 for dissipating the heat released from the light sources 1022 and 1024. Thus, the body 1068 may serve as a heatsink. In an embodiment, the body 1068 is made of a metal to dissipate heat efficiently. In addition, with reference to FIG. 6C, the body 1068 may be hollow so as to have a low weight.

Referring to FIGS. 6A-6C, the first side of the body 1068 may include a pair of flanges 1088. Referring to FIG. 1D, the flanges 1088 may be disposed along the rails 1046, respectively. As shown in FIG. 1D, the flanges 1088, as well as the first side of the body 1068, may be flush with an upper side of the beam 1006 (e.g., flush with the top portion of the first and second sidewalls 1036 and 1038 of the housing 1020).

Since the first side (upper side) of the body 1068 may be flush with the top portion of the beam 1006, the body 1068 may also serve as a cover for the beam 1006. Thus, no cover plate 1042 is not needed over the light engines 1026 in order to cover the components of the beam 1006. Thus, the construction of the lighting system 1000 may be simplified and the weight of the beam 1006 may be kept low.

The body 1068 may be attached to the beam 1006 through various fastening mechanisms (not shown). For example, screws may be used to attach the body 1068 to the beam 1006, the body 1068 may be frictionally engaged with the beam 1006, etc.

Referring to FIG. 6C, the connection ring 1072 may be selectively connected to the first side of the body 1068 through, for example, a pair of screws 1076 (one of the screws 1076 is also shown in FIG. 6A). Referring to FIGS. 6B-6C, the connection ring 1074 may be selectively connected to the second side of the body 1068 through, for example, a pair of screws 1078.

Referring to FIG. 6C, the first light source 1022 may be selectively connected to the first side of the body 1068 through, for example, a pair of screws 1080, and the second light source 1024 may be selective connected to the second side of the body 1068 through, for example, a pair of screws 1082.

Thus, as shown in FIG. 3, for each light engine 1026, the light source 1022 may be disposed at the opening of the connection ring 1072. As can be understood by the illustration of FIGS. 6B-6C, for each light engine 1026, the light source 1024 may also be disposed at the opening of the connection ring 1074.

The light sources 1022 and 1024 of each of the light engines 1026 may be light emitting diodes (LEDs) since LEDs are energy efficient, small, and have a high light output characteristic. The light sources 1022 and 1024 of each light engine 1026 may be, for example chip-on-board (COB) LEDs. Alternatively, the light sources 1022 and 1024 of the light engines 1026 may be fluorescent bulbs, incandescent bulbs, or other kinds of light sources.

The light sources 1022 of the light engines 1026 may be of the same kind as each other. In addition, the light sources 1024 of the light engines 1026 may be of the same kind as each other. However, the light sources 1022 may be of the same kind as, or of a different kind than, the light sources 1024.

Since the light sources 1022 are configured to provide illumination above the beam 1006, the light sources 1022 may be referred to as uplights. In addition, since the light sources 1024 are configured to provide illumination below the beam 1022, the light sources 1024 may be referred to as downlights.

For each light engine 1026, with reference to FIG. 6C, the cable 1070 may include a first set of two wires 1070-A electrically connected to the light source 1022, and a second set of two wires 1070-B electrically connected to the light source 1024.

Referring to FIGS. 6A-6C, the cable 1070 may have a first end connected to a male plug 1084 and a second end connected to a female plug 1086. The male and female plugs 1084 and 1086 of one light engine 1026 may be configured to be selectively coupled to one another, and therefore, to be selectively coupled to the male and female plugs 1084 and 1086 of the other light engines 1026 (see FIG. 3, illustrating that neighboring light engines can be electrically connected to one another thorough the cables 1070).

Thus, the light engines 1026 may be electrically connected to each other, as indicated in FIG. 3, by connecting the male plug 1084 of one of the light engines with the female plug 1086 of the neighboring light engine 1026.

The male plug 1084 may be configured to be coupled to the female plug 1086 in only one way. For example, as shown in FIGS. 6A and 6B, the female plug 1086 may have a trapezoidal shape, and the male plug 1084 may also have a trapezoidal shape that matches the shape of the female plug 1086. Thus, the alignment of the male plug 1084 needs to match the alignment of the female plug 1086 in order for the male plug 1084 to be inserted into the female plug 1086.

As shown in FIG. 6B, the first set of two wires 1070-A may be connected at one end to two predefined terminals of the female plug 1086, and at the other end to two corresponding terminals of the male plug 1084.

Since all of the light engines 1026 have the same configuration as one another, as shown in FIG. 3, when connecting the cable 1070 of one light engine 1026 with the cable 1070 of a neighboring light engine 1026, the light sources 1022 of the two connected light engines 1026 are electrically connected to one another through the first set of wires 1070-A of each respective engine 1026.

Similarly, the second set of wires 1070B of each light engine 1026 is electrically connected to corresponding terminals of the male and female plug 1084 and 1086. Thus, when connecting the cable 1070 of one light engine 1026 with the cable 1070 of a neighboring light engine 1026, the light sources 1024 of the two connected light engines 1026 are electrically connected to one another through the second set of wires 1070-B of each respective engine 1026.

Accordingly, when connecting the plurality of light engines 1026 (see FIG. 3) to one another, the cables 1070 of the light engines 1026 form two separate circuits, one circuit electrically connecting the light sources 1022 to one another (through the first set of wires 1070-A), and another circuit electrically connecting the light sources 1024 to one another (through the second set of wires 1070-B).

Since the male and female plugs 1084 and 1086 need to have matching alignments in order to be coupled to one another, there is no risk of mixing the first set of wires 1070-A of one light engine 1026 with the second set of wires 1070-B of another light engine 1026.

In addition, since the light sources 1022 and the light sources 1024 are connected to different circuits, the light sources 1022 and 1024 may be electrically driven independently of each other. In other words, the light sources 1022 may be turned on and off (and dimmed, when applicable) independently of the light sources 1024, and vice-versa.

The first diving circuit 1032 may be configured to drive the light sources 1022. The second driving circuit 1034 may be configured to drive the light sources 1024. This will be described below in detail.

Figure 4A:
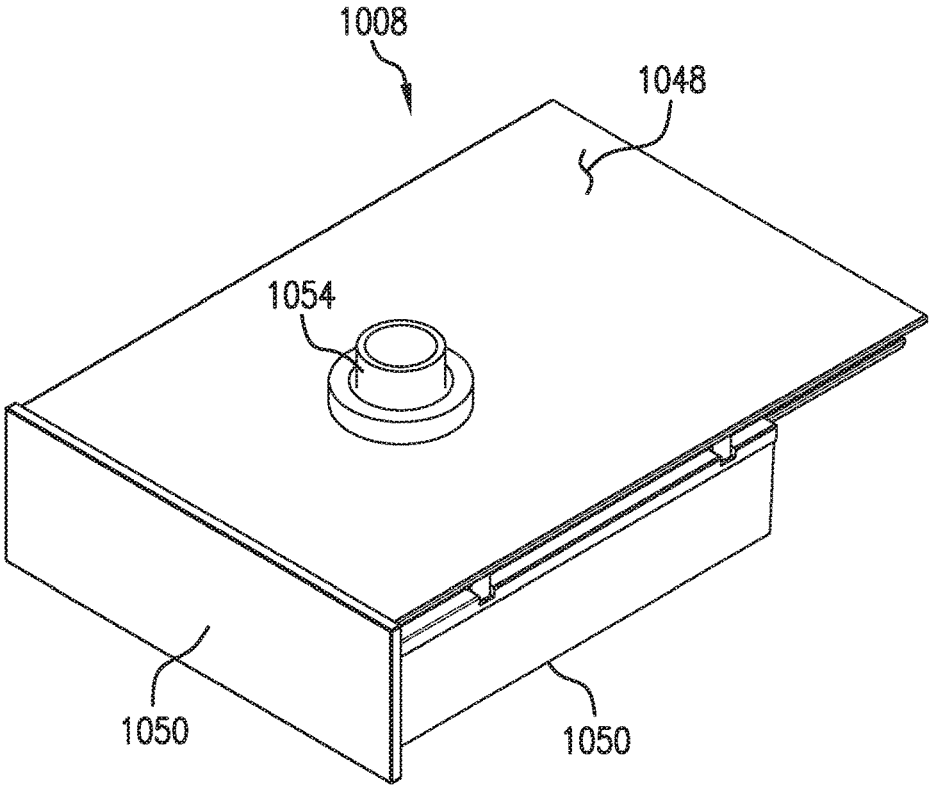
FIGS. 4A-4B are respectively top and bottom perspective views illustrating a connector according to an exemplary embodiment.
Figure 4B:
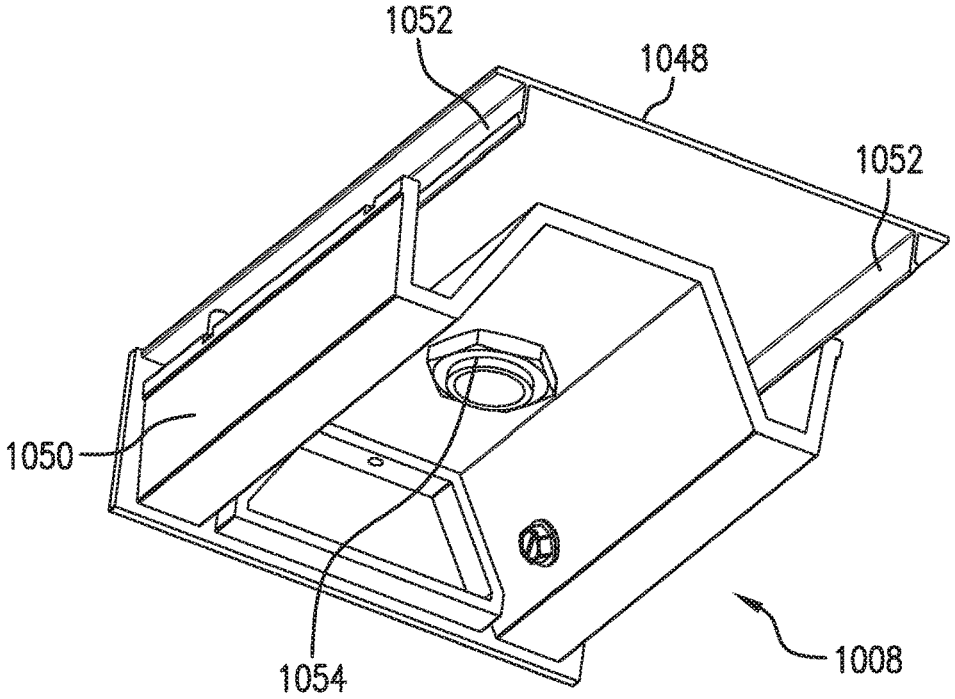

Referring to FIGS. 4A and 4B, each connector 1008 may include an upper sidewall 1048 covering an upper side of the beam 1006, an end sidewall 1050 closing a respective end 1092 or 1066 (see FIG. 3) of the beam 1006, an elongated member 1050 having a W-like shape (or a corrugated member 1050) providing structural support to the connector 1008 and configured to be inserted into the beam 1006, a pair of rails 1052 configured to be selectively coupled to the rails 1046 of the beam 1006 for selectively coupling the first connector 1008 with the beam 1006 (e.g., by sliding each connector 1008 through its respective beam end 1092 or 1066, or by snapping the first connector 1008 onto the end portion of the beam 1006 to engage the rails 1046 with the rails 1052), and a hollow coupler 1054 extending from the upper sidewall 1048.

The beam 1006 and the first connector 1008 may also be selectively attached to each other by using, for example, screws. See, for example, screw hole locations 1009 in FIG. 3.

The portion of the hollow coupler 1035 protruding above the upper sidewall 1048 is illustrated in FIG. 4A to have a smooth exterior surface. However, although not shown in the drawings, the portion of the hollow coupler 1035 protruding above the upper sidewall 1048 may also be threaded. Whether threaded or smooth, the portion of the hollow coupler 1035 protruding above the upper sidewall 1048 is configured to structurally connect each connector 1008 with a respective one of the first and second suspenders 1002 and 1004.

For example, although not shown in the drawings, the hollow coupler 1054 of each connector 1008 may be threaded, and the hollow member 1016 of each suspender 1002 and 1004 may also be threaded. Thus, the hollow coupler 1054 of each connector 1008 may be selectively coupled to the hollow member 1016 of the suspender 1002 and to the hollow member 1016 of the suspender 1004, as shown in FIG. 1A. Alternatively, or in addition, other fastening mechanisms may be used to couple the first suspender 1002 with one of the connectors 1008 and to couple the second suspender 1004 with the other connector 1008. These mechanisms may include, for example, using set screws, glue, a snap-on mechanism, frictional forces, etc.

It is understood that the mechanism described above for coupling the first and second suspenders 1002 and 1004 with the connectors 1008 may also be employed to couple the third and fourth suspenders 1002-A and 1004-B with the connectors 1008.

Referring back to FIG. 1C, the first suspender 1002 includes the cable 1018. The cable 1018 may be used to electrically connect an external power source (e.g., the building or venue power supply cables) with the beam 1006 for driving the light sources 1022 and 1024. In addition, the cable 1018 may also be connected to a remote dimmer (not shown in the drawings) for dimming the light sources 1022 and 1024. In other words, the cable 1018 may transmit both electrical power and dimming control signals to the beam 1006.

The external power source may provide current of a first type, for example, alternating current (AC) at a first difference of potential, for example, 110 volts. A switch (not shown), such as a wall switch located at a remote location, may be used to electrically connect and disconnect the cable 1018 from the external power source to turn on and off the light sources 1022 (but not the light sources 1024), to turn on and off the light sources 1024 (but not the light sources 1022), or to turn on and off the light sources 1022 and the light sources 1024 together.

The dimmer (not shown) may be, for example, a 0-10 volt dimmer, and may be located at a remote location (e.g., at a wall switch), for providing dimming control signals to the beam 1006 through the cable 1018. However, the dimmer may also be omitted in some embodiments.

Figure 5A:
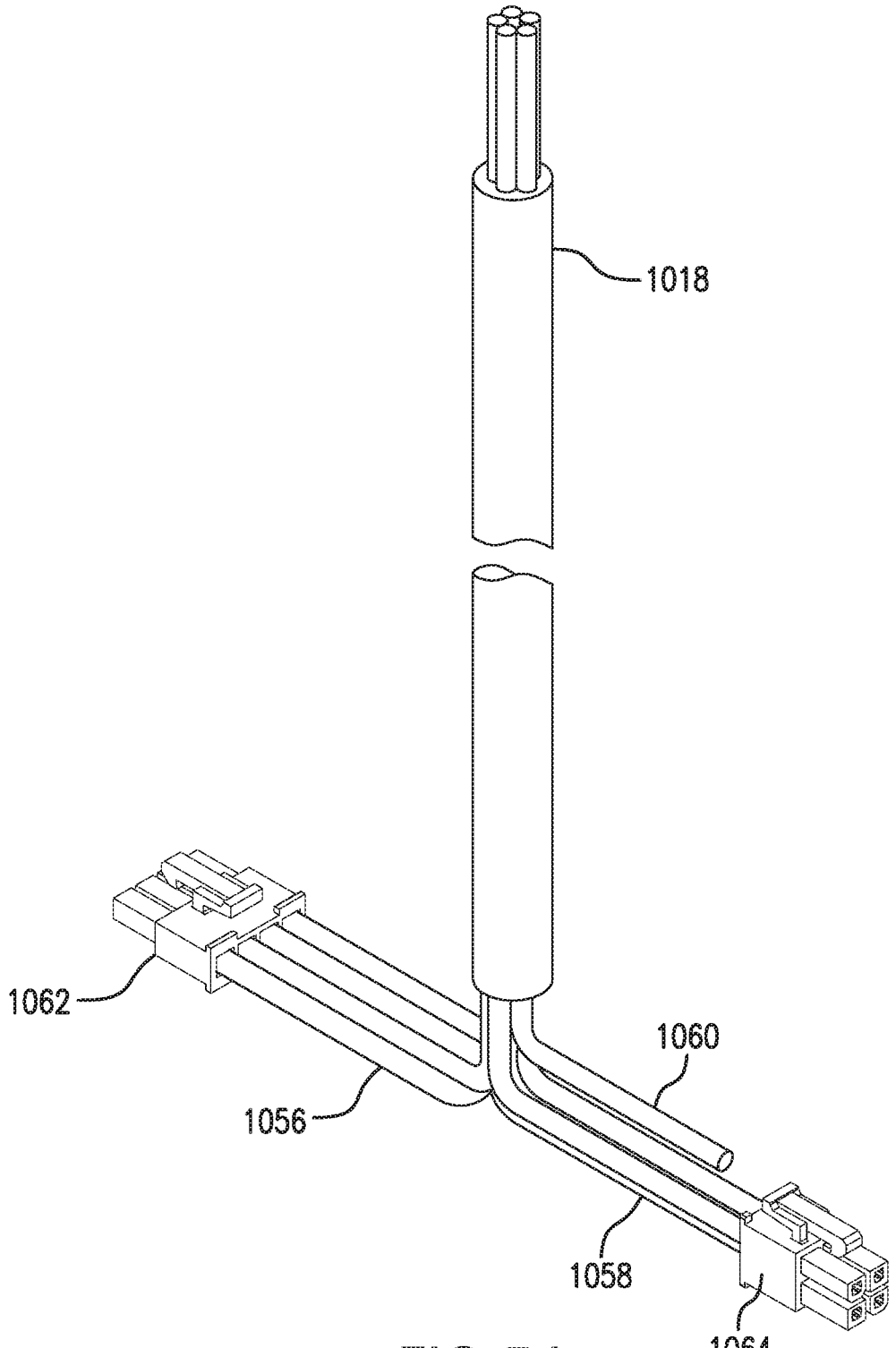
FIG. 5A is a perspective view illustrating a portion of a cable included in a suspender; according to an exemplary embodiment.

Referring to FIG. 1C, the cable 1018 may be split into two cables, cable 1056 and cable 1058. FIG. 5A illustrates the cables 1018, 1056 and 1058 more clearly.

As shown in FIG. 5A, cable 1018 may include five wires, two of which (e.g., hot wires) may transmit electrical power from the external power source to the beam 1006, another two may transmit dimming control signals from the dimmer to the beam 1006, and the fifth one being a ground wire. The hot wires may transmit, for example 110 VAC.

As shown in FIG. 5A, the cable 1018 may be split into two cables, cable 1056, defined by four wires, and cable 1058, also defined by four wires. Cables 1056 and 1058 may be connected in common to the cable 1018. In other words, the two hot wires of the cable 1056 may be respectively electrically connected to the two hot wires of the cable 1018, and the two dimmer control wires of the cable 1056 may be respectively electrically connected to the two dimmer control wires of the cable 1018; and the two hot wires of the cable 1058 may be respectively electrically connected to the two hot wires of the cable 1018, and the two dimmer control wires of the cable 1058 may be respectively electrically connected to the two dimmer control wires of the cable 1018.

A wire 1060, shown in FIG. 5A, may be a ground wire configured to ground the beam 1006.

As shown in FIG. 5A, the cable 1056 may terminate in a male plug 1062 of a first type (e.g., a 4×1 plug). The male plug 1062 is shown more clearly in FIG. 5B. The two power wires and the two dimmer control wires of the cable 1056 may be arranged in a predefined order in the prongs of the male plug 1062.

Referring to FIG. 5A, the cable 1058 may terminate in a male plug 1064 of a second type (e.g., a 2×2 plug). The male plug 1064 is shown more clearly in FIG. 5C. The two power wires and the two dimmer control wires of the cable 1058 may be arranged in a predefined order in the prongs of the male plug 1062.

The cable 1056 may transmit electrical power and dimming control signals to the first driving circuit 1032 for driving the light sources 1022. As shown in FIG. 3, a cable 1090 and a cable 1096 may be used to electrically connect the cable 1056 with the first driving circuit 1032 to transmit electrical power and dimming control signals to the first driving circuit 1032. FIG. 1D also illustrates the cable 1090.

The cable 1090, shown FIGS. 1D and 3, may include four wires. As shown in FIG. 3, the cable 1090 may extend between the ends 1066 and 1092 of the beam 1006. In addition, the cable 1090 may be disposed adjacent to the second sidewall 1038, as shown in FIGS. 1D and 3.

Figure 5B:
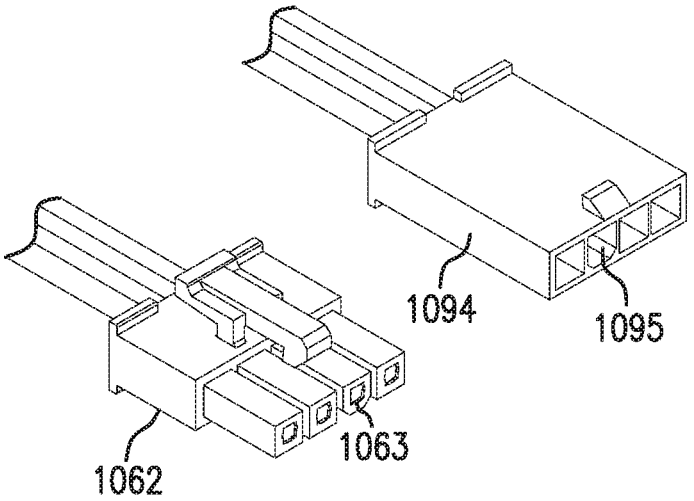
FIGS. 5B-5C are perspective views illustrating various cables and plugs according to an exemplary embodiment.

As shown in FIG. 3, the cable 1090 may terminate in a female plug 1094 at each of its ends, near the ends 1066 and 1092 of the beam 1006. The female plug 1094 is shown in FIG. 5B. The female plug 1094 may be of the same type (e.g., the first type, or a 4×1 plug), as the male plug 1062 and may be configured to be coupled with the male plug 1062 to electrically connect the cable 1090 with the cable 1056.

Referring to FIG. 5B, the male and female plugs 1062 and 1094 may respectively have a trapezoidal-shaped prong 1063 and 1095 such that the male and female plugs 1062 and 1094 can be connected to each other in only one way; thus, maintaining the order of the wires in the cable 1090. In addition, the male and female plugs 1062 and 1094 may have a selective locking mechanism, as shown in FIG. 5B, to maintain the electrical connection therebetween once coupled.

Referring to FIG. 3, a cable 1096 may be connected to the cable 1090 and to the first driving circuit 1032 for transmitting power from the two hot wires and the two dimmer control wires of the cable 1090 to the first driving circuit 1032. The first driving circuit 1032 may be, for example, an LED driver configured to receive as input power from the two hot wires and the two dimmer control wires of the cable 1096, and to generate output power for driving the light sources 1022 based on the input power and dimmer control signals.

The first driving circuit 1032 may output, for example, current of a second type (e.g., direct current (DC)), at a second difference of potential (e.g., 12 volts, 24 volts, etc., based on the current and difference of potential requirement of the light sources 1022) to the light engines 1026 through a cable 1098.

As shown in FIG. 3, the cable 1098 may include two wires. Referring to FIG. 3, the cable 1098 may terminate in a male plug 1084. Referring to FIG. 3, the two wires of the cable 1098 may be connected to the two prongs of the male plug 1084 of one of the light engines 1026 (e.g., the light engine 1026 on the right-hand side of FIG. 3) that correspond to the first set of two wires 1070-A. Thus, the first driving circuit 1032 may drive the light sources 1022 through the cable 1098 and the cable 1070 of each of the light engines 1026.

The cable 1058 (see FIG. 5A) may transmit electrical power and dimming control signals to the second driving circuit 1034 for driving the light sources 1024. A cable 1102 (see FIG. 1D) and a cable 1104 (see FIG. 3) may be used to electrically connect the cable 1058 with the second driving circuit 1034 to transmit electrical power and dimming control signals to the second driving circuit 1034.

The cable 1102, shown FIG. 1D, may include four wires. The cable 1102 may extend between the ends 1066 and 1092 of the beam 1006, similarly to the cable 1090 (see FIG. 3 for cable 1090). As shown in FIG. 1D, the cable 1090 may be disposed adjacent to the first sidewall 1036. The cable 1102 may have approximately the same length as the cable 1090, and the female plugs 1093 (see FIG. 5C) of the cable 1102 may have approximately the same separation distance from the ends 1066 and 1092 of the beam 1106 as the female plugs 1094 of the cable 1090.

Figure 5C:
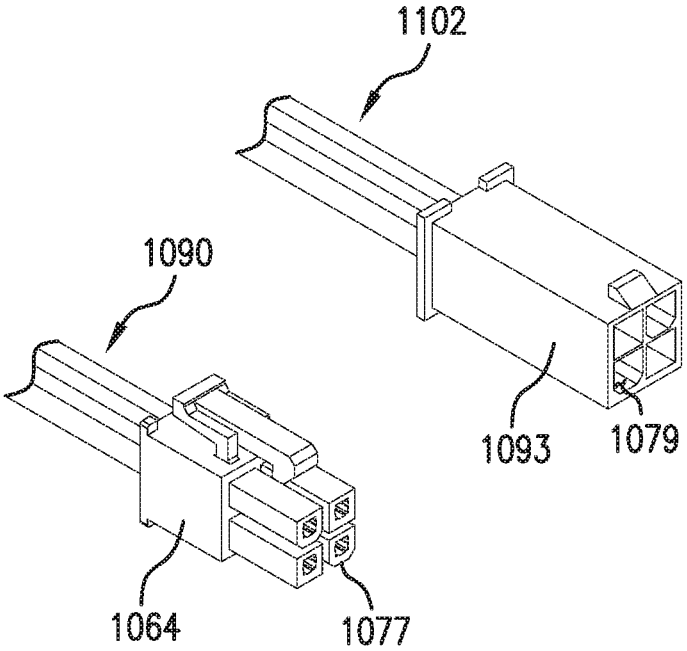

Referring to FIG. 5C, the female plug 1093 may be of the same type (e.g., the second type, or a 2×2 plug) as the male plug 1064, and may be configured to be coupled with the male plug 1064 to electrically connect the cable 1102 with the cable 1058.

Referring to FIG. 5C, the male and female plugs 1064 and 1093 may respectively have a trapezoidal-shaped prong 1077 and a trapezoidal-shaped prong 1079 such that the male and female plugs 1064 and 1093 can be connected to each other in only one way; thus, maintaining the order of the wires in the cable 1102. In addition, the male and female plugs 1064 and 1093 may have a selective locking mechanism, as shown in FIG. 5C, to maintain the electrical connection therebetween once coupled.

A cable 1104 (see FIG. 3) may be connected to the cable 1102 and to the second driving circuit 1034 for transmitting power from the two hot wires and the two dimmer control wires of the cable 1102 to the second driving circuit 1034. The second driving circuit 1034 may be, for example, an LED driver configured to receive as input power from the two hot wires and the two dimmer control wires of the cable 1104, and to generate output power for driving the light sources 1024 based on the input power and dimmer control signals.

The second driving circuit 1034 may output, for example, electrical current of a second type (e.g., direct current (DC)), at a second difference of potential (e.g., 12 volts, 24 volts, etc., based on the current and difference of potential requirement of the light sources 1024) to the light engines 1026 through a cable 1106 (see FIG. 3).

As shown in FIG. 3, the cable 1106 may include two wires. Referring to FIG. 3, the cable 1106 may terminate in a female plug 1086. Referring to FIG. 3, the two wires of the cable 1106 may be connected to the two prongs of the female plug 1086 of one of the light engines 1026 (e.g., the light engine 1026 on the left-hand side of FIG. 3) that correspond to the second set of two wires 1070-B. Thus, the second driving circuit 1034 may drive the light sources 1024 through the cable 1106 and the cable 1070 of each of the light engines 1026.

Thus, the cables 1070 of the light engines 1026 form two separate electrical circuits, one for providing power to the light sources 1022, and one for providing power to the light sources 1024.

In addition, since the male and female plugs 1084 and 1086 are can be selectively and quickly coupled and uncoupled to one another, any one of the light engines 1026 can be easily replaced when needed. Thus, in case of a defect, any one of the light engines 1026 can be easily removed and replaced with another light engine 1026. In some instances, however, as will be described below, a light engine 1026 can be replaced with another kind of a light engine, which is different from, but electrically compatible with, the light engines 1026.

The interchangeability feature of the light engines 1026 enables the lighting system 1000 to be adapted to various lighting needs, to easily be reconfigured after installation (if there is a change in the lighting needs of the venue) and to easily be repaired when needed.

In addition, as shown in FIGS. 1D and 3, the flanges 1088 of the light engines 1026 guide the light engines 1026 to be inserted into the beam 1006 correctly, with the upper side of the light engines 1026 facing upwardly. Thus, the rate of error of installing the light engines 1026 incorrectly (e.g., upper side down) during the assembly process of the beam 1006 is virtually eliminated.

As described above, the cables 1056 and 1058 may be connected in common to the cable 1018. In this case, all of the light sources 1022 and 1024 are operated together as a single group since they derive power from the same four wires of the cable 1018. Thus, in this case, all of the light sources 1022 and 1024 may be switched on and off together, and may be dimmable together.

However, as may be appreciated, the light sources 1022 may also be operated independently of the light sources 1024 since the light sources 1022 and 1024 are driven by different driving circuits (the first and second driving circuits 1032 and 1034), and the driving circuits 1032 and 1034 input power and dimming control signals from different cables (the cables 1090 and 1102).

Thus, for independent operation of the light sources 1022 and 1024, the cables 1090 and 1102 need to be supplied with power and dimming control signals from independent power sources and dimmers.

Although not shown, the cables 1090 and 1102 may be supplied with power and dimming control signals from two independently-powered cables 1018, or through a cable with at least eight wires. In the case of a cable with at least eight wires, the at least eight wires include a first group of four wires transmitting power from one external power source (two hot wires and two dimming control wires), and a second group of four wires transmitting power from another independent power source (two hot wires and two dimming control wires).

When using two independent cables 1018, the lighting system of FIGS. 1A-1C can be modified (not shown) to have two suspenders 1002, one at each end 1066 and 1092 of the beam 1006. In this case, each of the first two suspenders 1002 may have a cable 1018 as shown in FIG. 5A. As an example, although not shown, the cable 1056, split from one of the two cables 1018, may be connected to the cable 1090, at for example, the end 1066 of the beam 1006, by connecting the male plug 1062 with the female plug 1094 of the cable 1090. In this case, the cable 1058 (not shown), split from the other of the two cables 1018, may be connected to the cable 1102, at the end 1092 of the beam 1006, by connecting the male plug 1064 with the female plug 1093 of the cable 1102.

Thus, the cables 1090 and 1102 of the beam 1006 may be connected to different power sources through different ends of the beam 1006 for independent control of the light sources 1022 and 1024.

It is understood that the number of light engines 1026 and the length of the beam 1006 can be varied as needed.

Figure 7A:
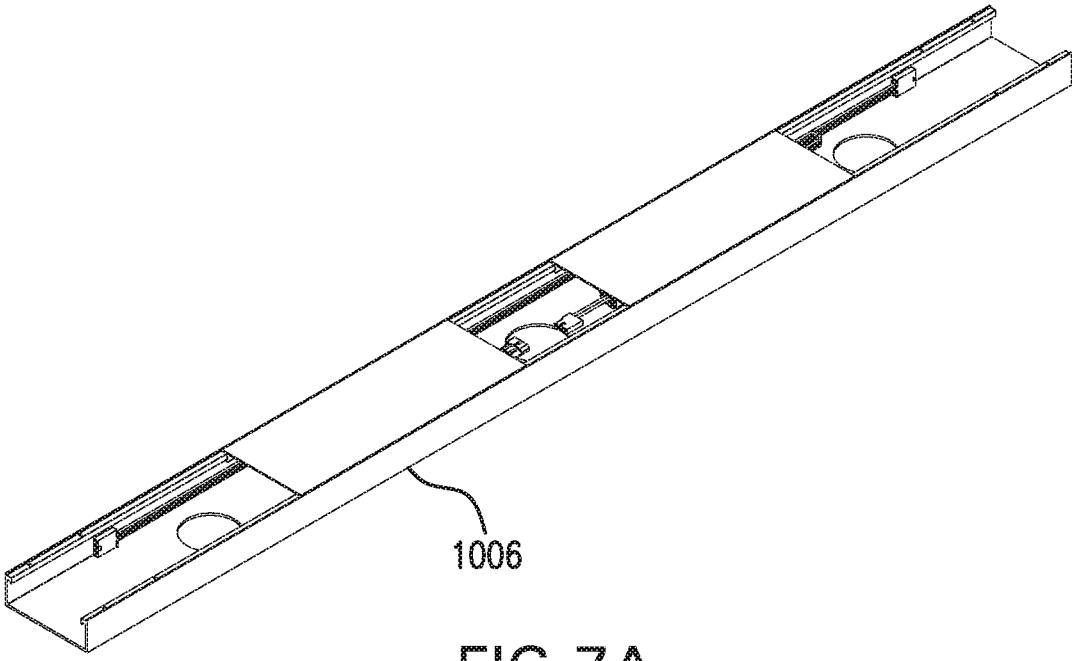
FIGS. 7A-7B are perspective views illustrating beams with different configurations.
Figure 7B:
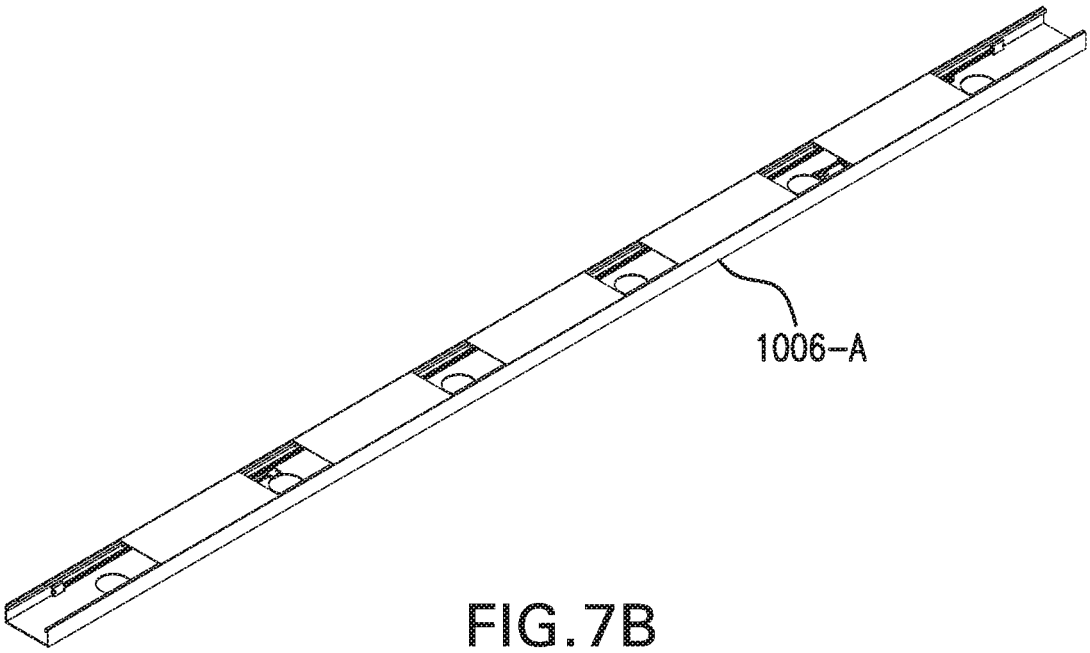

For example, while FIG. 7A illustrates that the beam 1006 is configured to receive three light engines, FIG. 7B illustrates a beam 1006-A configured to receive six light engines.

In addition, FIGS. 3 and 6A-6C illustrate that the light sources 1022 are connected to the first driving circuit 1032 in parallel, and that the light sources 1024 are connected to the second driving circuit 1034 in parallel. However, this is merely exemplary, and the light sources 1022 may be connected to the first driving circuit 1032 is series, and the light sources 1024 may be connected to the second driving circuit 1034 in series.

As shown in FIG. 3, the light engines 1026 are dual sided, and the beam 1006 can accommodate the dual sided light engines in only one compartment (e.g., the area between the first, second and third sidewalls 1036, 1038 and 1040) as opposed to having one compartment for accommodating light engines illuminating the area above the beam 1006 and a separate compartment for accommodating light engines illuminating the area below the beam 1106. In addition, all of the cables, first and second LED drivers 1032 and 1034, etc., fit in the same area as the light engines 1026.

Thus, the beam 1006 needs only one compartment to fit all of its components, which results in a highly efficient use of space. Due to this feature, the beam 1006 may have a relatively simple cross-section (e.g., a U-like cross-section, as illustrated in FIGS. 1D and 3). Due to its simple geometry, the beam 1006 may have a low manufacturing cost.

Further, since each of the cables 1070 includes a bundle of wires for powering both the uplights and the downlights, the circuitry of the beam 1070 is simplified and the number of separate cables and cable connections is reduced.

In addition, since the uplights and downlights can be operated independently, the lighting system 1000 is versatile.

Referring to FIG. 1C, each of the lenses 1110 may be configured to direct, condense, and/or spread the light emitted from the light sources 1022 and 1024. For each light engine 1026, one lens 1110 may be disposed on a light source 1022 (see FIG. 8), and one lens 1110 may be disposed on the light source 1024 (see FIG. 6C). More particularly, and still referring to FIG. 8, for each light engine, one lens 1110 (e.g., an upper lens 1110) may be disposed between the first side (e.g., the upper side) of the body 1068 and the casing 1028 for providing directing, condensing, and/or spreading upwardly, and another lens 1110 (e.g., a lower lens 1110) may be disposed between the second side (e.g., the bottom side) of the body 1068 and the casing 1030 for providing illumination downwardly.

For each light engine 1026, the upper lens 1110 may be selectively coupled to the upper body 1068 and/or the casing 1028, and the lower lens 1110 may be selectively coupled to the lower side of the body 1060 and/or the casing 1030.

The casings 1028 may be selectively coupled to the upper sides of the light engines 1026, and the casings 1030 may be selectively coupled to the lower sides of the light engines 1026.

The casings 1028 and 1030 may be connected to the light engines 1026 rather than to the beam 1006, simplifying the construction of the lighting system 1000.

For each light engine 1026, with reference to FIG. 1D, the casing 1028 may be selectively coupled to the connection ring 1072, and the casing 1030 may be selectively coupled to the connection ring 1074. For example, the casing 1028 may be threaded, and the outer perimeter of the connection ring 1072 may also be threaded to receive the casing 1028. See FIG. 1D, which illustrates that the casing 1028 is coupled to the outer perimeter of the connection ring 1072.

Further, the casing 1030 may be threaded, and the inner perimeter of the connection ring 1074 may also be threaded to receive the casing 1030. See FIG. 1D illustrating that the casing 1030 is coupled to the inner perimeter of the connection ring 1074.

The casings 1028 may be used to help directing, condensing, and/or spreading the light emitted from the light sources 1022, and the casings 1030 may be used to help directing, condensing, and/or spreading the light emitted from the light sources 1024.

Figure 9A:
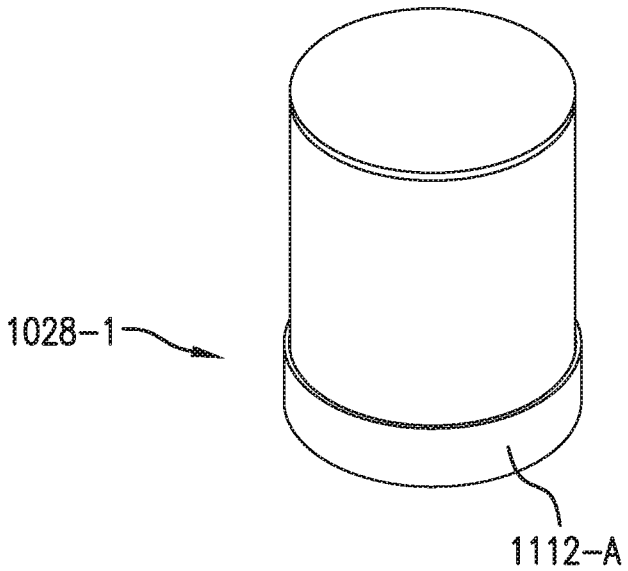
FIGS. 9A-9C are perspective views illustrating various casings that may be disposed in an upper side of a beam.
Figure 9B:
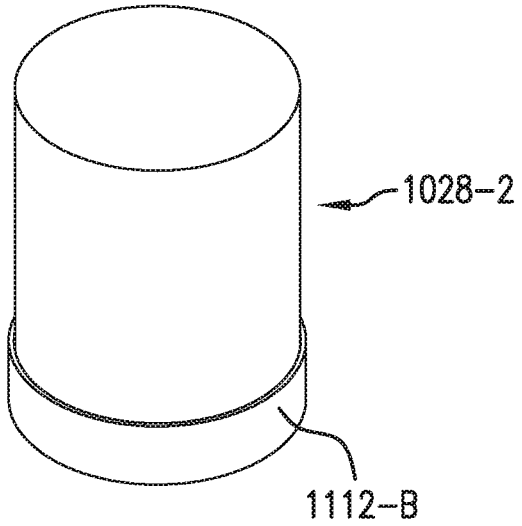
Figure 9C:
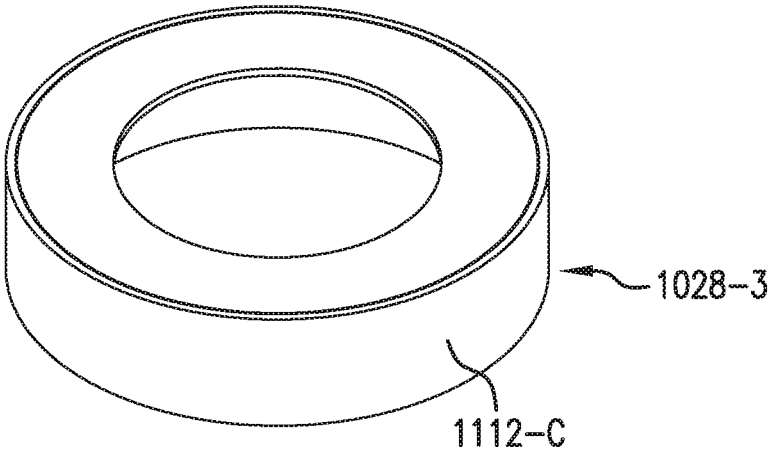

FIGS. 9A-9C illustrates casings 1028-1 to 1028-3 according to alternate embodiments of the invention. The casings 1028-1 to 1028-3 may be disposed on the upper side of the beam 1006. The casings 1028-1 to 1028-3 have respective portions 1112-A, 1112-B, and 1112-C (see FIGS. 9A-9C) configured to be coupled with the upper side of the light engines 1026 through, for example, the connection ring 1072 of each light engine 1026. The portions 1112-A to 1112-C may each be threaded for selective coupling with the threads of the connection ring 1072 of each light engine 1026. The casings 1028-1 to 1028-3 may be used to help directing, condensing, and/or spreading the light emitted from the light sources 1022.

Figure 9D:
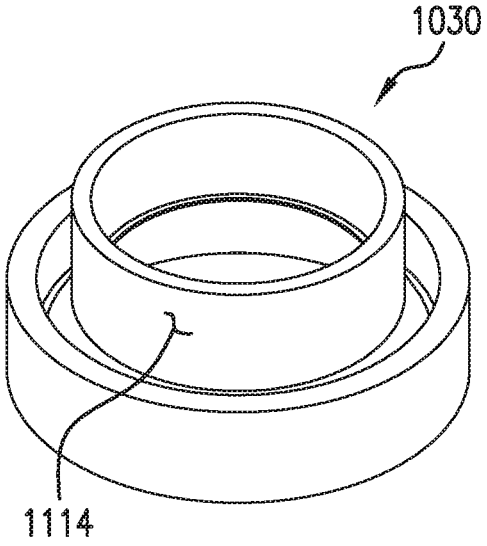
FIG. 9D is a perspective view illustrating a casing that may be disposed in a lower side of a beam.

FIG. 9D illustrates casing 1030, which includes a portion 1114 configured to be selectively coupled to the light engine 1026. For example, the portion 1114 may be threaded to be selectively coupled with the connection ring 1074 of each light engine 1026.

Figure 10A:
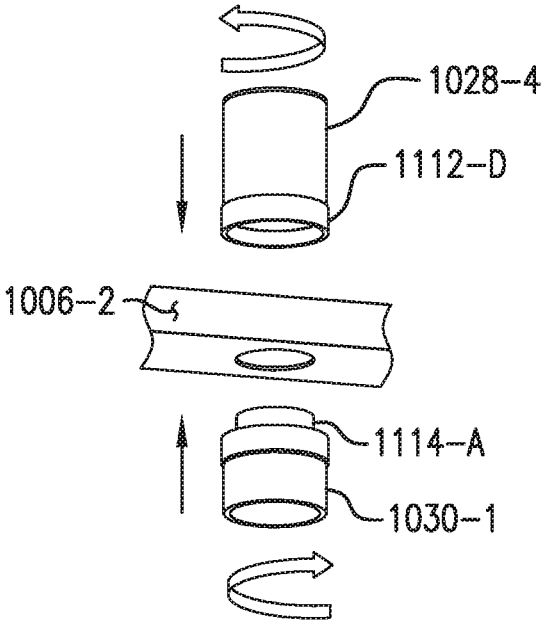
FIGS. 10A-10B are perspective views illustrating a method of installing casings on a beam.
Figure 10B:
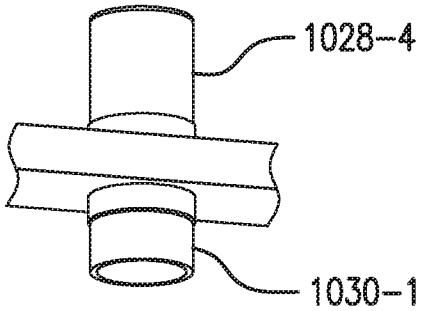
Figure 10C:
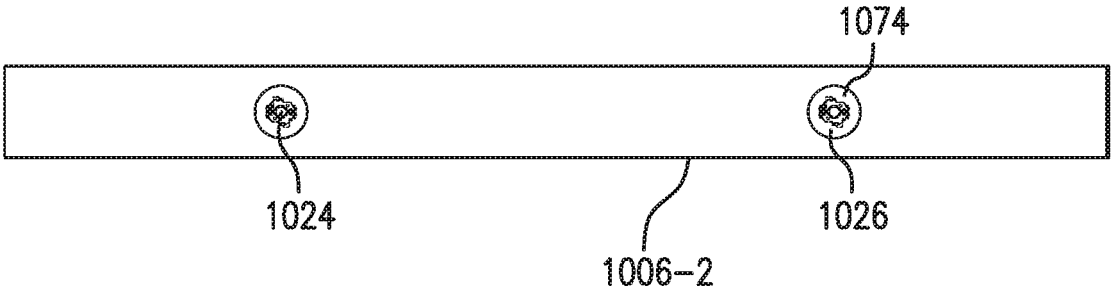
FIGS. 10C-10E illustrates a beam according to an embodiment.
Figure 10D:
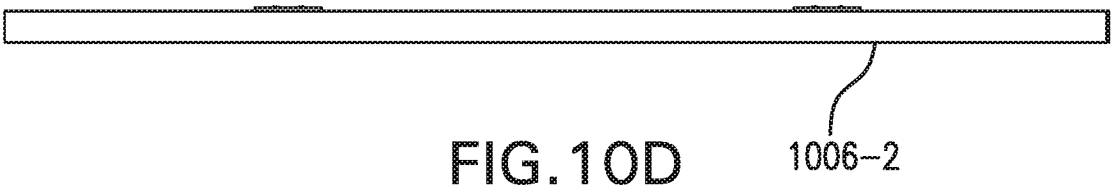
Figure 10E:
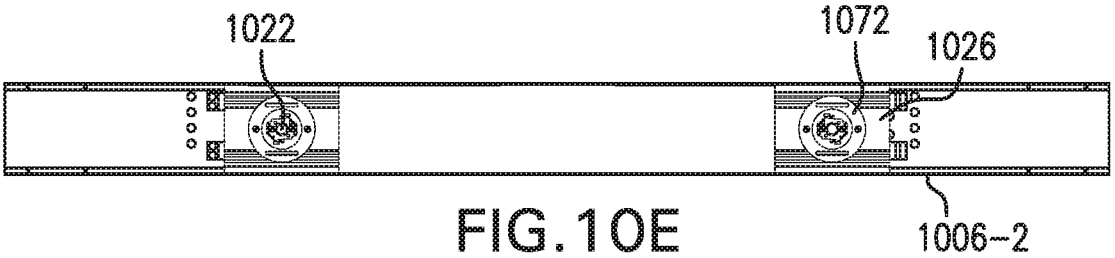
Figure 11A:
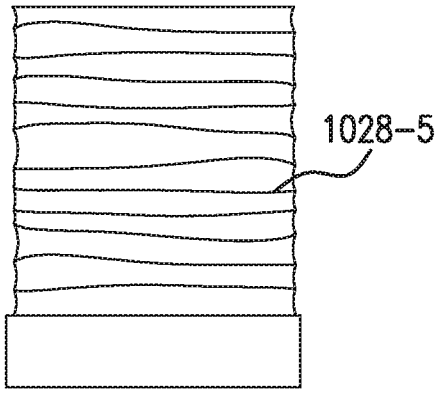
FIGS. 11A-11E are various views illustrating a casing that may be disposed on an upper side of a beam according to an embodiment.
Figure 11B:
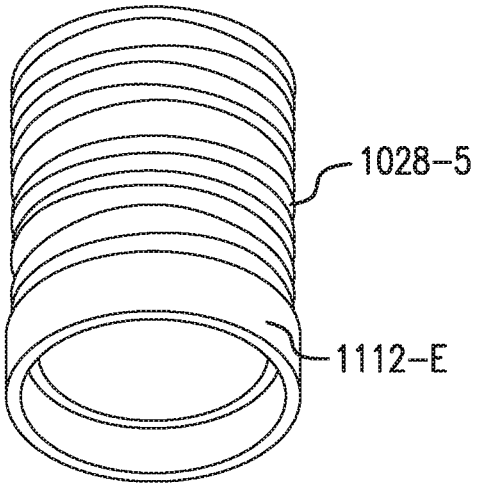
Figure 11C:
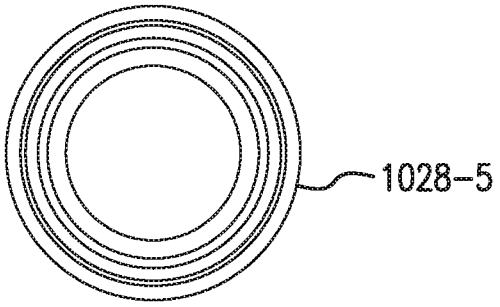
Figure 11D:
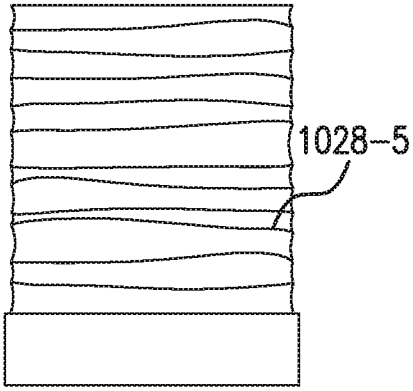
Figure 11E:
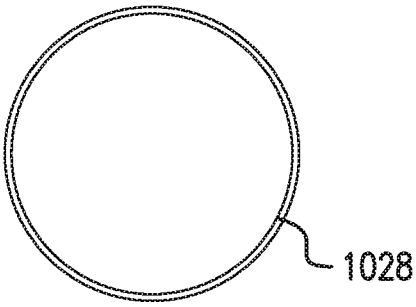
Figure 12A:
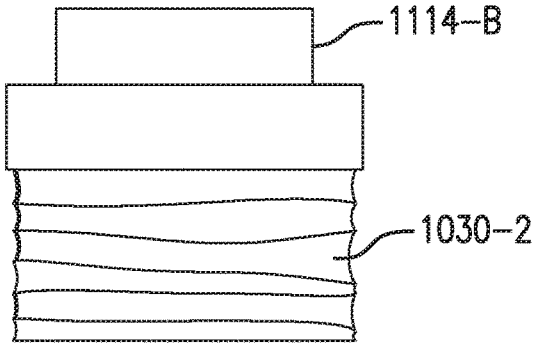
FIGS. 12A-12E are various views illustrating a casing that may be disposed on an upper side of a beam according to an embodiment.
Figure 12B:
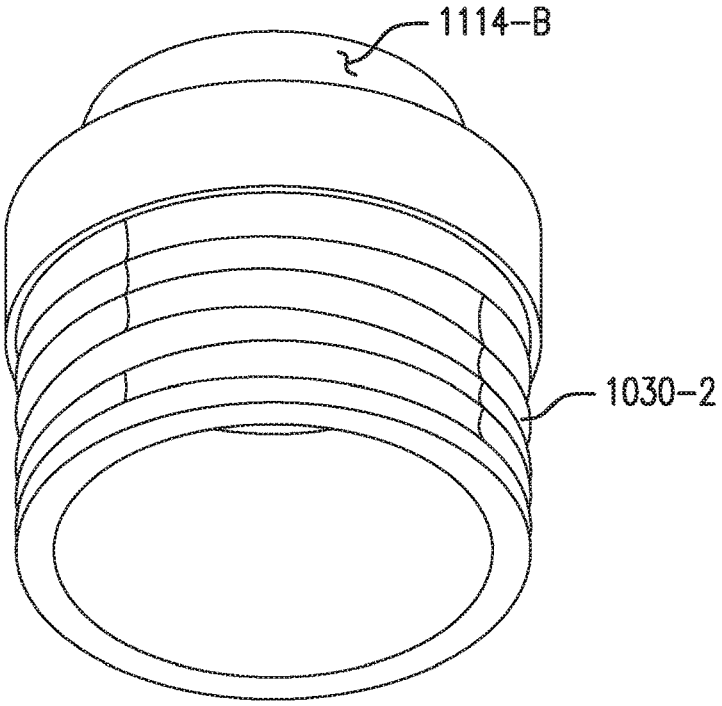
Figure 12C:
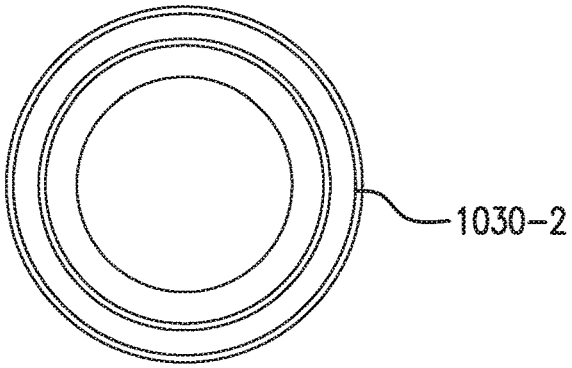
Figure 12D:
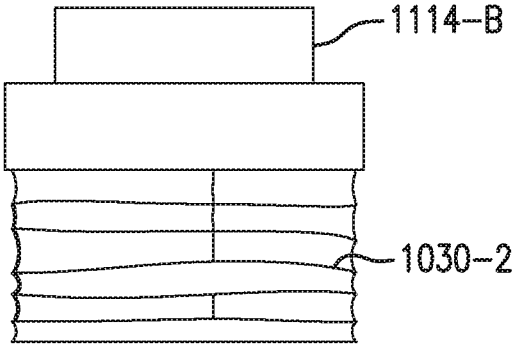
Figure 12E:
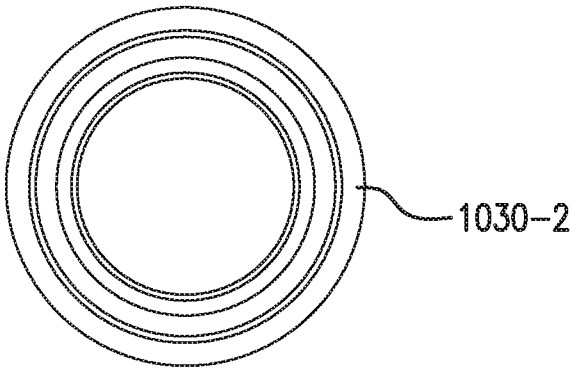
Figure 13A:
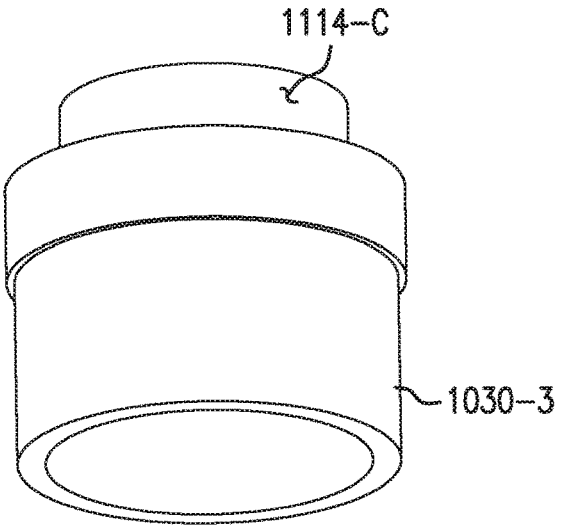
FIGS. 13A-13E are various views illustrating a casing that may be disposed on a lower side of a beam according to an embodiment.
Figure 13B:
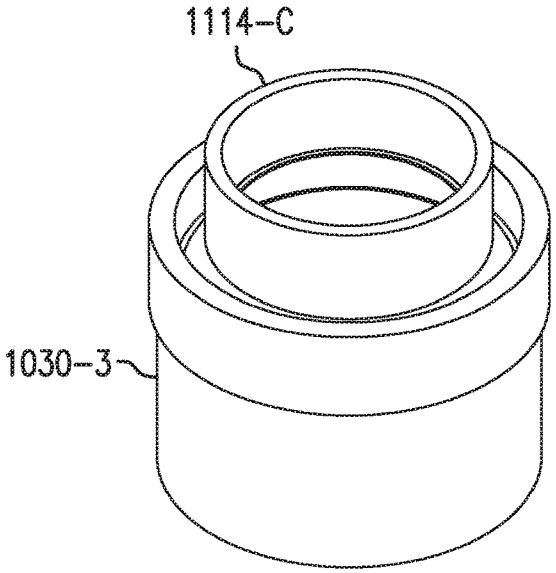
Figure 13C:
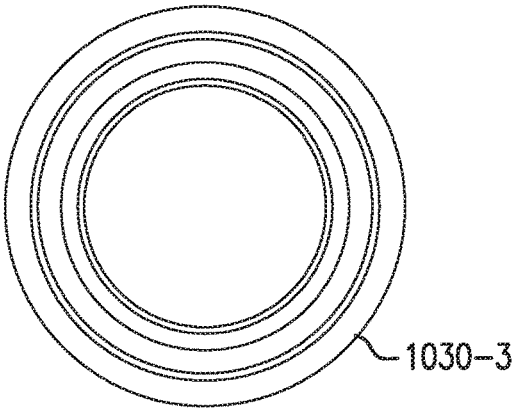
Figure 13D:
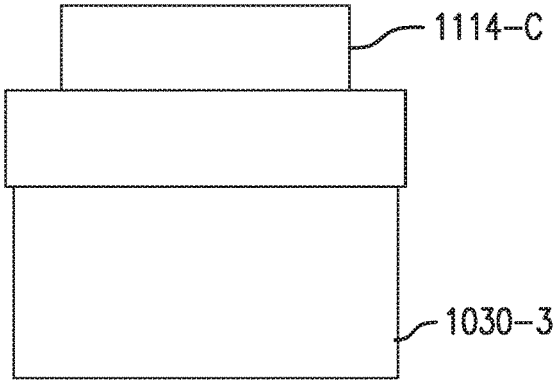
Figure 13E:
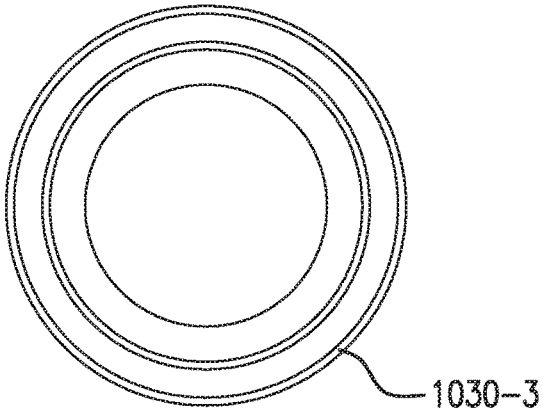
Figure 14A:
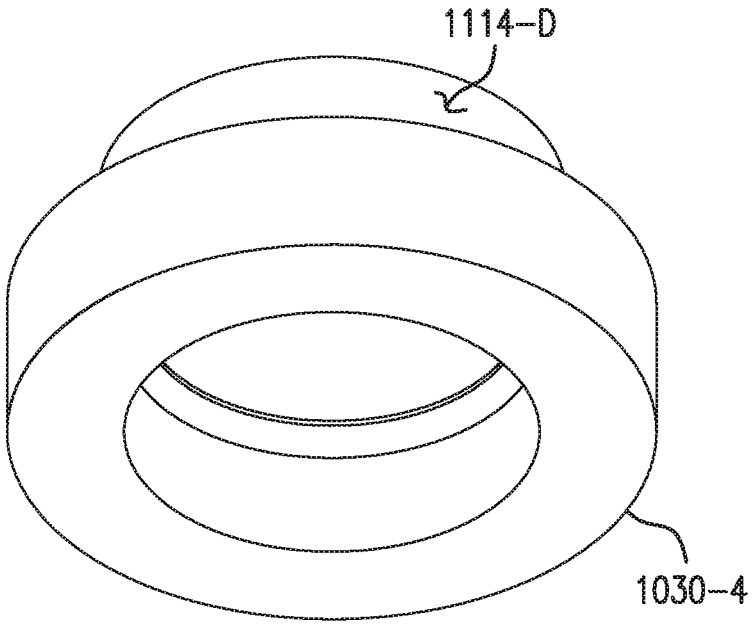
FIGS. 14A-14D are various views illustrating a casing that may be disposed on a lower side of a beam according to an embodiment.
Figure 14B:
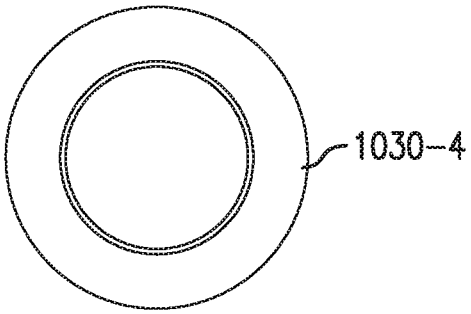
Figure 14C:
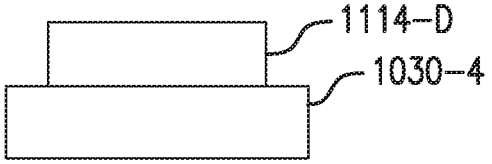
Figure 14D:
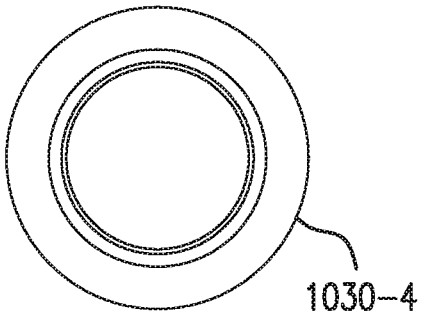
Figure 15A:
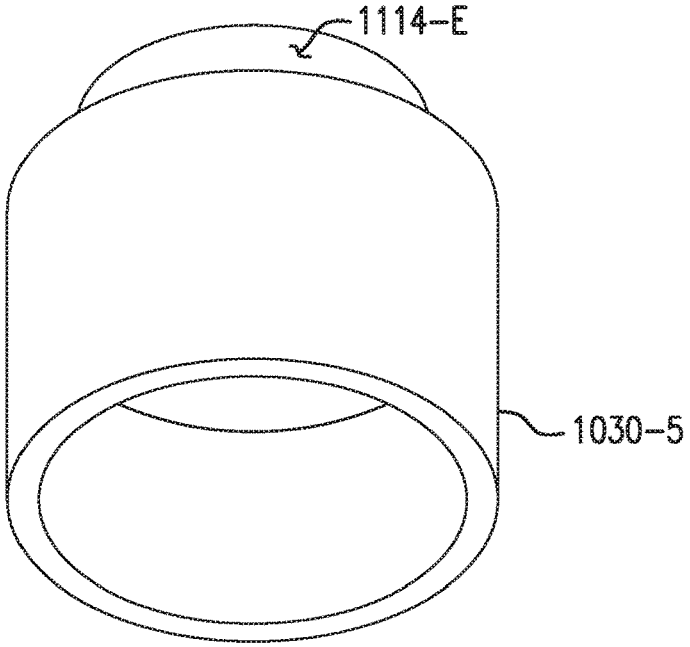
FIGS. 15A-15D are various views illustrating a casing that may be disposed on a lower side of a beam according to an embodiment.
Figure 15B:
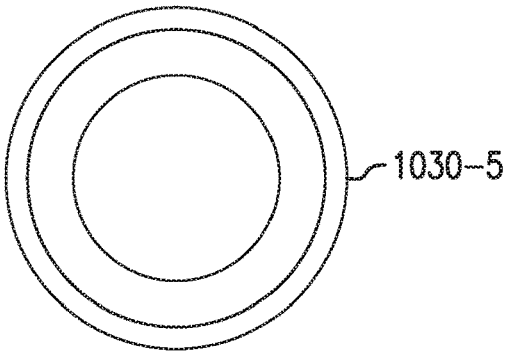
Figure 15C:
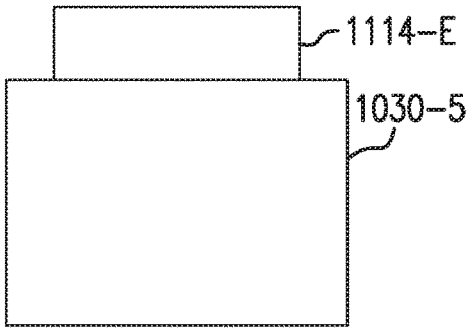
Figure 15D:
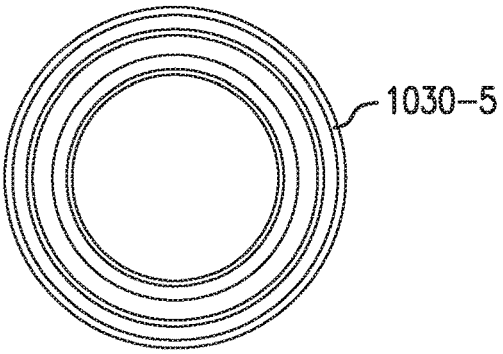
Figure 16A:
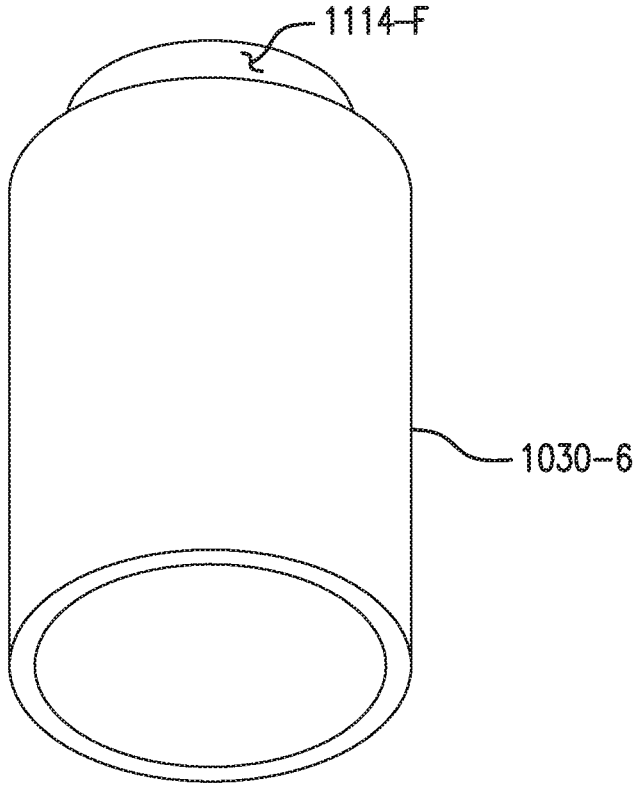
FIGS. 16A-16D are various views illustrating a casing that may be disposed on a lower side of a beam according to an embodiment.
Figures 16B, 16C, 16D:
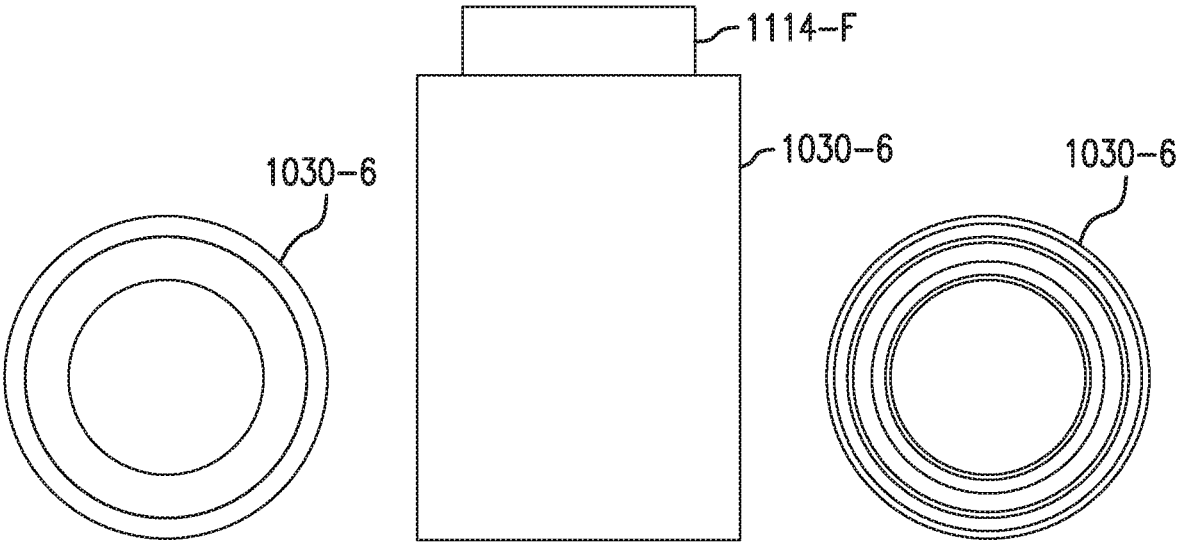
Figure 17A:
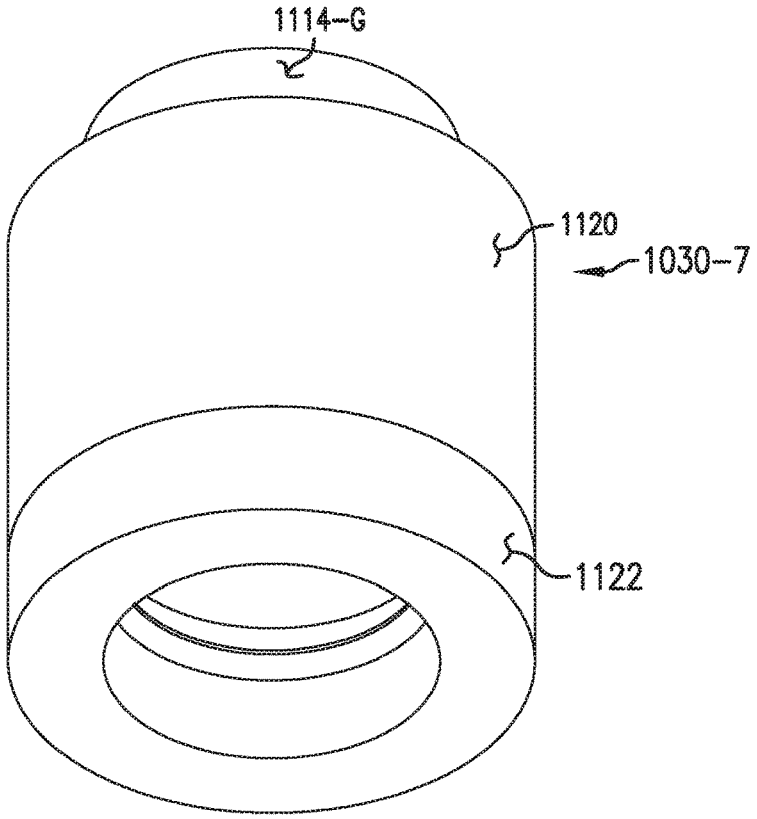
FIGS. 17A-17D are various views illustrating a casing that may be disposed on a lower side of a beam according to an embodiment.
Figure 17B:
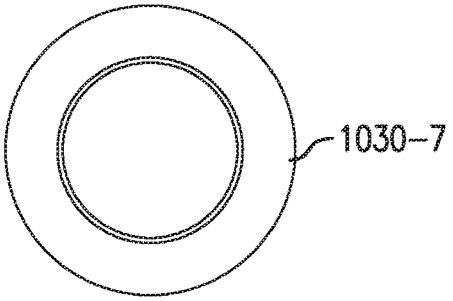
Figure 17C:
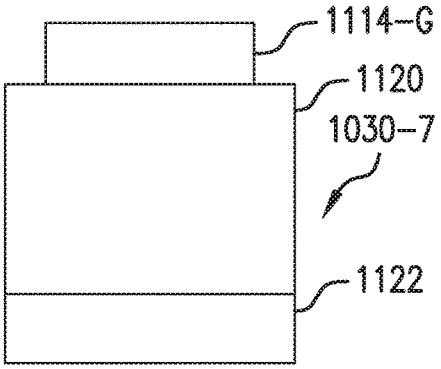
Figure 17D:
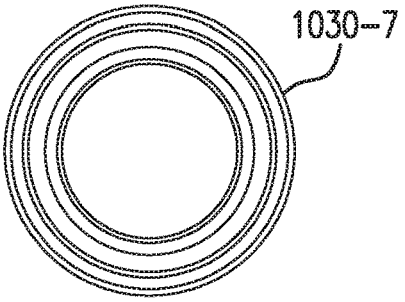
Figure 18A:
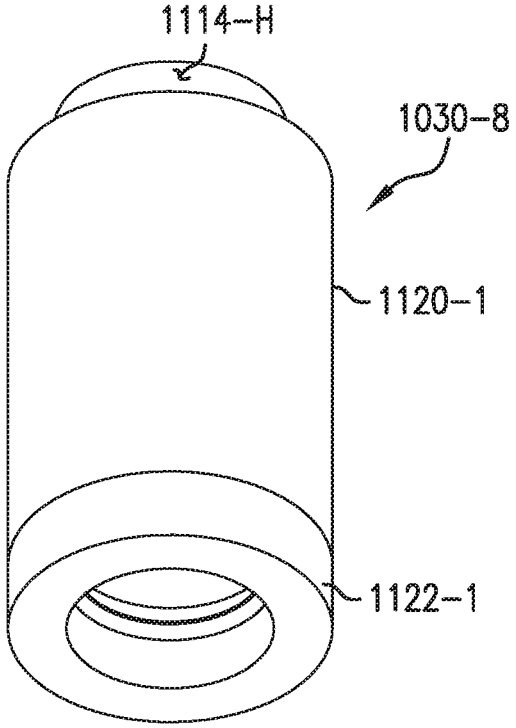
FIGS. 18A-18D are various views illustrating a casing that may be disposed on a lower side of a beam according to an embodiment.
Figure 18B:
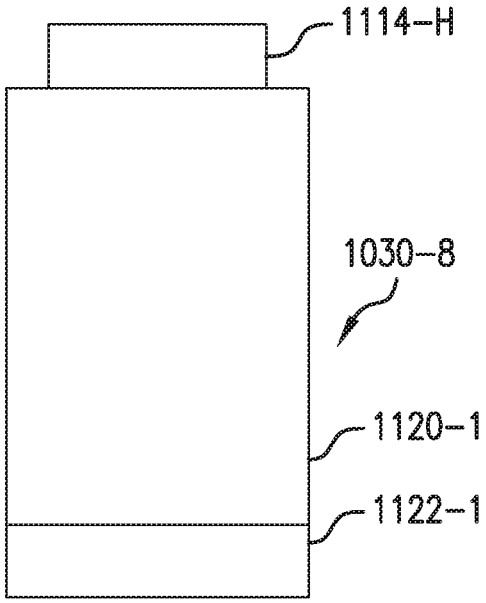
Figure 18C:
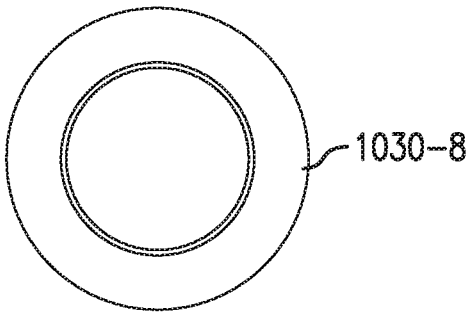
Figure 18D:
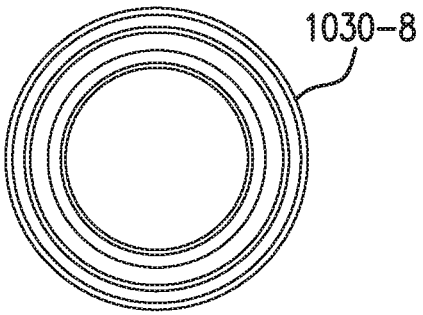
Figure 19A:
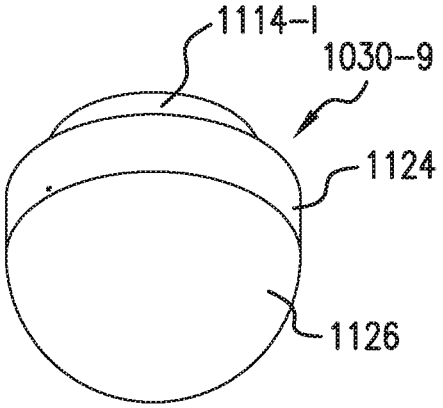
FIGS. 19A-19D are various views illustrating a casing that may be disposed on a lower side of a beam according to an embodiment.
Figure 19B:
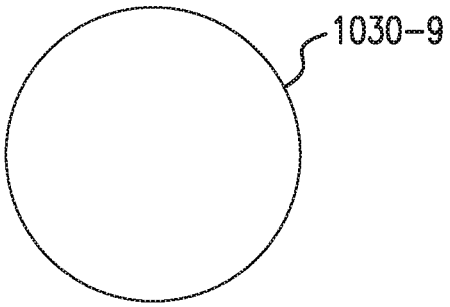
Figure 19C:
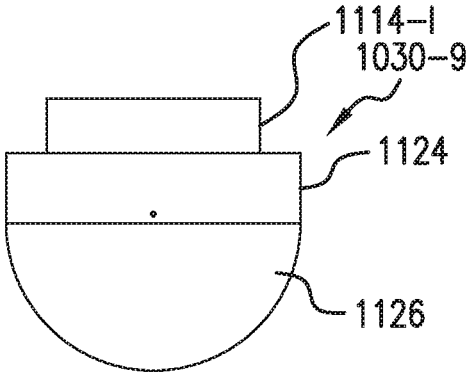
Figure 19D:
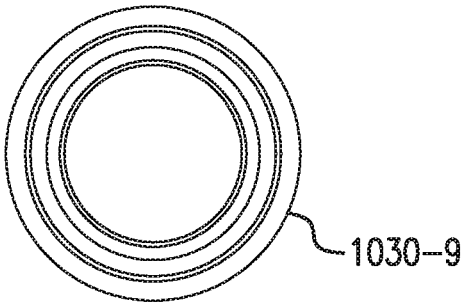
Figure 20A:
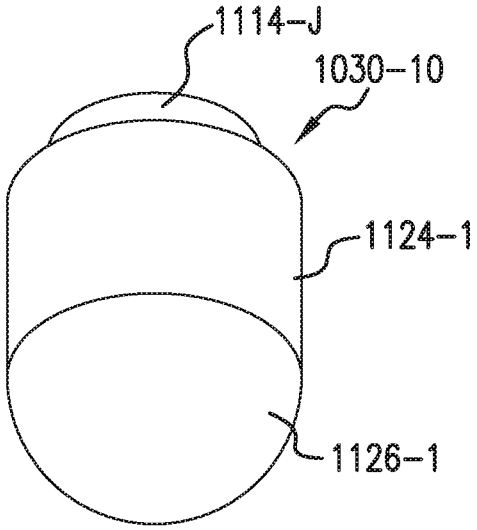
FIGS. 20A-20D are various views illustrating a casing that may be disposed on a lower side of a beam according to an embodiment.
Figure 20B:
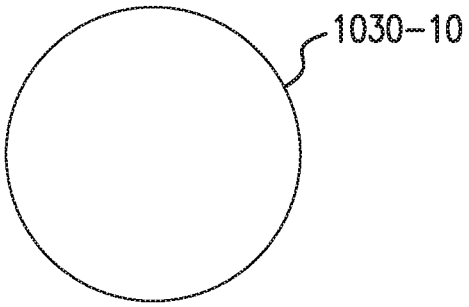
Figure 20C:
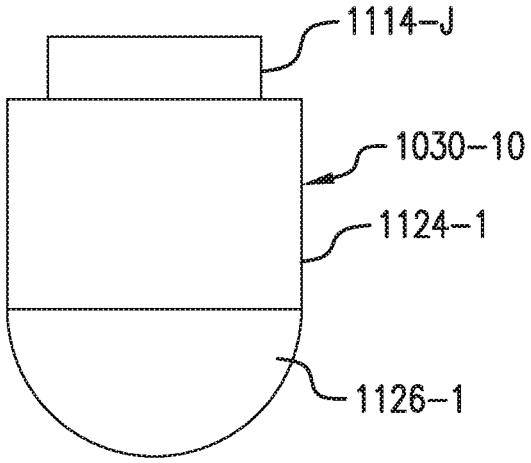
Figure 20D:
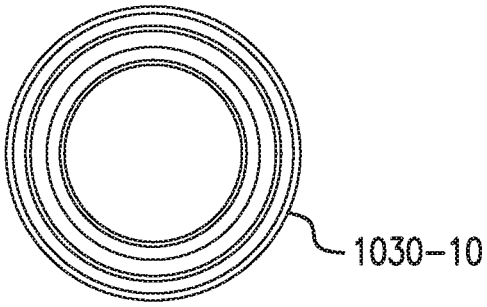
Figure 21A:
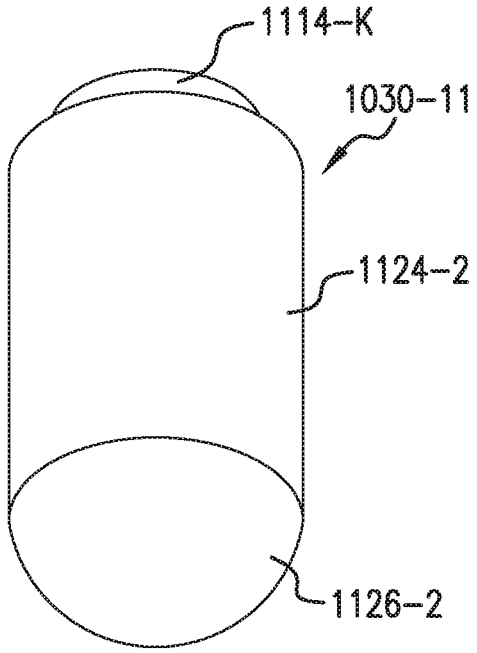
FIGS. 21A-21D are various views illustrating a casing that may be disposed on a lower side of a beam according to an embodiment.
Figure 21B:
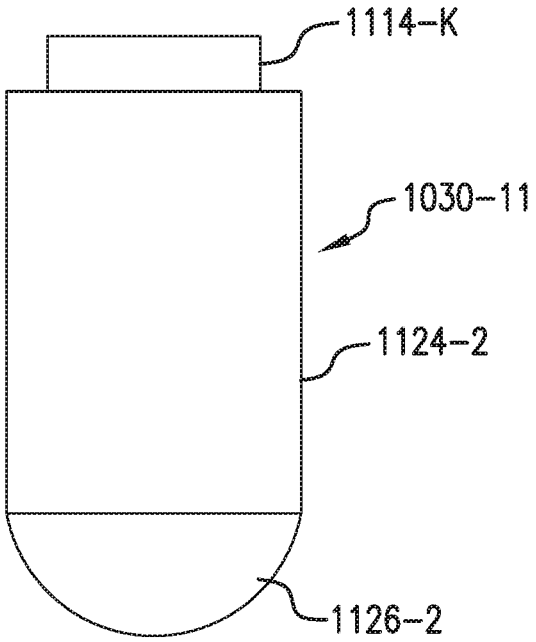
Figure 21C:
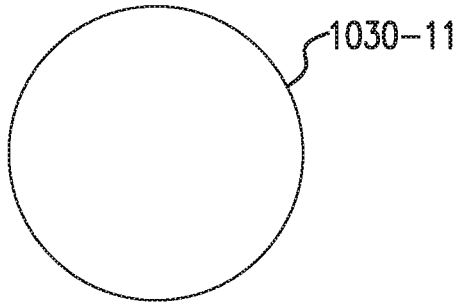
Figure 21D:
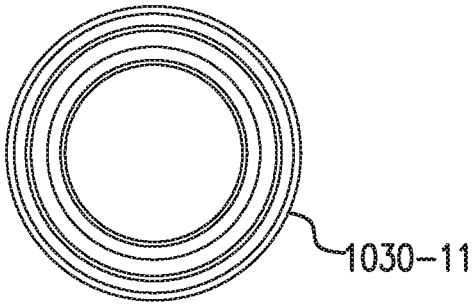

FIGS. 10A-10B illustrate a casing 1028-4 according to an alternate embodiment and a casing 1030-1 according to an alternate embodiment. FIGS. 10C-10E illustrate a beam 1006-2 according to an alternate embodiment, the beam 1006-2 including a plurality of light engines 1026. FIGS. 10A-10B also illustrate a method of coupling the casings 1028-4 and 1030-1 to the beam 1006-2.

As indicated in FIG. 10A, the portion 1112-D of the casing 1028-4 may be placed onto the upper side light engine 1026, and may be rotated as shown in FIG. 10A to couple the casing 1028-4 with the light engine 1026. The portion 1112-D of the casing 1028-4 (see FIG. 10A) may be coupled with the connection ring 1072 (see FIG. 10E) of any light engine 1026 since both the portion 1112-D and the connection ring 1072 may have matching threads.

Similarly, the casing 1030-1 may be placed onto the bottom side of the light engine 1026 and may be rotated as shown in FIG. 10A to be coupled with the light engine 1026 since the casing 1030-1 may include a threaded portion 1114-A, and the light engine 1026 may include the threaded connection ring 1074 (see FIG. 10C).

FIGS. 11A-11E illustrate a casing 1028-5 according an alternate embodiment, the casing 1028-5 having a portion 1112-E for connection with the upper side of the light engines 1026. The casing 1028-5 may be made of a clear or etched ribbon glass.

FIGS. 12A-12E illustrate a casing 1030-2 according an alternate embodiment, the casing 1030-2 having a portion 1114-B for connection with the lower side of the light engines 1026. The casing 1030-2 may be made of a clear or etched ribbon glass.

FIGS. 13A-13E illustrate a casing 1030-3 according an alternate embodiment, the casing 1030-3 having a portion 1114-C for connection with the lower side of the light engines 1026. The casing 1030-3 may be made of etched glass.

FIGS. 14A-14D illustrate a casing 1030-4 according an alternate embodiment, the casing 1030-4 having a portion 1114-D for connection with the lower side of the light engines 1026. The casing 1030-4 may be made of frosted acrylic.

FIGS. 15A-15D illustrate a casing 1030-5 according an alternate embodiment, the casing 1030-5 having a portion 1114-E for connection with the lower side of the light engines 1026. The casing 1030-5 may be made of a metal.

FIGS. 16A-16D illustrate a casing 1030-6 according an alternate embodiment, the casing 1030-6 having a portion 1114-F for connection with the lower side of the light engines 1026. The casing 1030-6 may be made of a metal. In addition, the casing 1030-6 may be longer than the casing 1030-5.

FIGS. 17A-17D illustrate a casing 1030-7 according an alternate embodiment, the casing 1030-7 including a first hollow portion 1120 made of a metal and a second hollow portion 1122 made of frosted acrylic. The first hollow portion 1120 may include a portion 1114-G for connection with the lower side of the light engines 1026.

FIGS. 18A-18D illustrate a casing 1030-8 according an alternate embodiment, the casing 1030-8 including a first hollow portion 1120-1 made of a metal and a second hollow portion 1122-1 made of frosted acrylic. The first hollow portion 1120-1 may include a portion 1114-H for connection with the lower side of the light engines 1026. In addition, the first hollow portion 1120-1 may be longer than the first hollow portion 1120.

FIGS. 19A-19D illustrate a casing 1030-9 according an alternate embodiment, the casing 1030-9 including a hollow metal portion 1124 and a glass dome 1126 connected to the hollow metal portion 1124. The hollow metal portion 1124 may include a portion 1114-I for connection with the lower side of the light engines 1026.

FIGS. 20A-20D illustrate a casing 1030-10 according an alternate embodiment, the casing 1030-10 including a hollow metal portion 1124-1 and a glass dome 1126-1 connected to the hollow metal portion 1124-1. The hollow metal portion 1124-1 may include a portion 1114-J for connection with the lower side of the light engines 1026, and the hollow metal portion 1124-1 may be longer than the hollow metal portion 1124.

FIGS. 21A-21D illustrate a casing 1030-11 according an alternate embodiment, the casing 1030-11 including a hollow metal portion 1124-2 and a glass dome 1126-2 connected to the hollow metal portion 1124-2. The hollow metal portion 1124-2 may include a portion 1114-K for connection with the lower side of the light engines 1026, and the hollow metal portion 1124-2 may be longer than the hollow metal portion 1124-1.

Figure 22A:
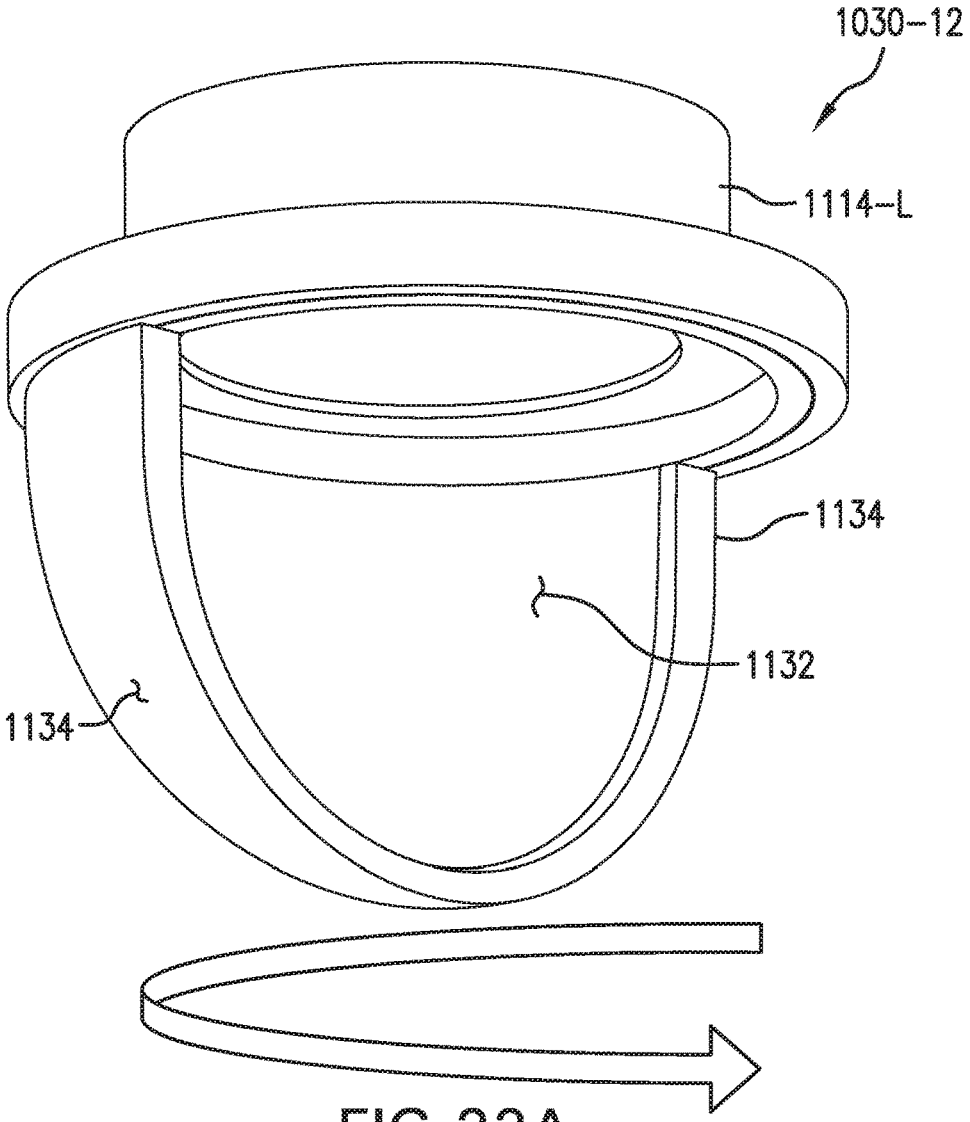
FIGS. 22A-22G are various views illustrating a casing that may be disposed on a lower side of a beam according to an embodiment.
Figure 22B:
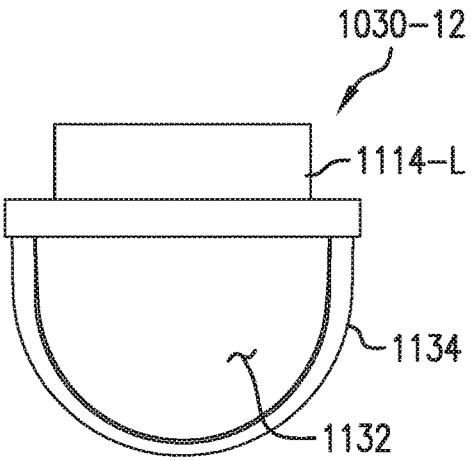
Figure 22C:
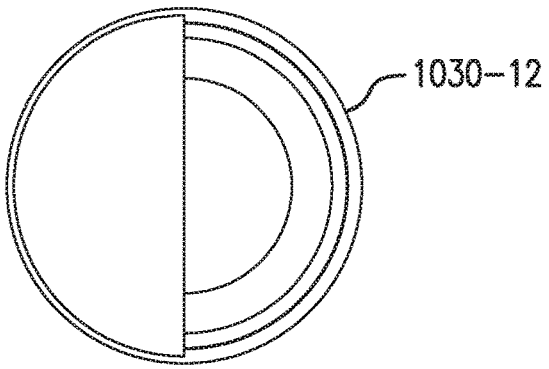
Figure 22D:
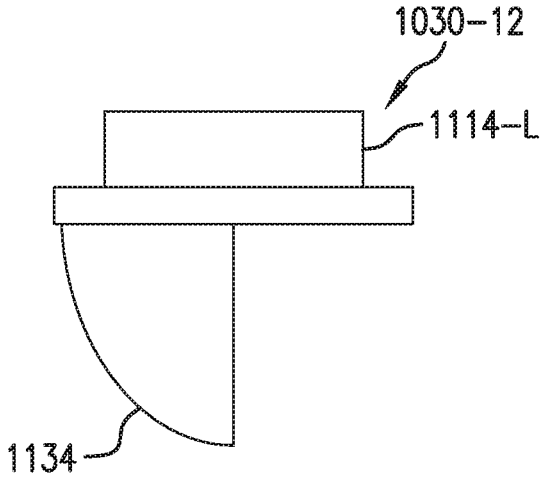
Figure 22E:
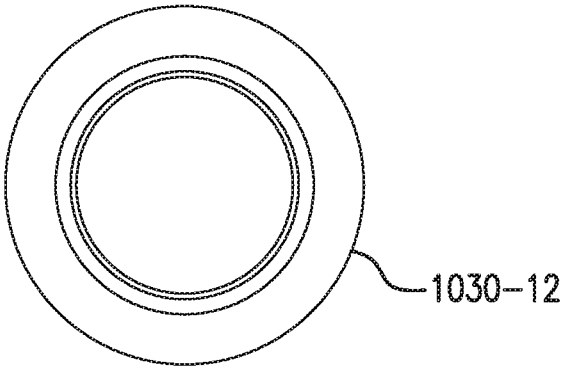
Figure 22F:
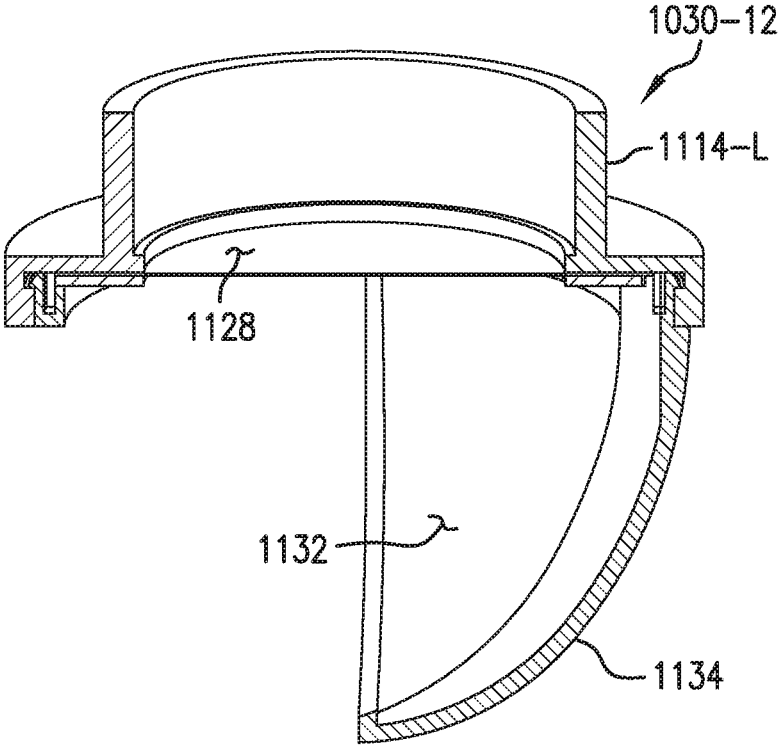
Figure 22G:
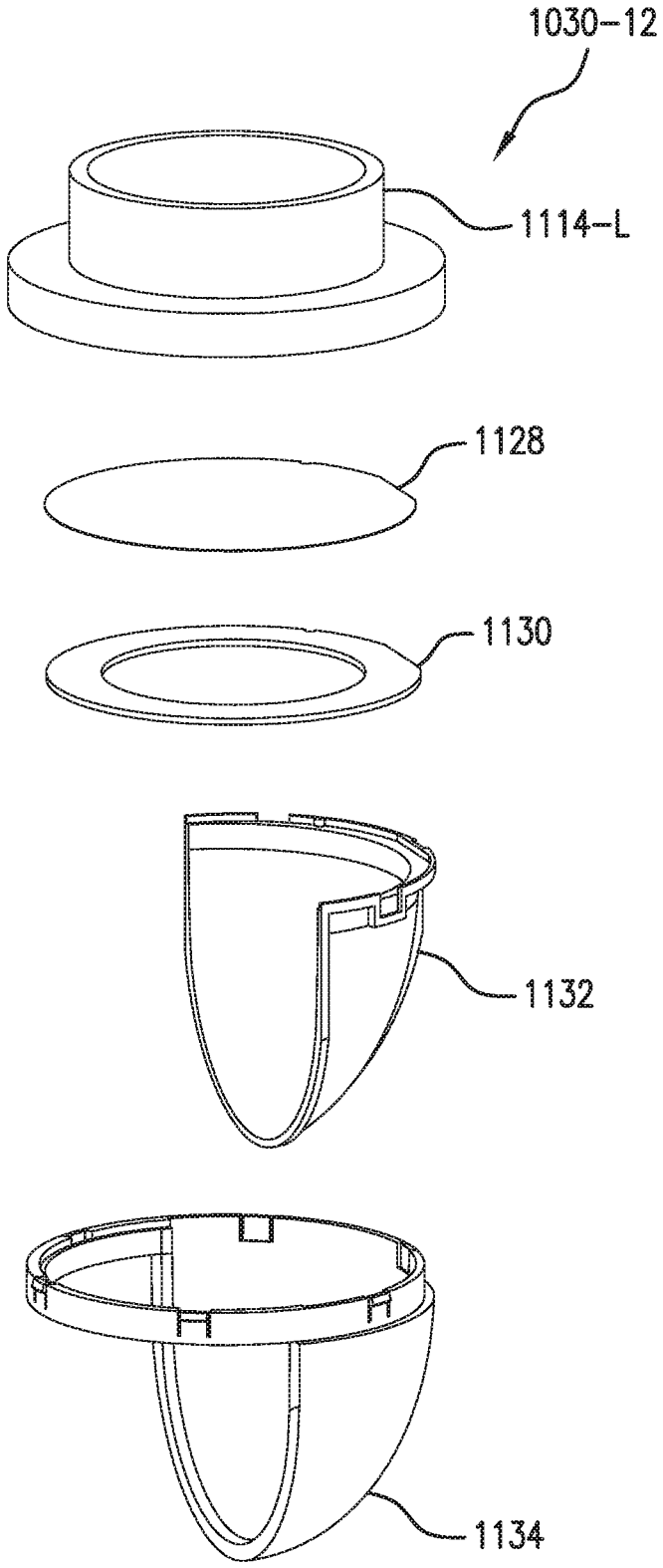
Figure 23A:
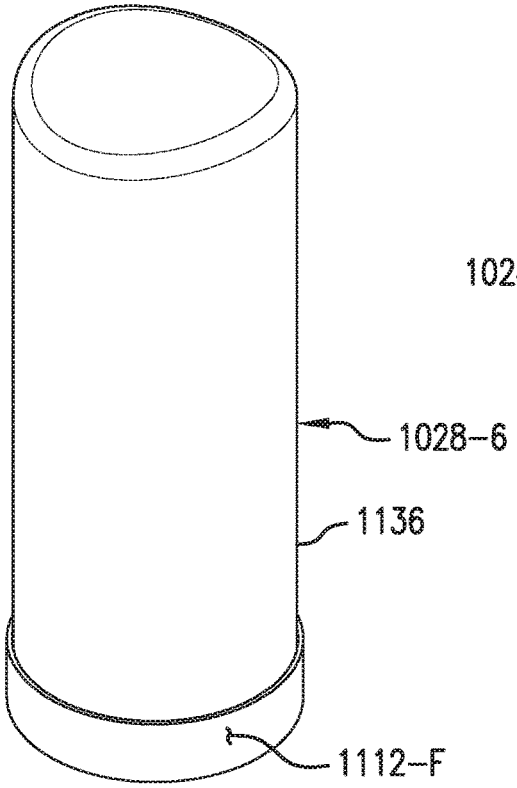
FIGS. 23A-23G are various views illustrating a casing that may be disposed on an upper side of a beam according to an embodiment.
Figure 23B:
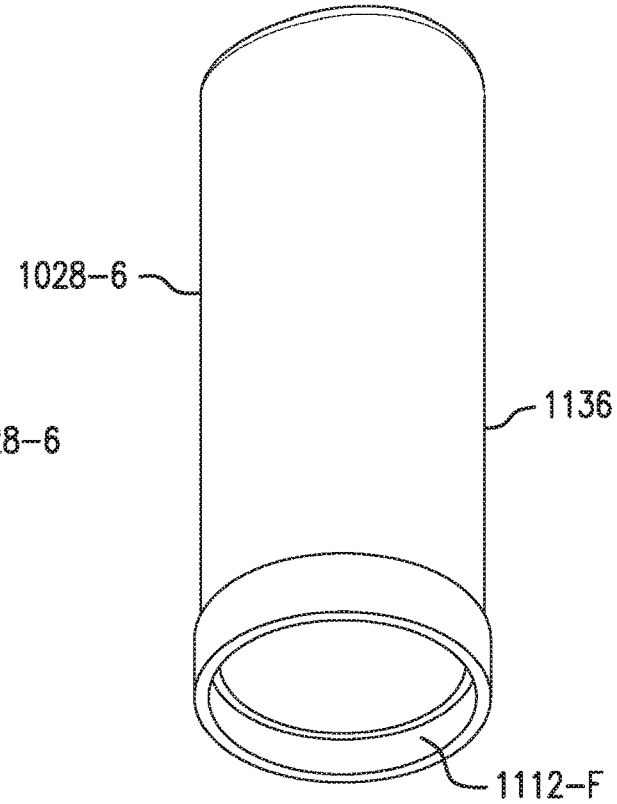
Figure 23C:
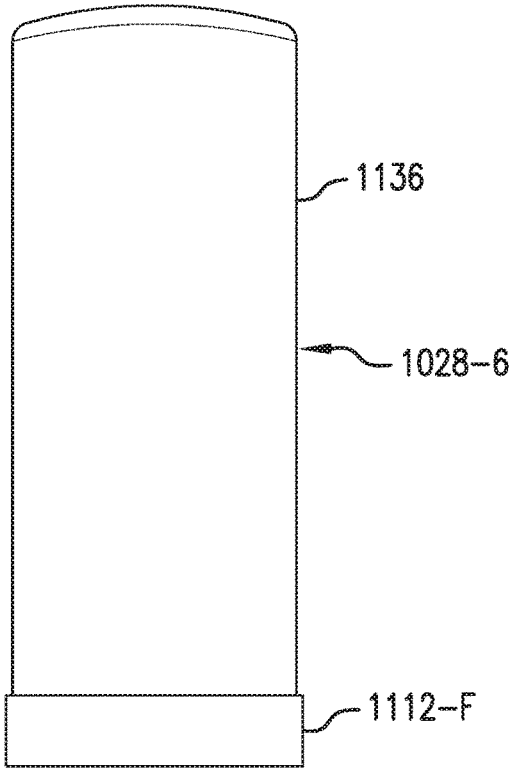
Figure 23D:
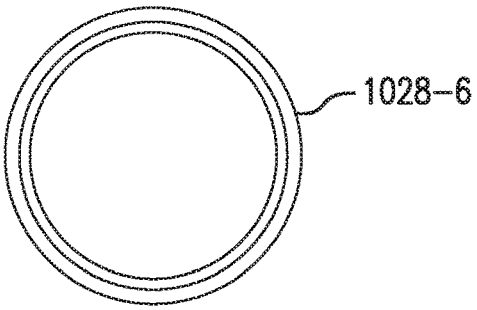
Figure 23E:
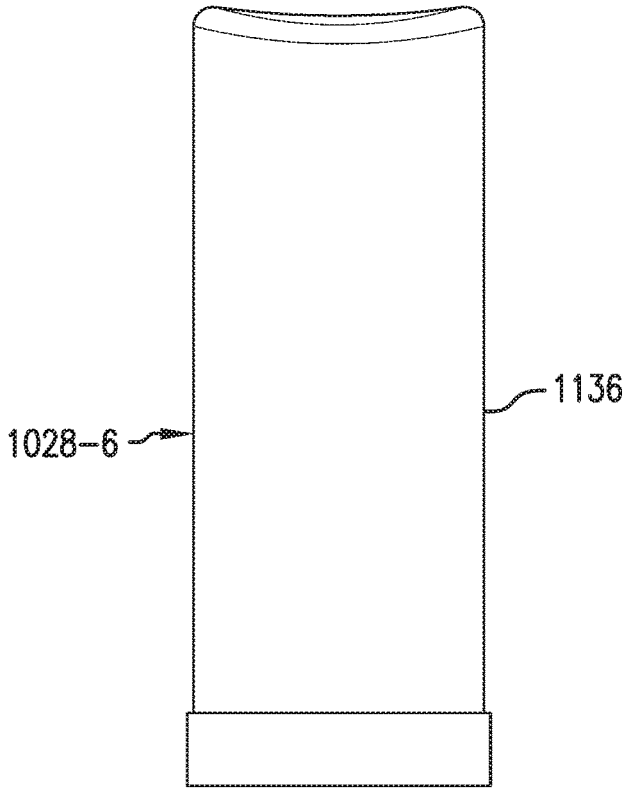
Figure 23G:
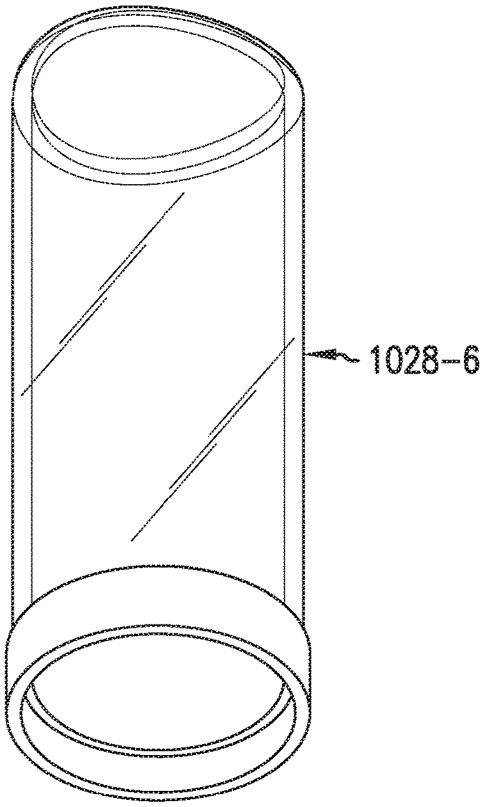
Figure 23F:
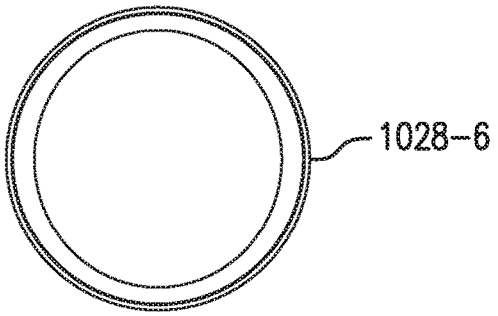
Figure 24A:
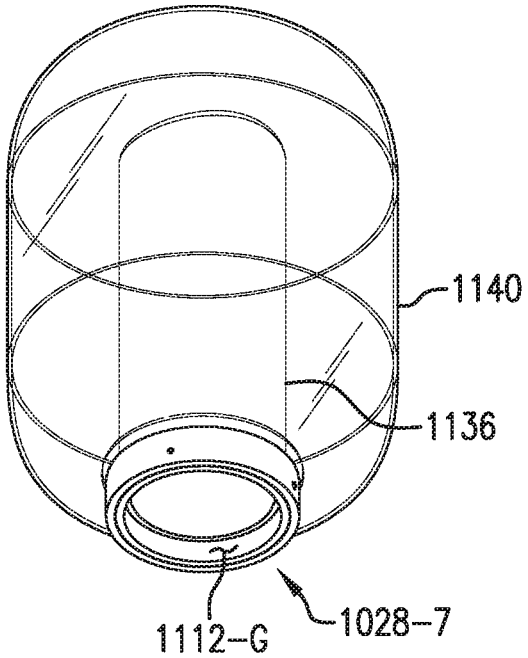
FIGS. 24A-24F are various views illustrating a casing that may be disposed on an upper side of a beam according to an embodiment.
Figure 24B:
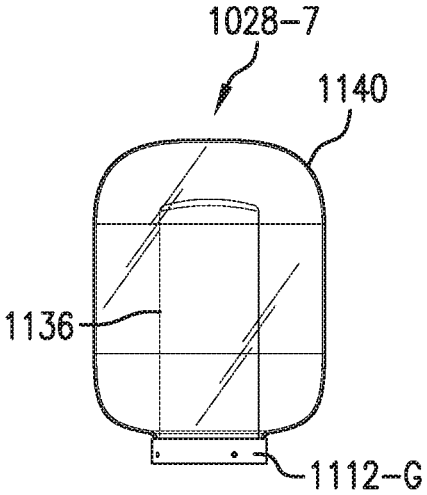
Figure 24C:
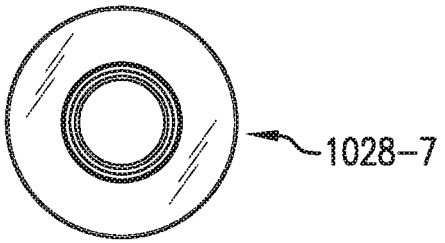
Figure 24D:
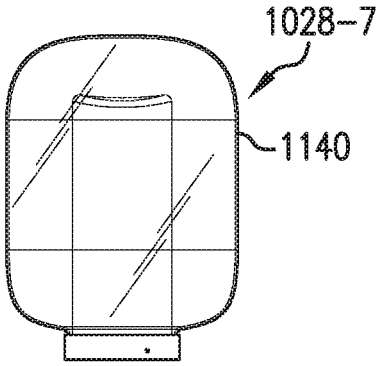
Figure 24E:
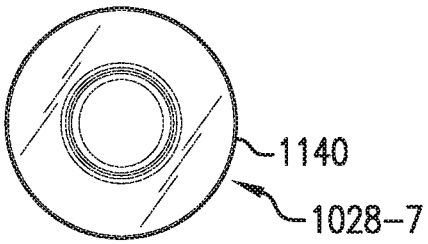
Figure 24F:
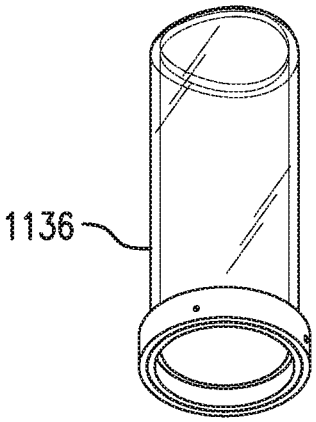
Figure 25A:
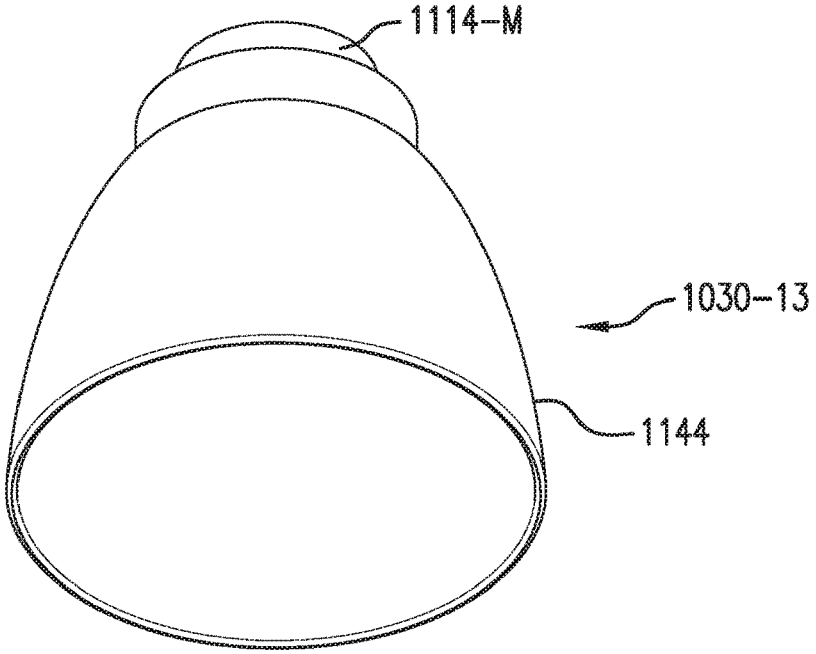
FIGS. 25A-25D are various views illustrating a casing that may be disposed on a lower side of a beam according to an embodiment.
Figure 25B:
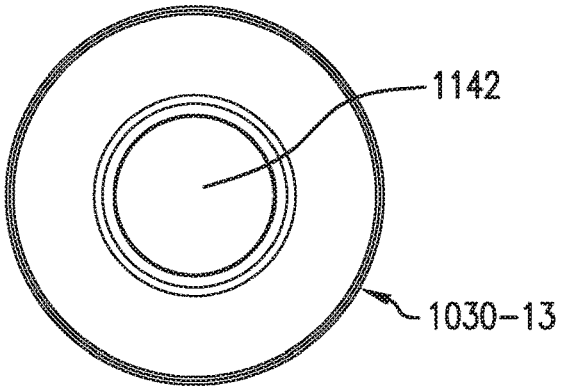
Figure 25C:
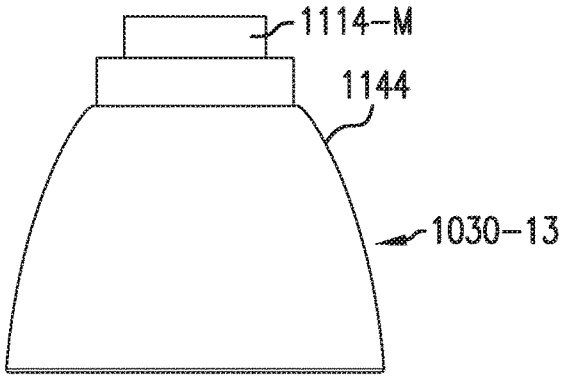
Figure 25D:
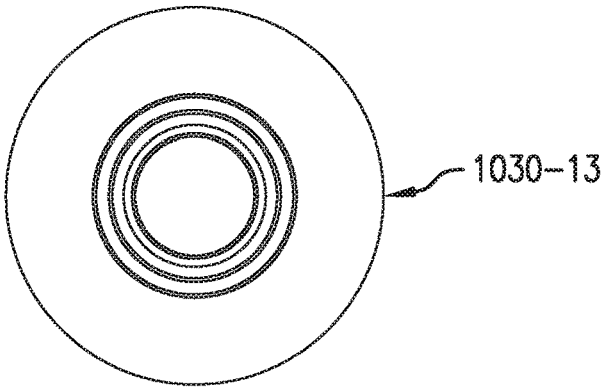
Figure 26A:
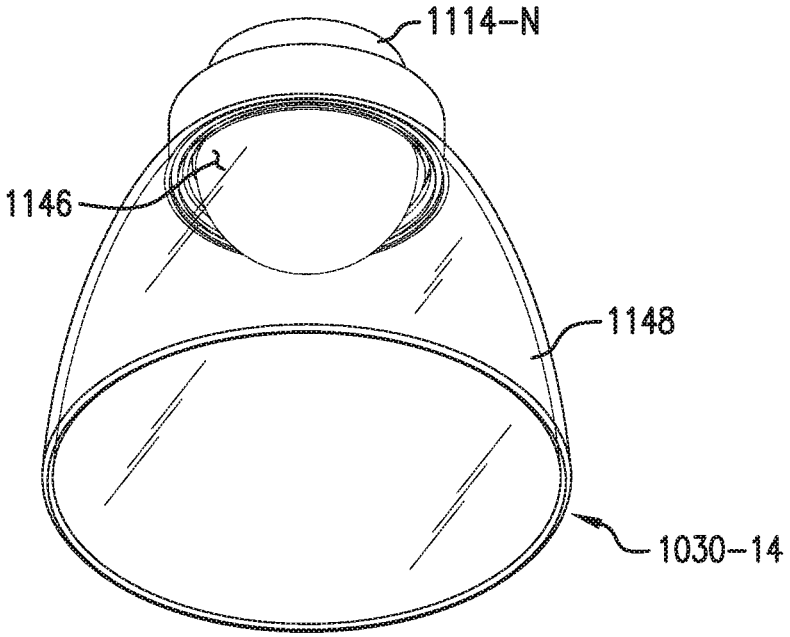
FIGS. 26A-26D are various views illustrating a casing that may be disposed on a lower side of a beam according to an embodiment.
Figure 26B:
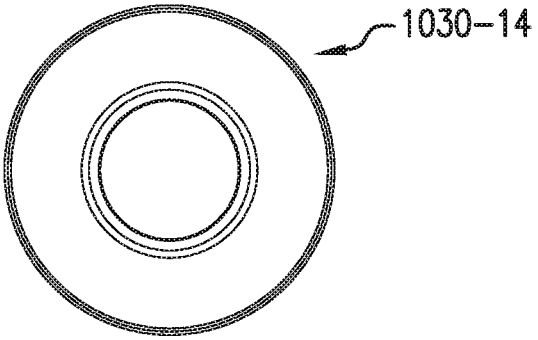
Figure 26C:
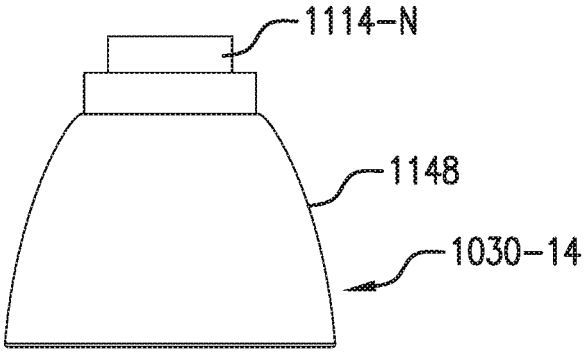
Figure 26D:
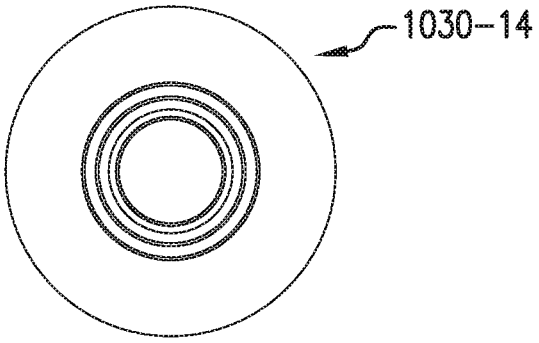
Figure 27A:
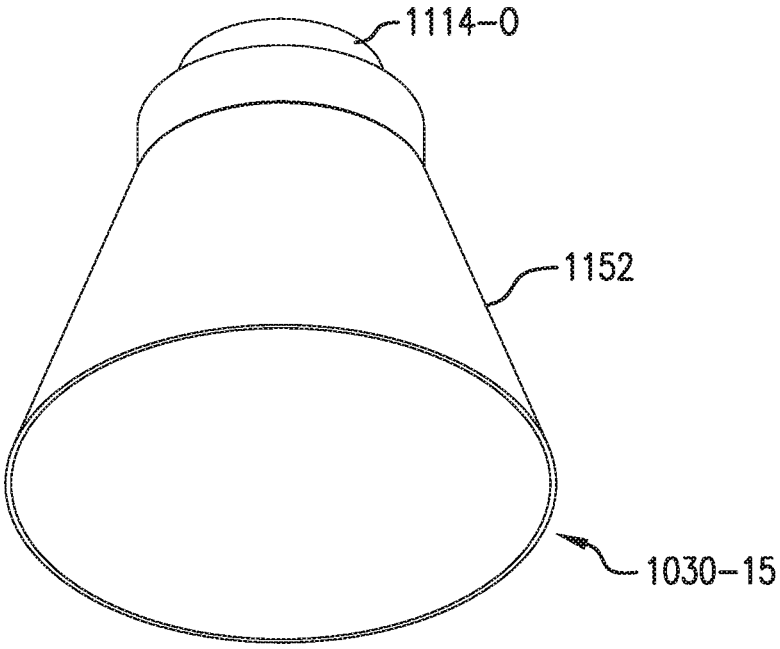
FIGS. 27A-27D are various views illustrating a casing that may be disposed on a lower side of a beam according to an embodiment.
Figure 27B:
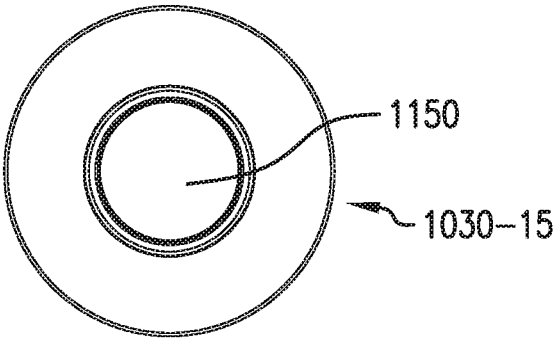
Figure 27C:
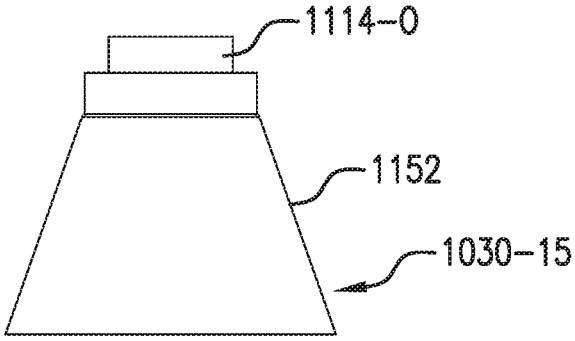
Figure 27D:
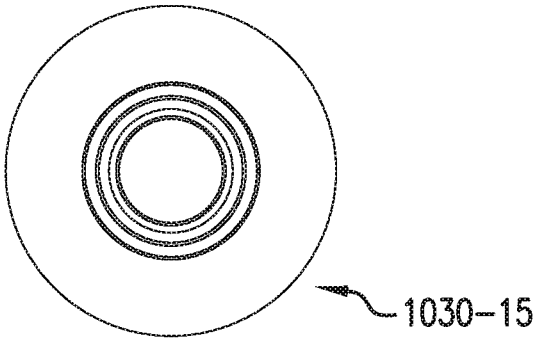
Figure 28A:
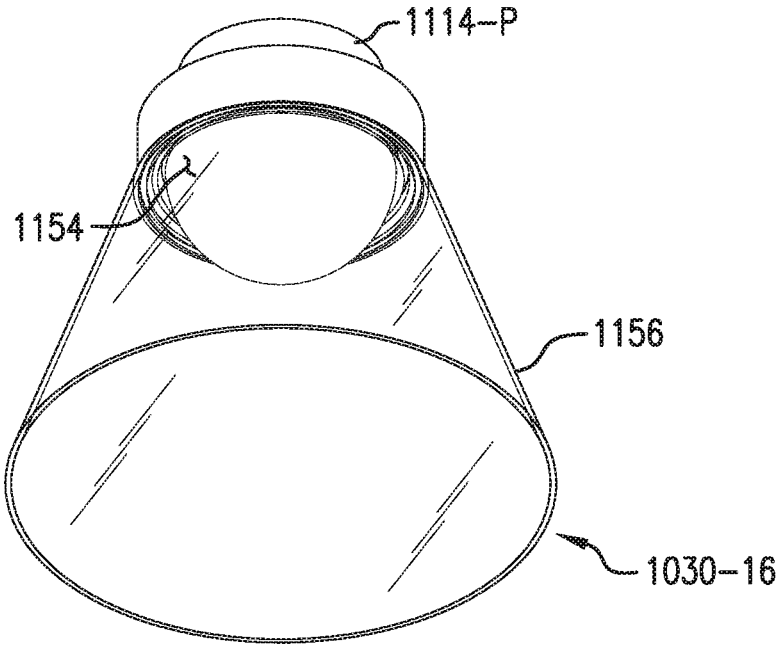
FIGS. 28A-28D are various views illustrating a casing that may be disposed on a lower side of a beam according to an embodiment.
Figure 28B:
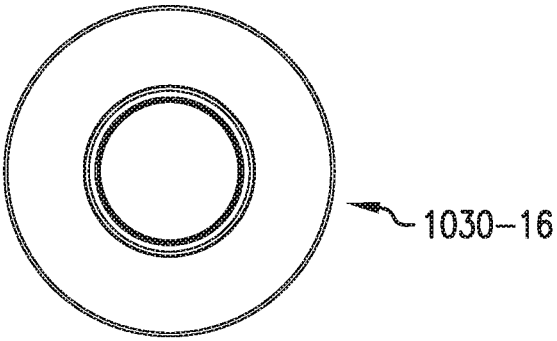
Figure 28C:
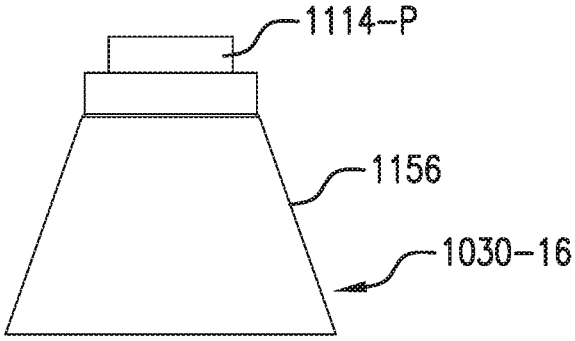
Figure 28D:
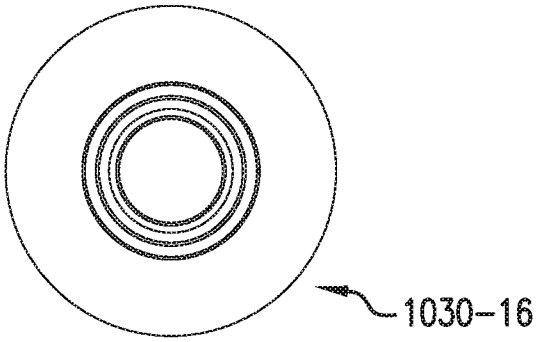
Figure 29A:
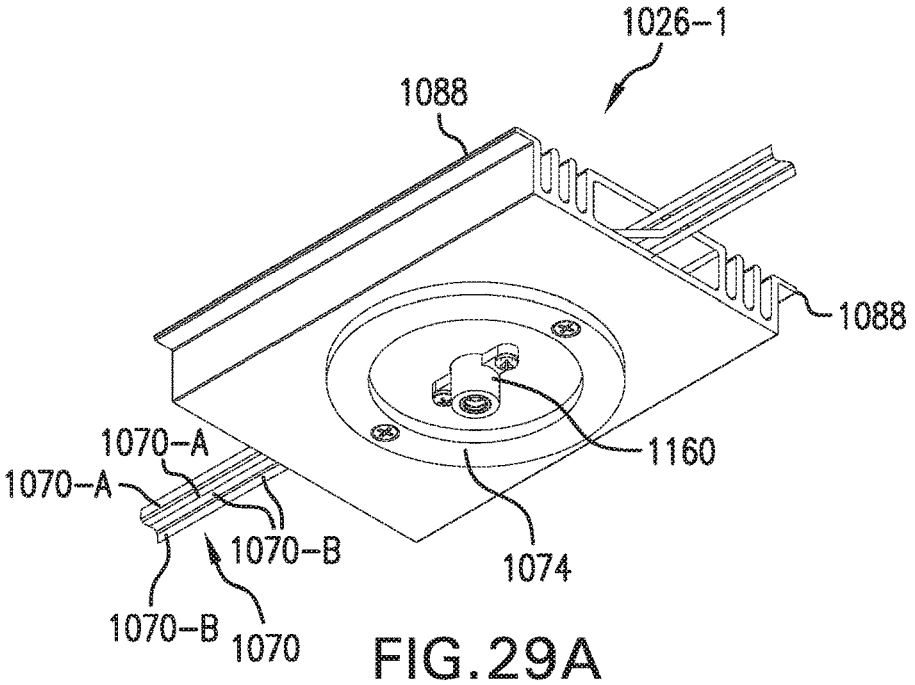
FIGS. 29A-29E are various views illustrating a light engine according to an embodiment.
Figure 29B:
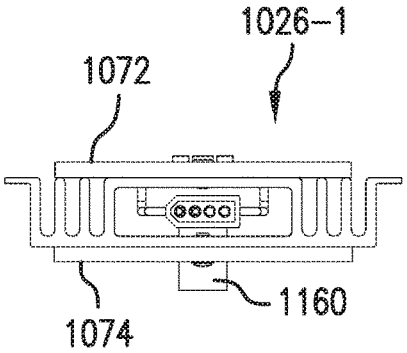
Figure 29C:
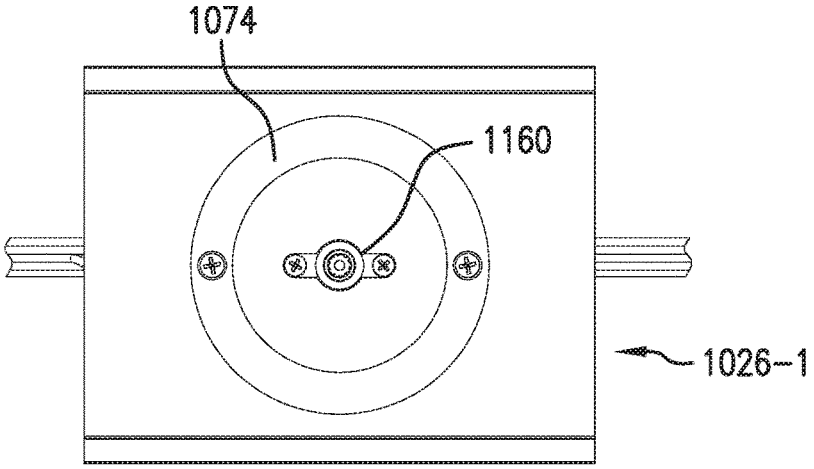
Figure 29D:
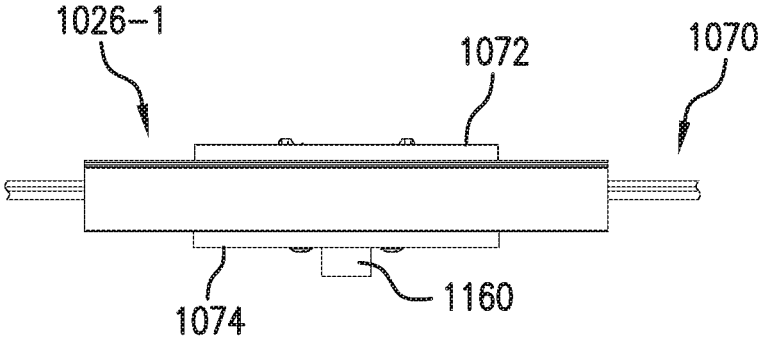
Figure 29E:
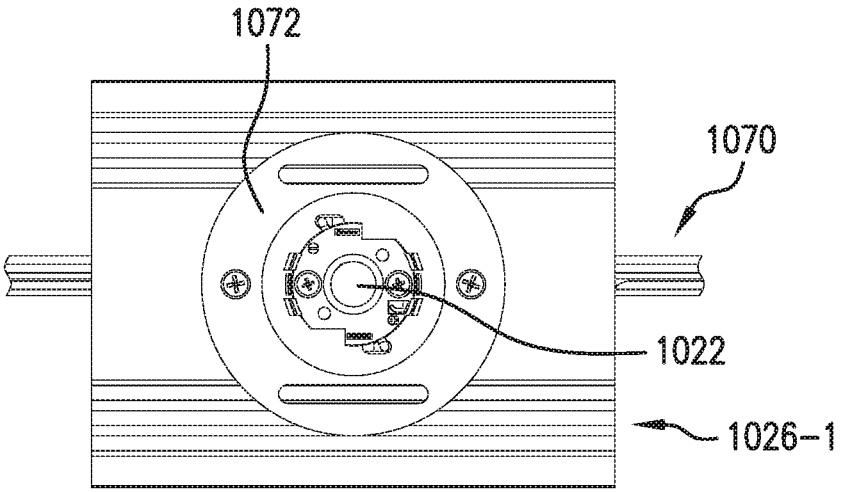

FIGS. 22A-22G illustrate a casing 1030-12 according an alternate embodiment. Referring to FIGS. 22A-22B, the casing 1030-12 is rotatable, as indicated by the curved arrow in FIG. 22A for aiming, condensing, spreading and/or diffusing light in a selectable direction. Referring to FIG. 22G, the casing 1030-12 may include a portion 1114-L for connection with the lower sides of the light engines 1026, a diffusing film 1128, a bezel 1130 for securing the diffusing film 1128, a half-dome shaped reflector 1132, and an outer shell 1134 securing the reflector 1132, the bezel 1130 and the diffuser film 1128 onto the portion 1114-L. After snapping in place, the outer shell 1134 is rotatable about the portion 1114-L.

FIGS. 23A-23G illustrate a casing 1028-6 according an alternate embodiment. The casing 1028-6 includes a portion 1112-F for connection with the upper side of the light engines 1026, and a cylindrical glass portion 1136 that becomes gradually opal in a direction away from the light engine 1026 to which it may be connected.

FIGS. 24A-24F illustrate a casing 1028-7 according an alternate embodiment. The casing 1028-7 includes a portion 1112-G for connection with the upper side of the light engines 1026, the cylindrical glass portion 1136, and a glass encasement 1140 covering the cylindrical glass portion 1136. The glass encasement 1140 may be round and may be made of clear glass.

FIGS. 25A-25D illustrate a casing 1030-13 according an alternate embodiment. The casing 1030-13 includes a portion 1114-M for connection with the lower side of the light engines 1026, a metal bell 1144 and a diffuser 1142 disposed within the metal bell 1144.

FIGS. 26A-26D illustrate a casing 1030-14 according an alternate embodiment. The casing 1030-14 includes the portion 1114-N for connection with the lower side of the light engines 1026, a glass bell 1148 and a diffuser 1146 disposed within the glass bell 1148.

FIGS. 27A-27D illustrate a casing 1030-15 according an alternate embodiment. The casing 1030-15 includes a portion 1114-0 for connection with the lower side of the light engines 1026, a metal cone 1152, and a diffuser 1150 disposed within the metal cone 1152.

FIGS. 28A-28D illustrate a casing 1030-16 according an alternate embodiment. The casing 1030-16 includes a portion 1114-P for connection with the lower side of the light engines 1026, a glass cone 1156, and a diffuser 1154 disposed within the metal cone 1154.

FIGS. 29A-29E illustrate a light engine 1026-1 according to an alternate embodiment.

The light engine 1026-1 may be similar in all respects to the light engine 1026 except for having a power jack 1160 (see FIG. 29A) on its second side (e.g., bottom side), opposite to the flanges 1088.

The power jack 1160 (see FIG. 29A) may be electrically connected to the second set of two wires 1070-B (see FIG. 29A) of the light engine 1026-1. The power jack 1160 may be configured to provide power to light sources that may be appended to the bottom side the light engine 1026-1. The power jack 1160 may be, for example, a female power jack.

Since all other parts (other than the power jack 1160) of the light engine 1026-1 may be the same as those of the light engine 1026, the light engine 1026-1 may be connected to any one of the light engines 1026 just like the light engines 1026 may be connected to each other.

Thus, in an alternate embodiment, a beam may include at least one light engine 1026-1 and a light engine 1026, or a plurality of engines 1026-1 only, connected to each other as described for the light engines 1026 (e.g., see FIG. 3).

FIGS. 30A-30I illustrate a casing 1030-17 according to an alternate embodiment. The casing 1030-17 may include a portion 1114-Q for connection with the lower side of the light engine 1026-1 and the light engine 1026-3 (see FIG. 33A), a portion 1170 configured to emit light, and an intermediate member 1172 pivotally coupling the portion 1170 with the portion 1114-Q.

The portion 1170 may include a light source 1166 (see FIGS. 30D, 30F), and the portion 1114-Q may include a power jack 1164 (see FIGS. 30A, 30D) configured to electrically connect the light source 1166 with the second set of two wires 1070-B (see FIG. 29A) of the light engine 1026-1, and with the wires 1070-C (see FIG. 33A) of the light engine 1026-3.

The intermediate member 1172 may include two wires 1161 (see FIG. 30D) electrically connecting the light source 1166 with the power jack 1164. The two wires 1161 may be disposed inside of the intermediate member 1172 in order to avoid having loose wires disposed outside of the portions 1114-Q and 1170. Thus, the casing 1030-17 includes no external wires that may be entangled with the exterior sides of the portions 1114-Q, 1170 and intermediate member 1172 to interfere or prevent the portion 1170 from being rotated with respect to the portion 1114-Q. Thus, the disposal of the two wires 1161 inside of the intermediate member 1172 ensures that the portion 1114-Q and 1170 can be freely rotated with respect to one another.

Figure 30A:
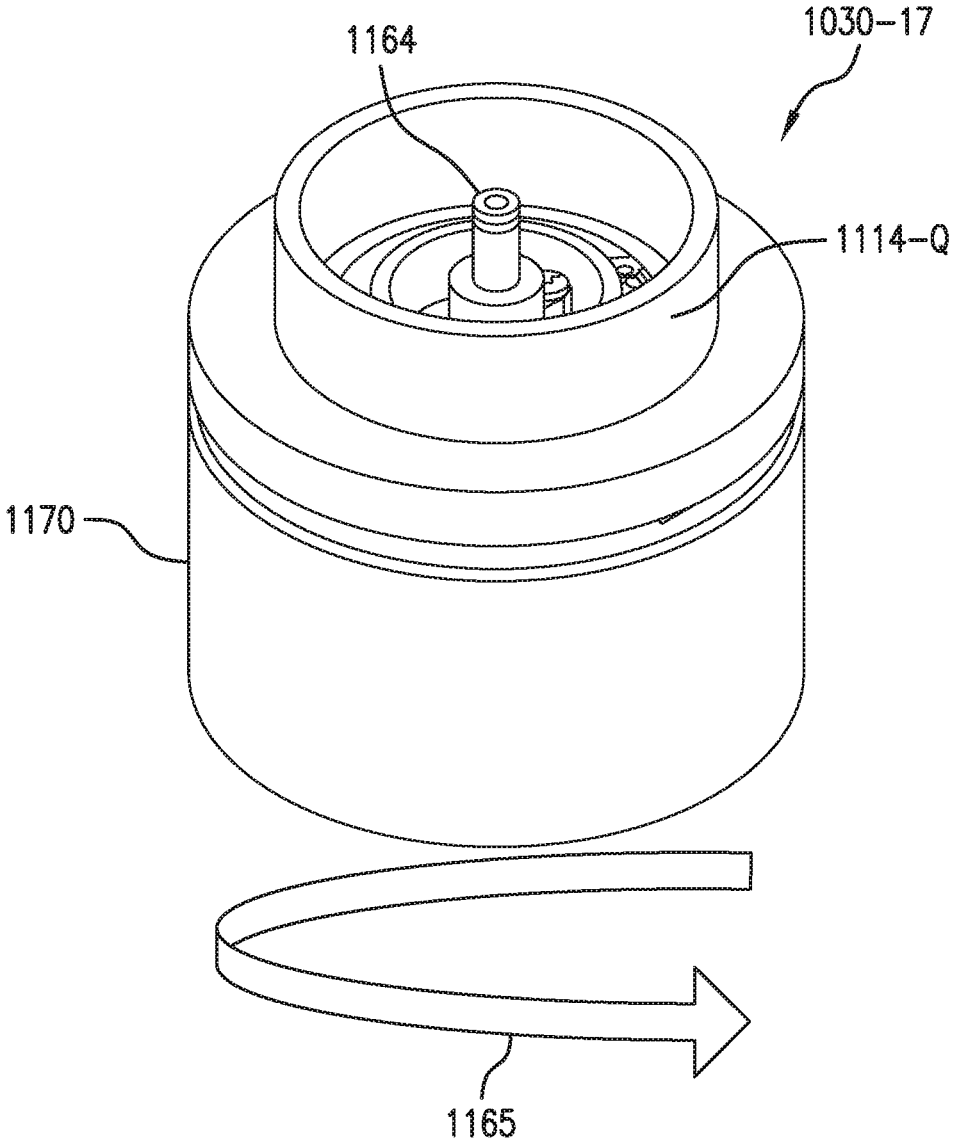
FIGS. 30A-30I are various views illustrating a casing that may be connected to the light engine of FIGS. 29A-29E according to an embodiment.
Figure 30B:
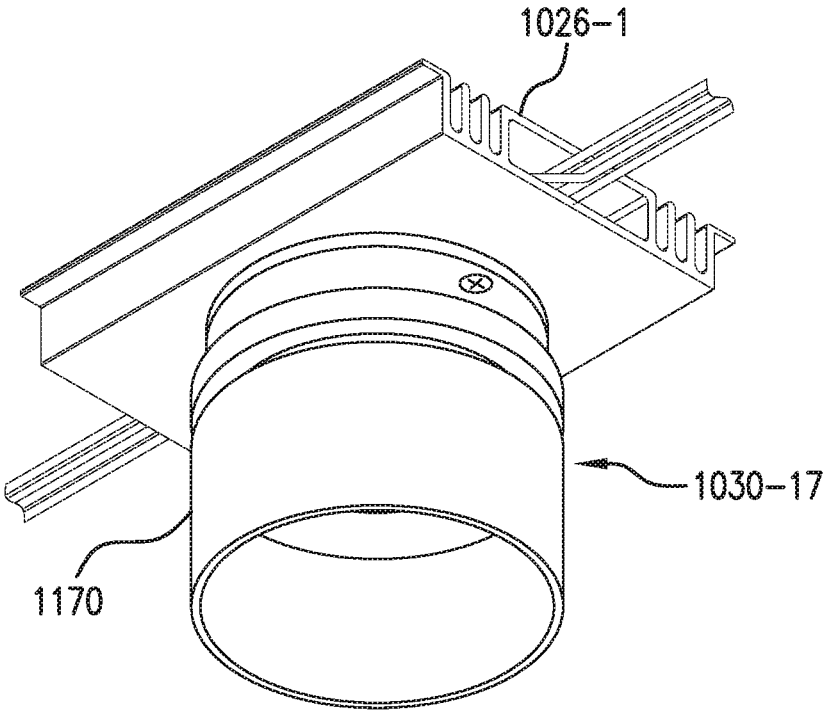
Figure 30C:
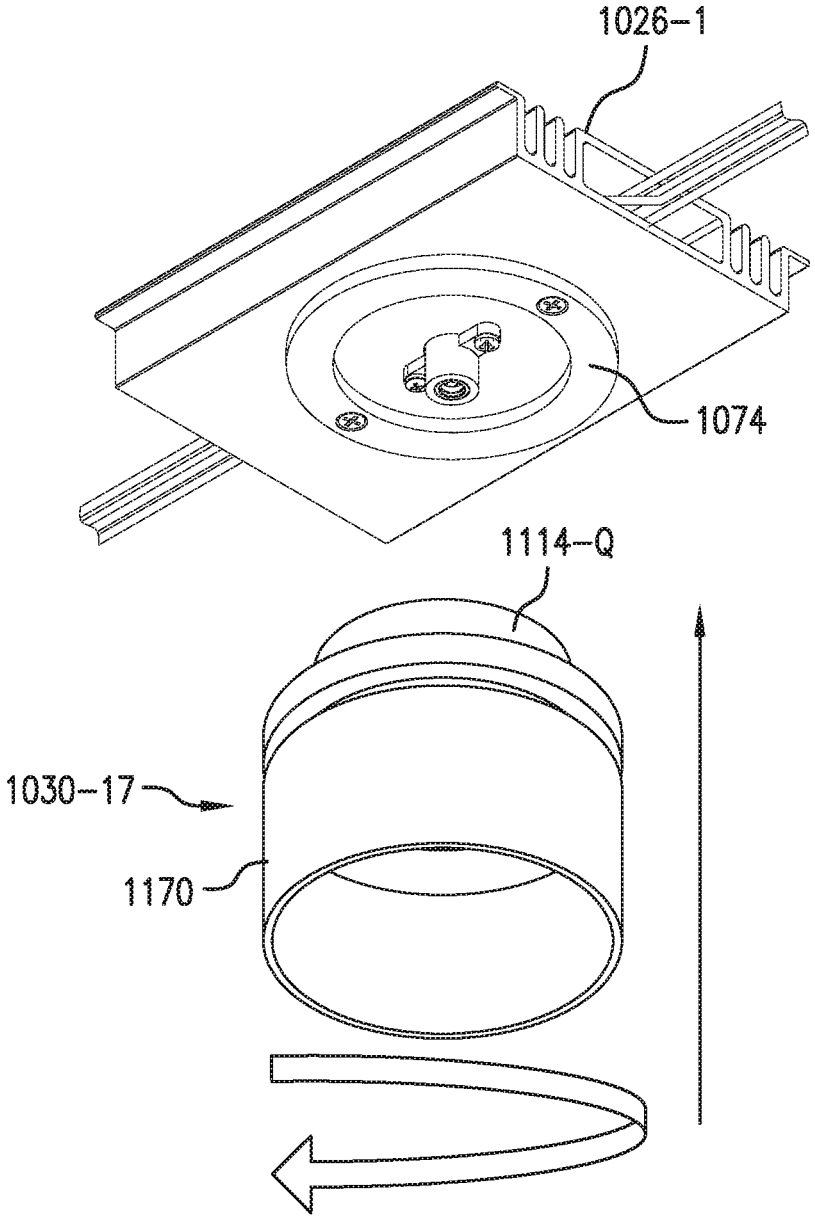
Figure 30D:
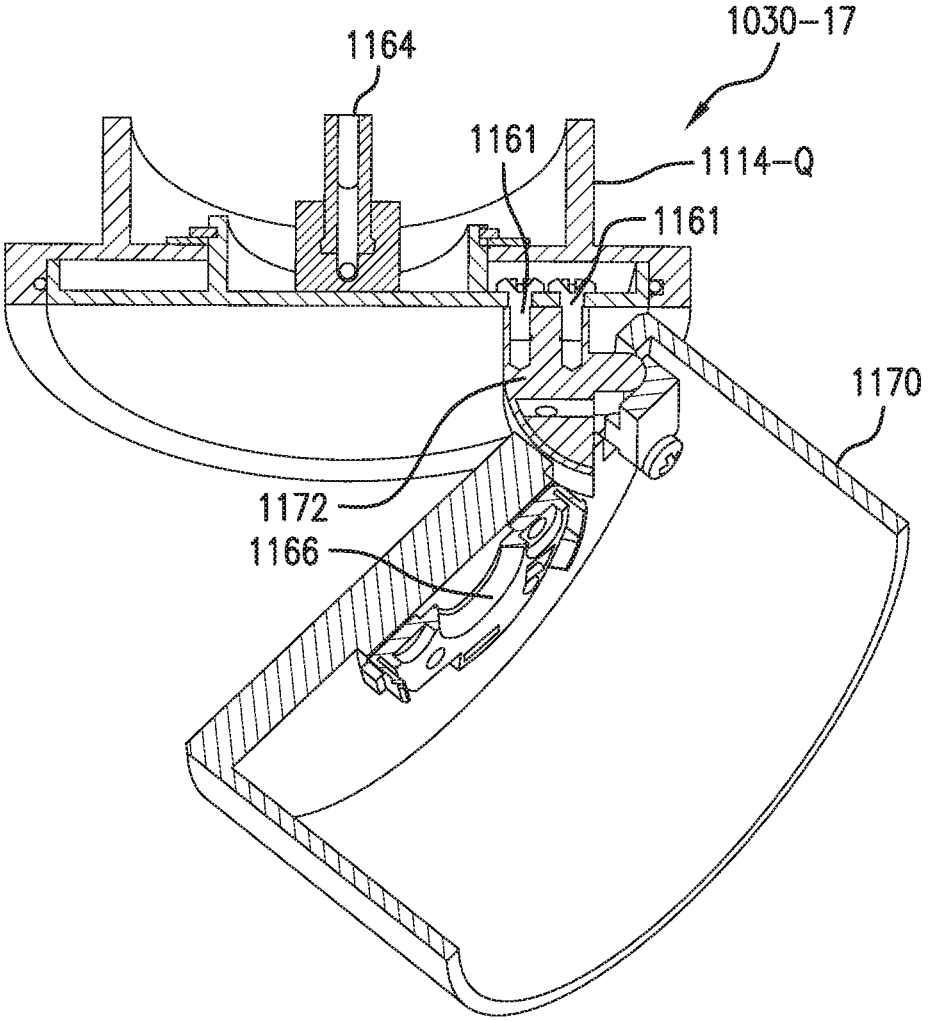

The casing 1030-17 may be coupled to the bottom part of the light engine 1026-1 by selectively coupling the portion 1114-Q (see FIG. 30C) to the connection ring 1074 of the light engine 1026-1 (see FIGS. 30C-30D).

The power jack 1164 of the casing 1030-17 is configured to be coupled to the power jack 1160 of the light engine 1026-1 to electrically connect the light source 1166 of the casing 1030-17 with the second set of two wires 1070-B (see FIG. 29A) of the light engine 1026-1.

As shown in FIG. 30A, the portion 1170 may be rotatable 360 degrees, as indicated by the arrow 1165 in FIG. 30A, with respect to the portion 1114-Q about an axis that is normal to the horizontal plane (when the casing 1030-17 is aligned horizontally).

Figure 30E:
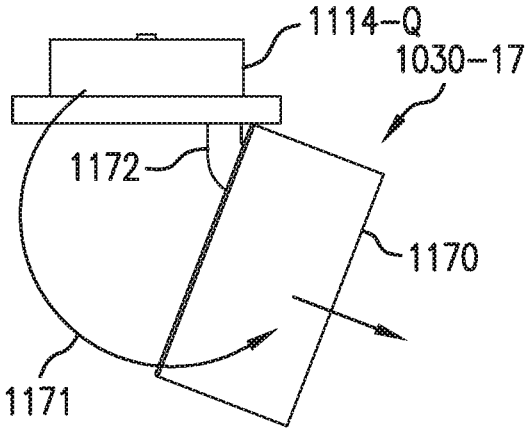
Figure 30F:
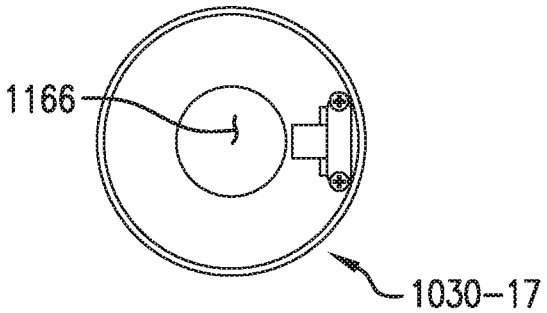
Figure 30G:
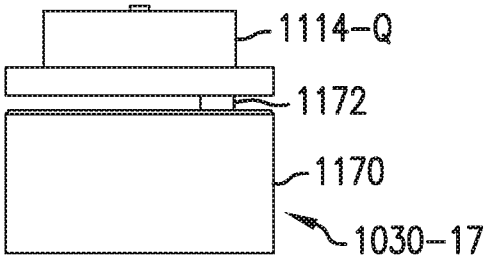
Figure 30H:
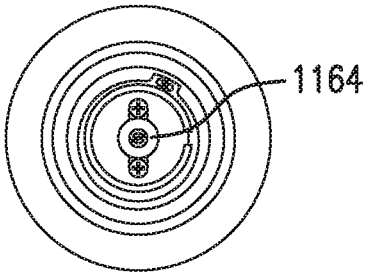
Figure 30I:
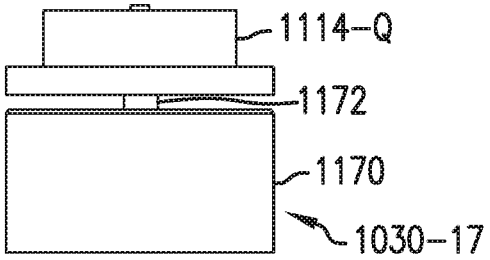

In addition to the rotation indicated by the arrow 1165 in FIG. 30A, the portion 1170 may also be rotatable about an axis that is parallel to the horizontal plane (when the casing 1030-17 is aligned horizontally), as indicated by the arrow 1171 in FIG. 30E. For example, as shown in FIG. 30E, the portion 1170 may be pivotally coupled to the intermediate member 1172 to be rotatable as indicated by the arrow 1171.

Thus, the casing 1030-17 may be used to generate light through the light source 1166 and to be rotatable in a plurality of directions to direct the generated light where needed.

Accordingly, the light engine 1026-1 may be used in combination with the casing 1030-17 to direct light in various directions, as needed.

Figure 31A:
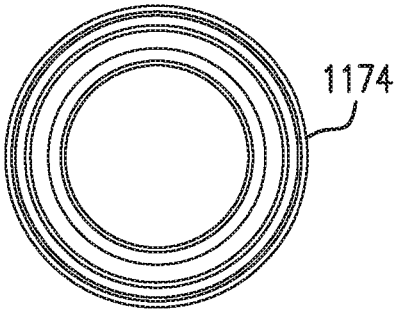
FIGS. 31A-31E are various views illustrating a round bezel that may be connected to the casing of FIGS. 30A-30I according to an embodiment.
Figure 31B:
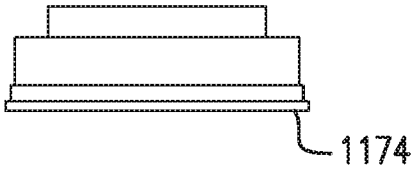
Figure 31C:
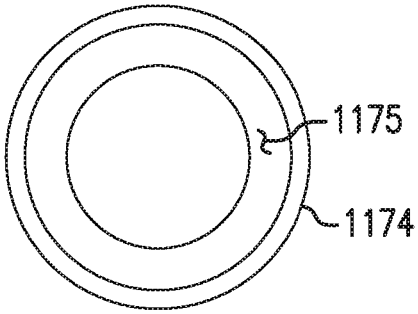
Figure 31D:
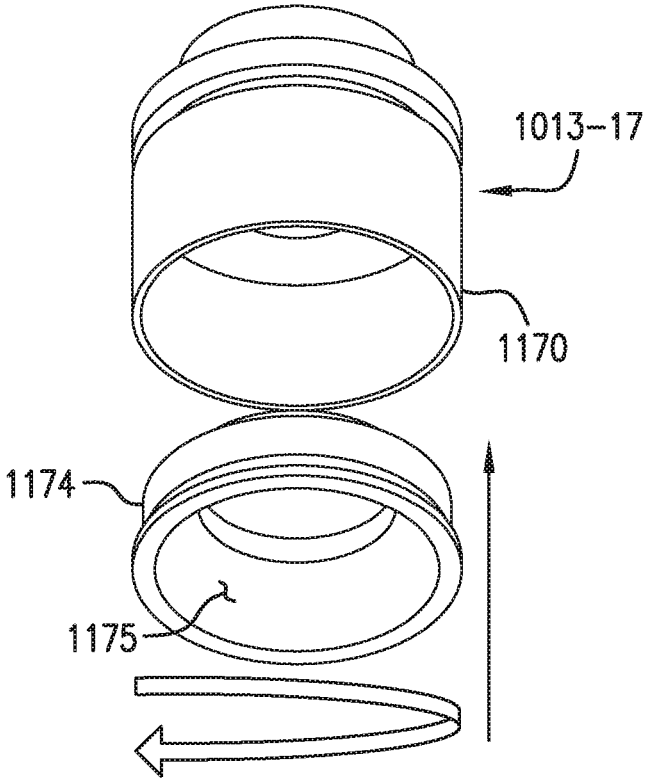

FIGS. 31A-31E illustrate a round bezel 1174 that may be selectively coupled to the light-emitting side of the portion 1170 (see FIG. 31D) of the casing 1030-17. As indicated in FIGS. 31A-31C, the round bezel 1174 may be threaded. As indicated in FIG. 31D, the light-emitting end of the portion 1170 may also be threaded to match the threads of the round bezel 1174.

Figure 31E:
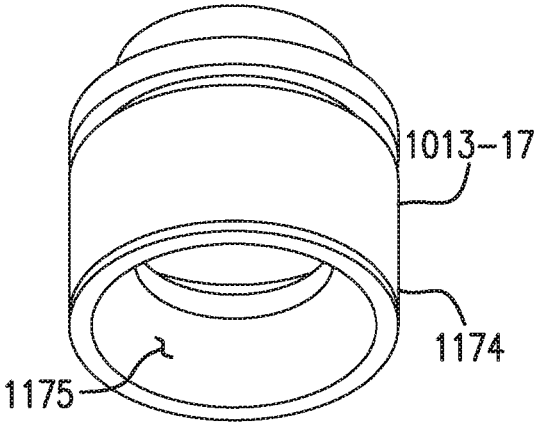

As illustrated in FIGS. 31C-31E, the round bezel 1174 may include a section 1175 that tapers toward the light-emitting side of the round bezel 1174 in order to help directing and/or reflecting the light emitted from the light source 1166 as needed.

Thus, as shown in FIGS. 31D-31E, the round bezel 1174 can be selectively coupled to and uncoupled from the casing 1030-17 to guide light emitted from the casing 1030-17.

FIGS. 32A-32D illustrate a light engine 1026-2 according to an alternate embodiment. The light engine 1026-2 may be single sided. As shown in FIGS. 32A-32E, the light engine 1026-2 may have a light source 1024 (see FIG. 32A), for example, a downlight, on the bottom side, opposite to the flanges 1088 (see FIG. 32A). Thus, the light engine 1026-2 may be used to provide illumination downwardly only.

Figure 32A:
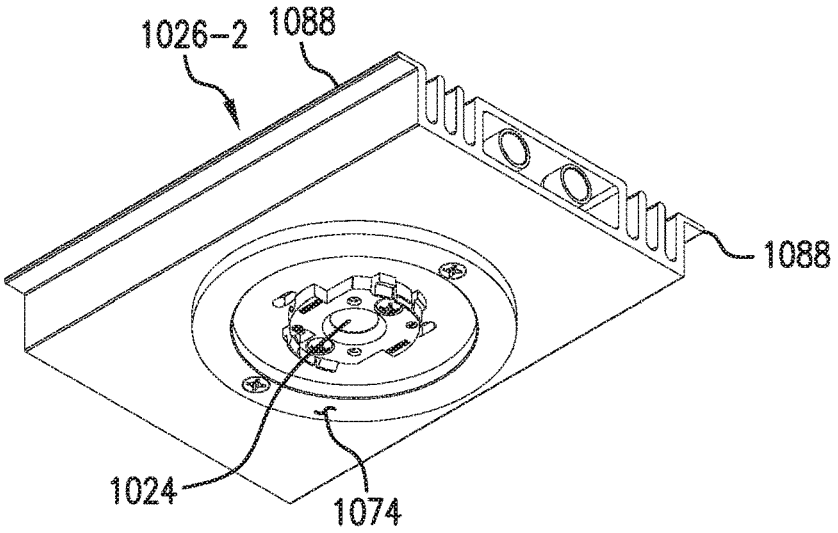
FIGS. 32A-32E are various views illustrating a light engine according to an embodiment.
Figure 32B:
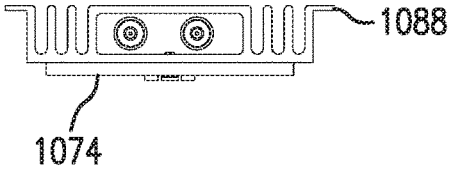
Figure 32C:
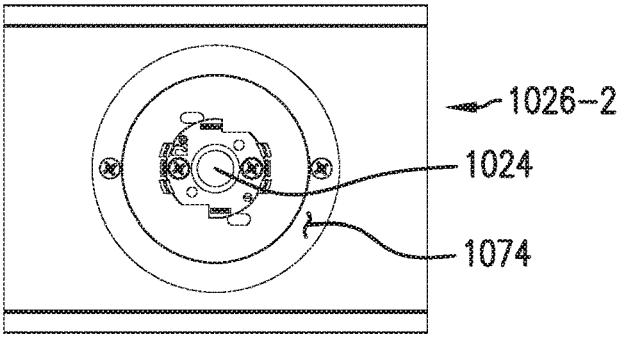
Figure 32D:
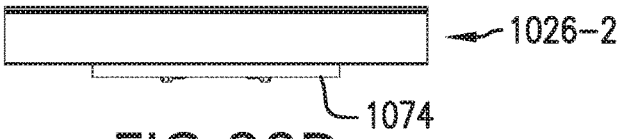
Figure 32E:
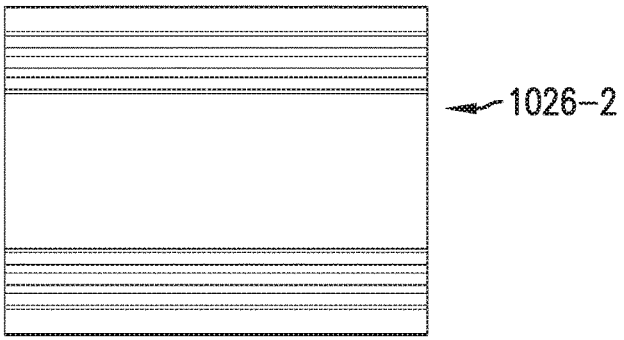

As shown in FIG. 32A, the light engine 1026-2 may have the same connection ring 1074 as the light engines 1026 and 1026-1 described above.

Thus, each of the casings 1030 to 1030-16 may be selectively coupled to the light engine 1026-2.

Although not shown in the drawings, the light engine 1026-2 may have a pair of wires feeding power to it since it has one light source (e.g., the light source 1024).

The wires of the light engine 1026-2 may have a male plug on one end and a female plug on the other end, similarly to the cables 1070, such that a plurality of light engines 1026-2 may be electrically connected to one another through their respective male and female plugs, as shown in FIG. 3 for the light engines 1026.

Thus, in an alternate embodiment, a beam may be configured to include a plurality of light engines 1026-2.

Figure 33A:
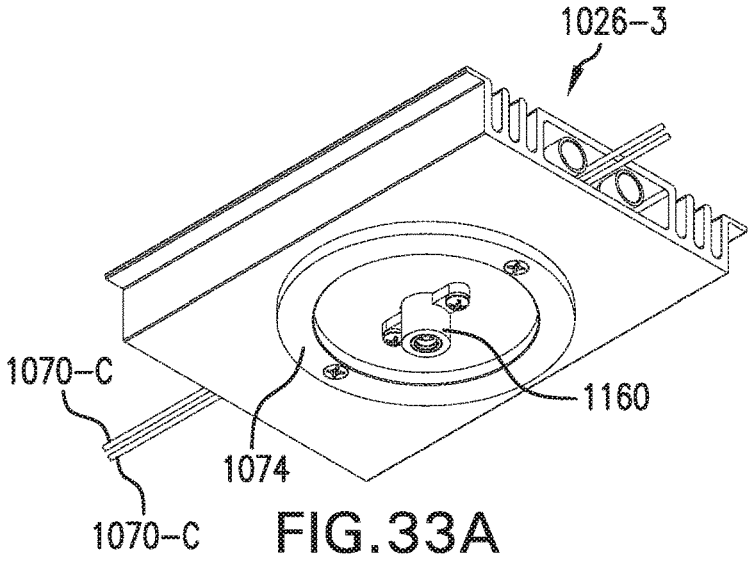
FIGS. 33A-33E are various views illustrating a light engine according to an embodiment.
Figure 33B:
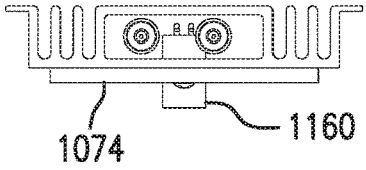
Figure 33C:
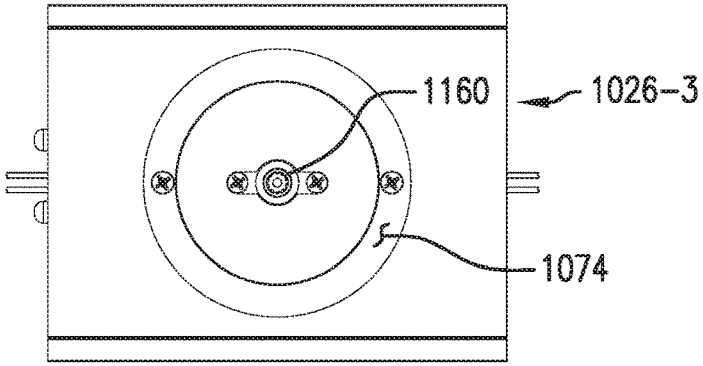
Figure 33D:
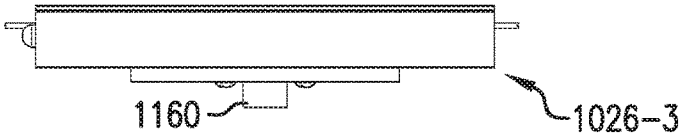
Figure 33E:
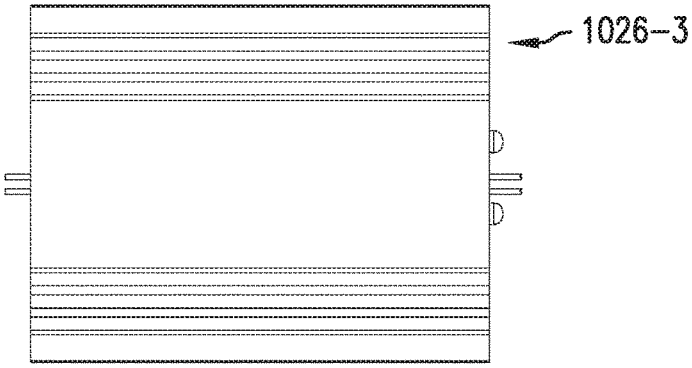

FIGS. 33A-33E illustrate a single sided light engine 1026-3 according to an alternate embodiment. The light engine 1026-3 may be similar to the light engine 1026-2 except for having the power jack 1160, as shown in FIGS. 33A-33B, instead of the light source 1024. The power jack 1160 may be electrically connected to the two wires 1070-C shown in FIG. 33A.

Thus, in an alternate embodiment, a beam may include a plurality of light engines 1026-3 connected to one another in a manner similar to light engines 1026 of FIG. 3. In a further alternate embodiment, a beam may include at least one light engine 1026-3 and a light engine 1026-2 electrically connected to one another.

Figure 33F:
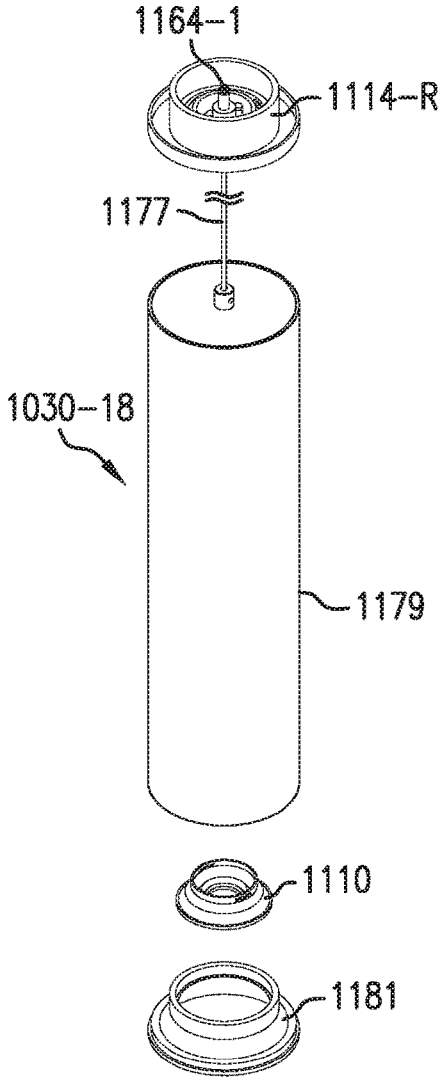
FIGS. 33F-33H are various views illustrating a pendant casing a casing that may be disposed on a lower side of a beam according to an embodiment.
Figure 33G:
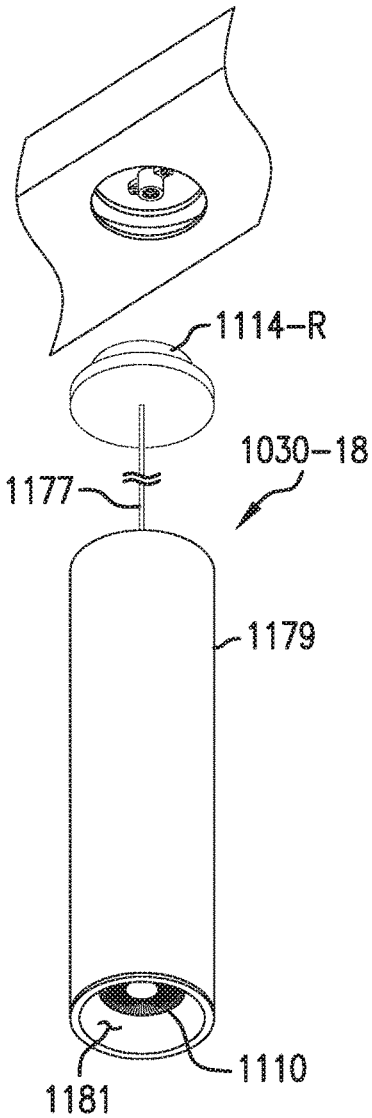
Figure 33H:
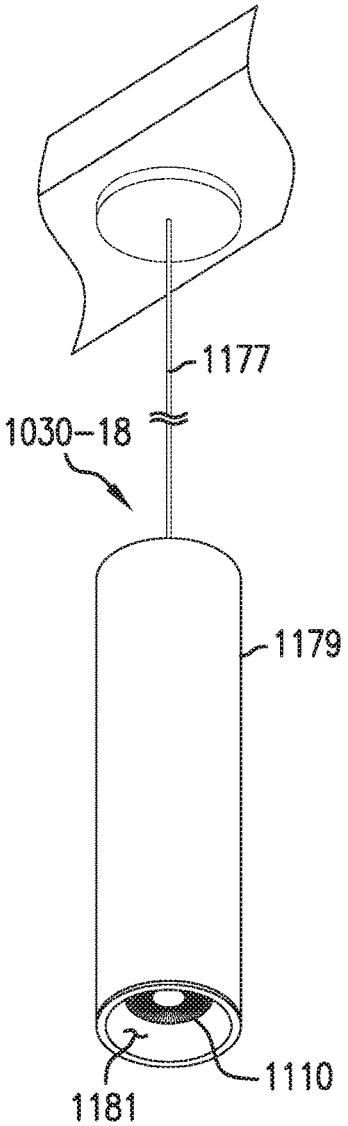

FIGS. 33F-33H illustrate a pendant casing 1030-18 according to an alternate embodiment. The pendant casing 1030-18 may include a portion 1114-R, a power cord 1177, an elongated body 1179 (e.g., an elongated cylindrical body 1179) with a light source disposed therein (not shown), a lens 1110 and a bezel neck 1181.

The portion 1114-R (see FIGS. 33F-33G) may be configured to be coupled with the lower side of the light engine 1026-1 and with the lower side of the light engine 1026-3 through the connection ring 1074 of each of the light engines 1026-1 and 1026-3.

The portion 1114-R may include a power jack 1164 (see FIGS. 33F-33G) configured to be coupled with the power jack 1160 (see FIG. 33A), at the bottom of the light engine 1026-3, and with the power jack 1160 (see FIG. 29A) at the bottom of the light engine 1026-1 in order to electrically connect the light source disposed within the elongated body 1179 with the light engine 1026-3 and the light engine 1026-1.

The power cord 1177 may include a plurality of wires transmitting electrical power from the power jack 1164-1 of the portion 1114-R to the light source disposed inside of the elongated body 1179. In addition, the power cord 1177 structurally connects the portion 1114-R with the elongated body 1179, supporting the weight of the elongated body 1179. The length of the power cord 1177 may be varied as needed in order to suspend the elongated body 1179 to a desired elevation.

Referring to FIGS. 33F-33G, the lens 1110 may be disposed inside of the elongated body 1179, covering the light source (not shown) in the body 1179, and the bezel neck 1181 may be disposed on the lens 1110. Thus, the lens 1110 and the bezel neck 1181 may help condense, spread and/or reflect the light emitted from the light source inside of the elongated body 1179 downwardly.

Figure 33I:
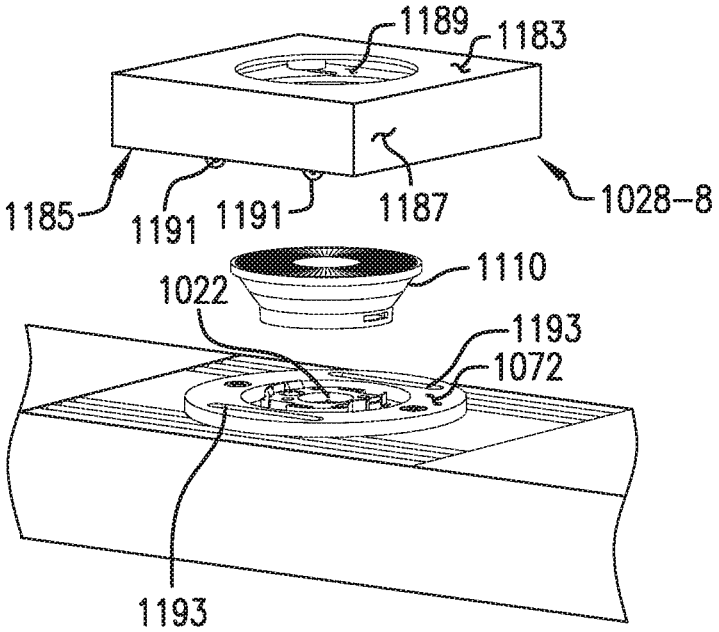
FIGS. 33I-33J are various views illustrating a pendant casing a casing that may be disposed on an upper side of a beam according to an embodiment.
Figure 33J:
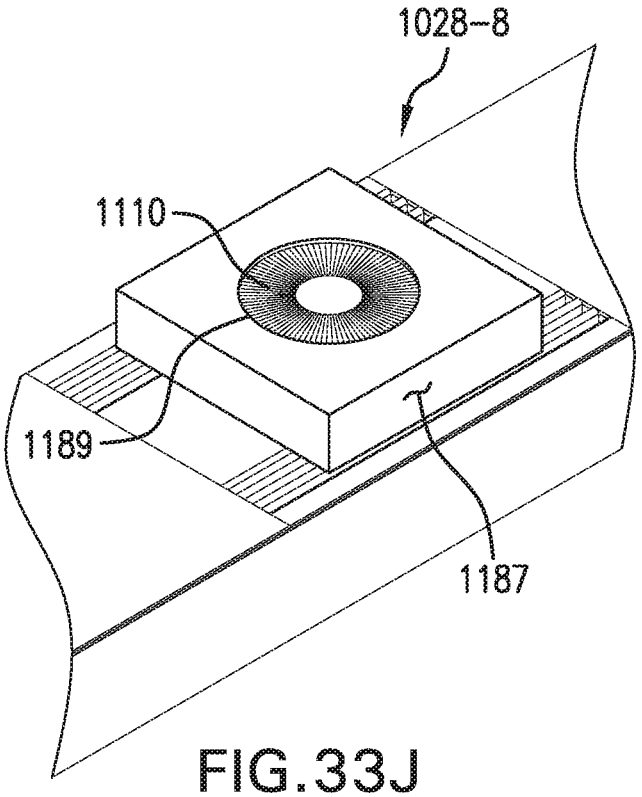

FIGS. 33I-33J illustrate a casing 1028-8 according to an alternate embodiment. The casing 1028-8 may be combined with the top sides of the light engines 1026 and 1026-1 to cover the uplights.

The casing 1028-8 may have a square shape, and may include an upper side 1183, a bottom side 1185, a plurality of sidewalls 1187, and a plurality of wire springs 1191. The upper side 1183 may include an opening 1189 to allow light to pass through the casing 1028-8.

A first set of wire springs 1191 (see FIG. 33I) may be disposed on the bottom side 1185 of the casing 1018-8, adjacent to one of the sidewalls 1187. A second set of wire springs 1191 (not shown) may also be disposed on the bottom side 1185 of the casing 1018-8, adjacent to an opposite sidewall 1187.

The wire springs 1191 may be configured to be selectively coupled to mounting slots 1193 (see FIG. 33I and FIG. 6C) of the connection ring 1072 of any of the light engines 1026 and 1026-1. FIG. 6C illustrates the mounting slots 1193 more clearly.

For each of the light engines 1026 and 1026-1, a lens 1110 may be disposed between the light source 1022 and the casing 1028-8.

For each of the light engines 1026 and 1026-1, the casing 1028-8 may be installed by aligning the first set of wire springs 1191 with one of the mounting slots 1193 of the connection ring 1072, aligning the second set of wire springs 1191 with the other of the mounting slots 1193 of the connection ring 1072, and pressing the casing 1028-8 toward the light engine (1026 or 1026-1) until the first and second sets of wire springs 1191 snap onto mounting slots 1193 of the connection ring 1072. The snapping motion and sound indicates that the light engine 1026 or 1026-1, as the case may be, is selectively coupled with the casing 1028-8.

FIGS. 33K-33U illustrate a casing 1030-19 according to an alternate embodiment. The casing 1030-19 may be coupled to the bottom side of the light engines 1026 and 1026-2.

The casing 1030-19 may have a square shape. The casing 1030-19 may include an adjustable portion 1114-S for selective coupling with the connection ring 1074 of the light engines 1026 and 1026-2, a plurality of tapering sidewalls 1195, a plurality of spring clips 1199, and a plurality of sides 1197.

The adjustable portion 1114-S may be threaded (not shown) in order to be selectively coupled with the threaded connection ring 1074 of the light engines 1026 and 1026-2.

Figure 33K:
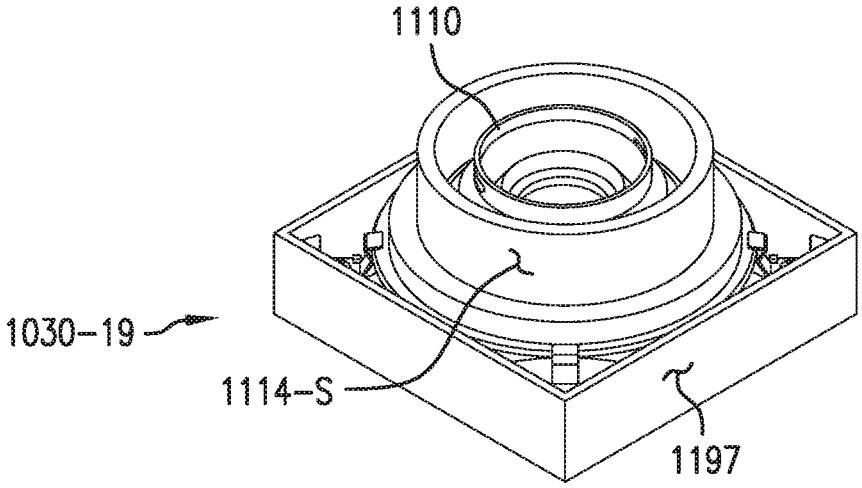
FIGS. 33K-33U are various views illustrating a pendant casing a casing that may be disposed on a lower side of a beam according to an embodiment.
Figure 33L:
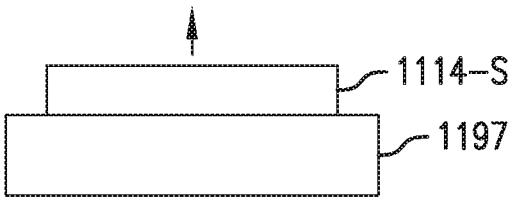
Figure 33M:
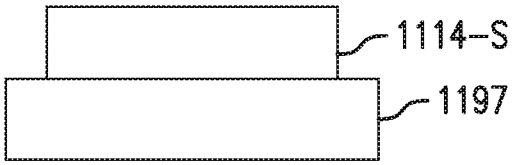

The adjustable portion 1114-S may be adjustable between a first state, as shown in FIG. 33M, and a second state, as shown in FIG. 33L. For example, the adjustable portion 1114-S may be selectively extendable and retractable between the first and second states shown in FIGS. 33L-33M.

Figure 33N:
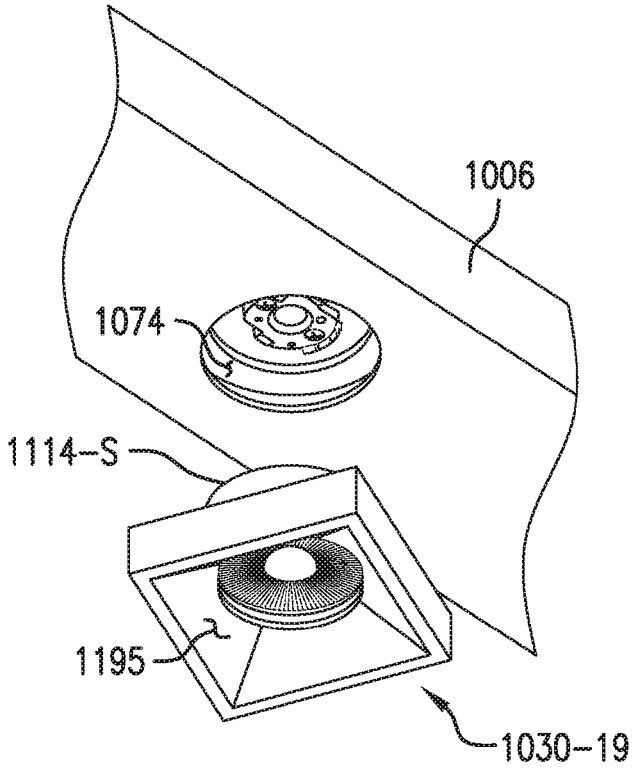
Figure 33O:
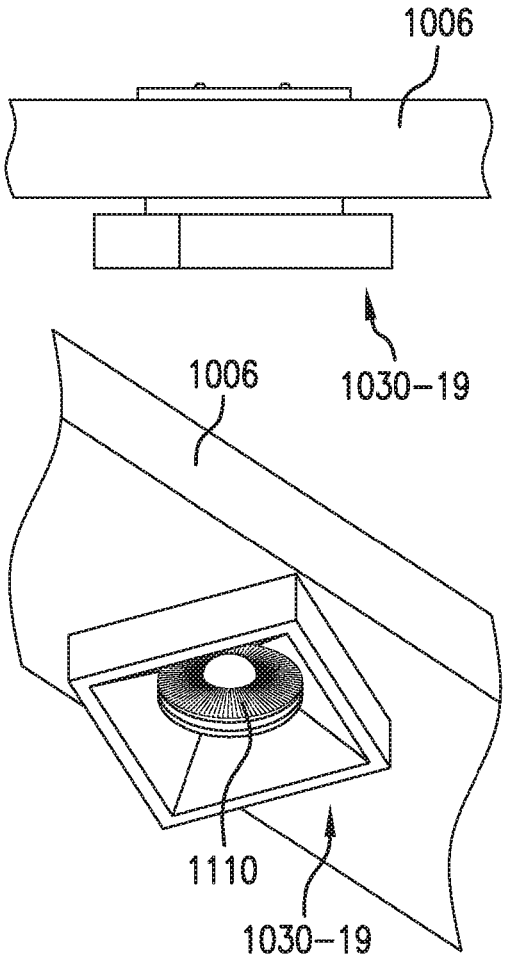
Figure 33P:
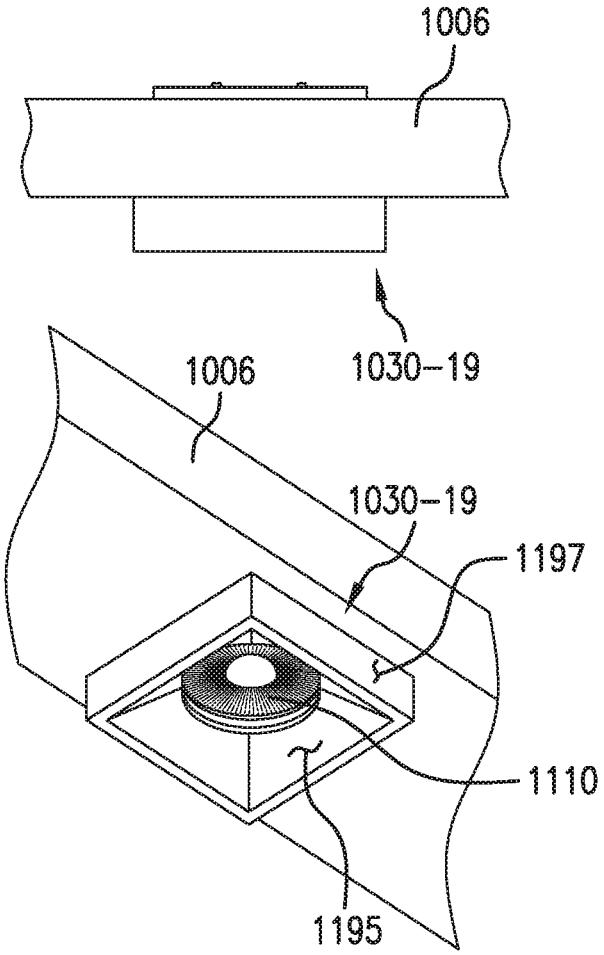
Figure 33Q:
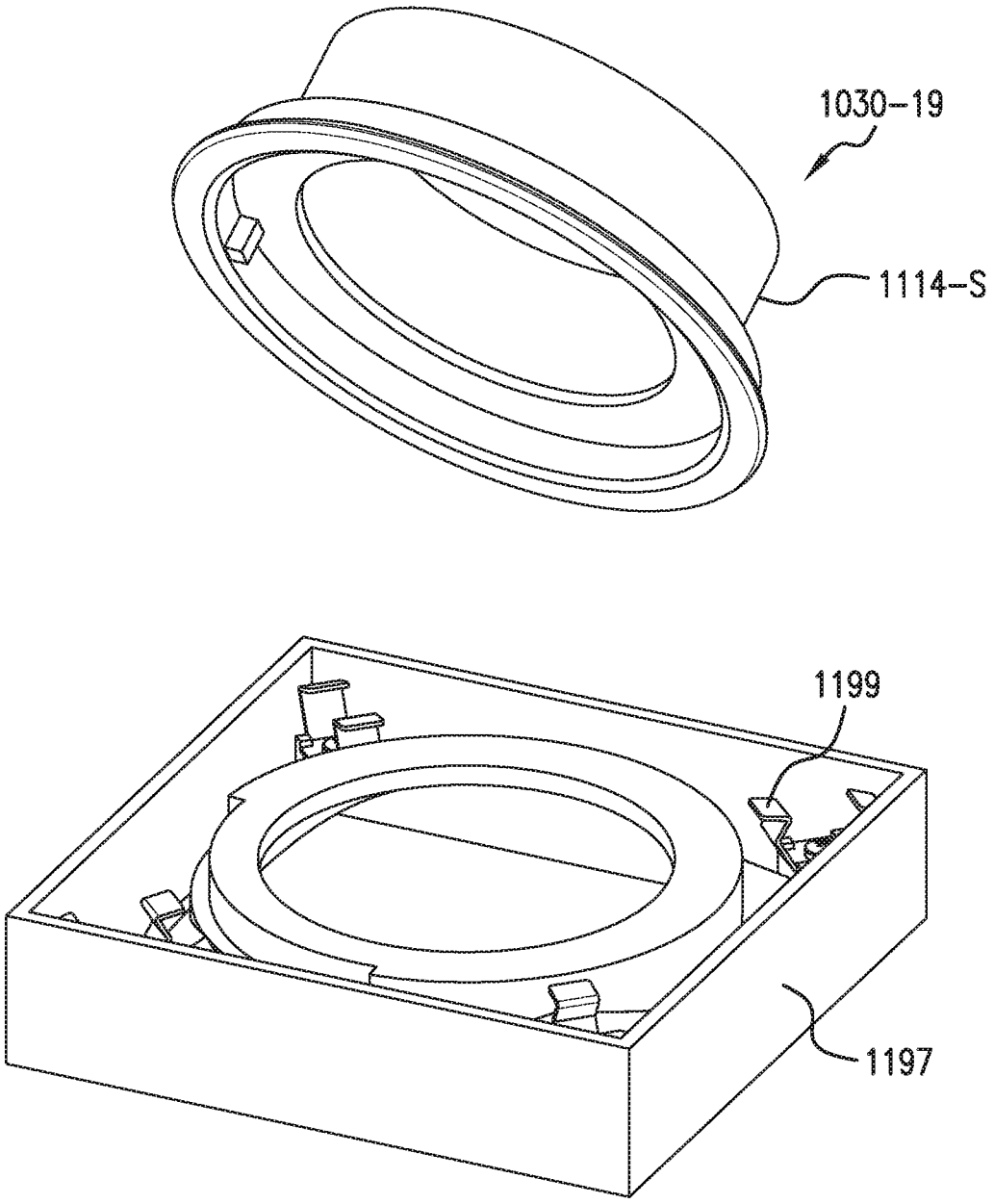
Figure 33R:
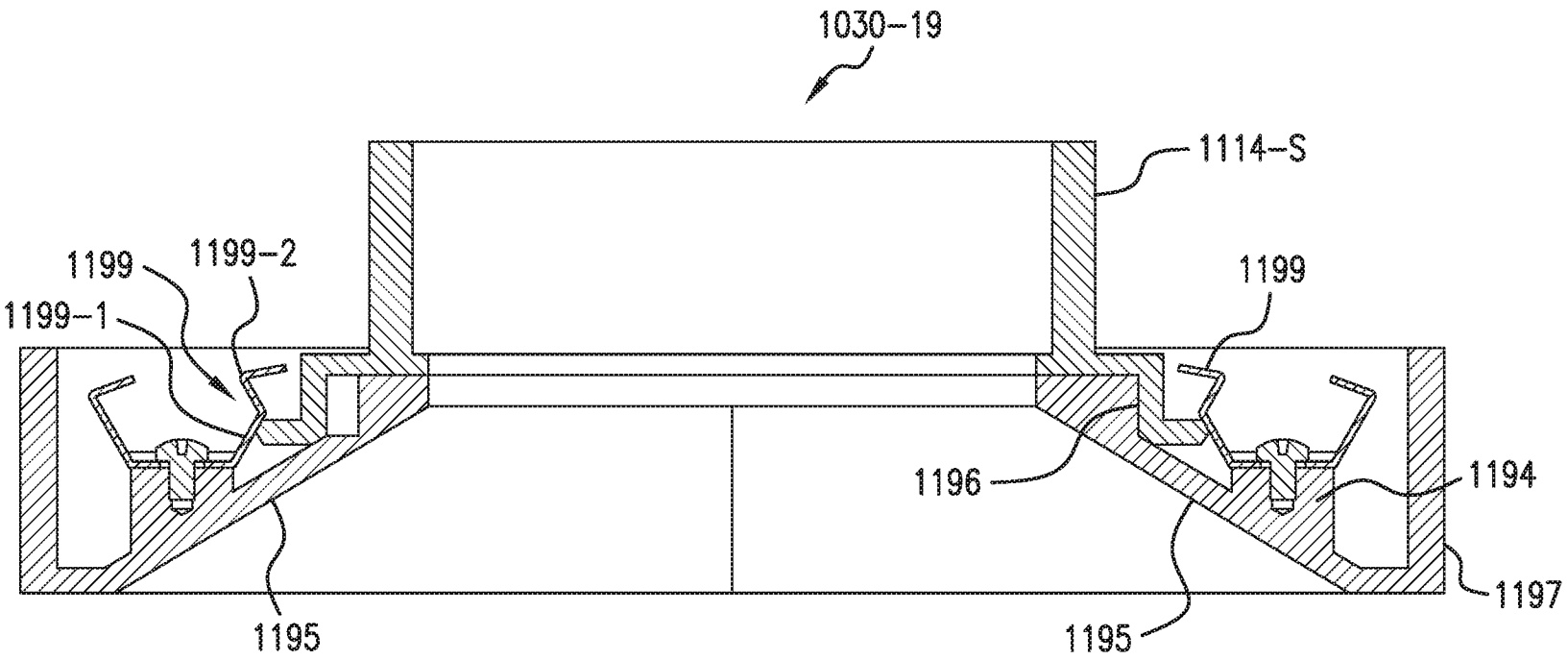
Figure 33S:
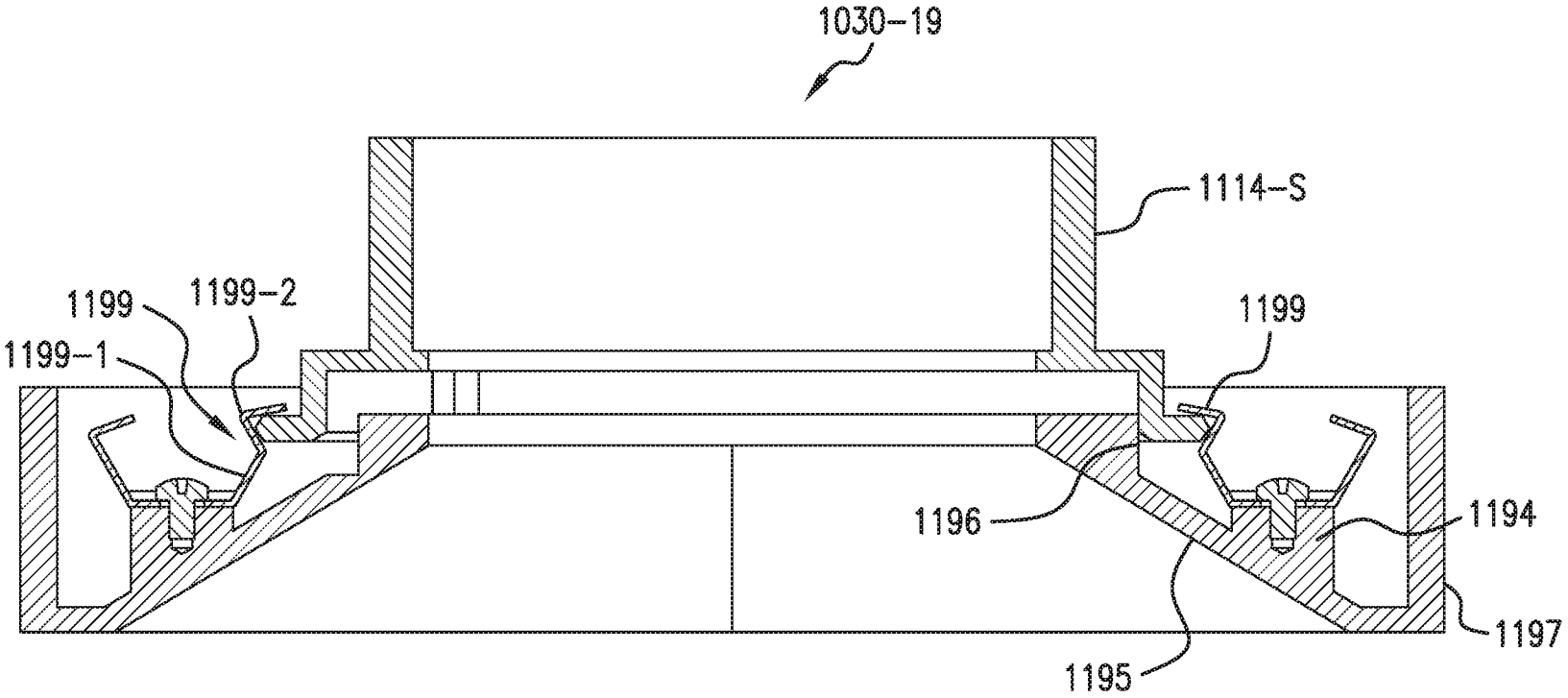

FIG. 33R is a cross-section illustrating the casing 1030-19 in the retracted state, and FIG. 33S is a cross-section illustrating the casing 1030-19 in the extended state.

Referring to FIGS. 33S and 33R, each of the spring clips 1199 may be attached to an abutment 1194 over a respective sidewall 1195, for example, by a screw. The spring clips 1199 may be made of an elastic material, for example, an elastic metal, an elastic plastic material, etc.

Referring again to FIGS. 33S and 33R, each of the spring clips 1199 may include a first portion 1199-1 configured to maintain the portion 1114-S pressed on the sidewalls 1195 when the adjustable portion 1114-S is in the retracted state (see FIG. 33R) and a second portion 1199-2 extending from the first portion 1199-1

The second portion 1199-2 of each spring clip 1199 may have a hooked, or notched shape, as shown in FIGS. 33R-33S. When the adjustable portion 1114-S is in the extended state (see FIG. 33S), the second portion 1199-2 of the clip 1199 maintains the adjustable portion 1114-S is in the extended state due to its hook or notch-like shape. For example, the hook or notch-like shape of the second portion 1199-2 of the spring clip 1199 selectively locks the adjustable portion 1114-S in place in the extended state.

The shape and flexibility of the spring clips 1199 allows the adjustable portion 1114-S to travel on a collar 1196 (see FIGS. 33R-33S) between the extended state and the retracted state, and to be maintained in the extended or retracted state, as the case may be, until an external force acting on the casing 1030-19 overcomes the spring forces of the clip 1199 in order to change the state of the adjustable portion 1114-S.

As shown in FIG. 33K, a lens 1110 may be disposed within the casing 1030-19.

To selectively couple the casing 1030-19 to the light engines 1026 and 1026-2, the adjustable portion 1114-S may be set to the extended state, as shown in FIG. 33M, and FIG. 33R. With the adjustable portion 1114-S in the extended state, the casing 1030-19 may be selectively coupled to the connection ring 1074 of the light engines 1026 and 1026-2, by, for example, screwing the adjustable portion 1114-S to the connection ring 1074 of the light engines 1026 and 1026-2. In addition, during the coupling process, the sides 1197 of the casing 1030-19 may be aligned with the sidewalls 1036 and 1038 of the beam 1006.

Figure 33T:
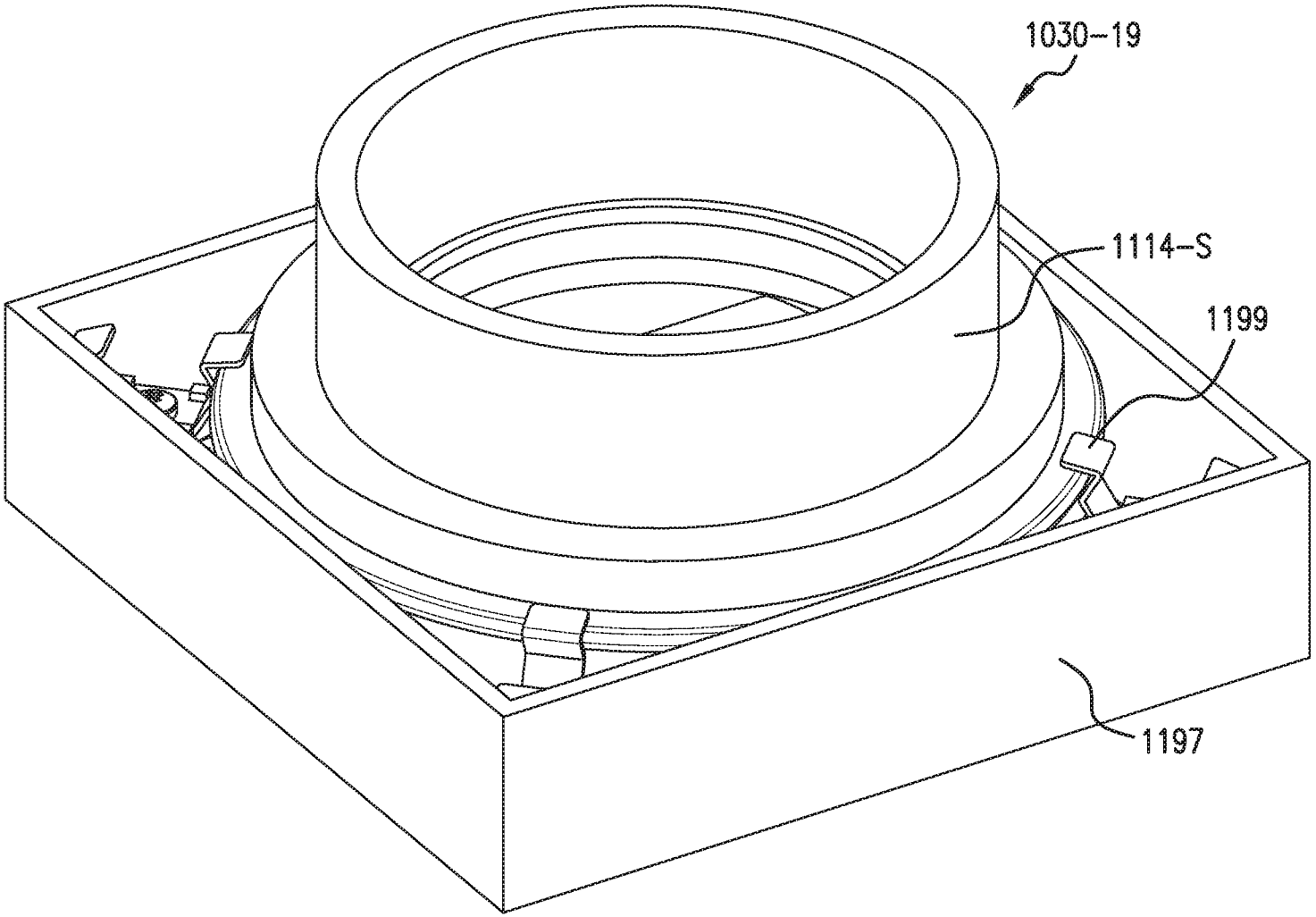
Figure 33U:
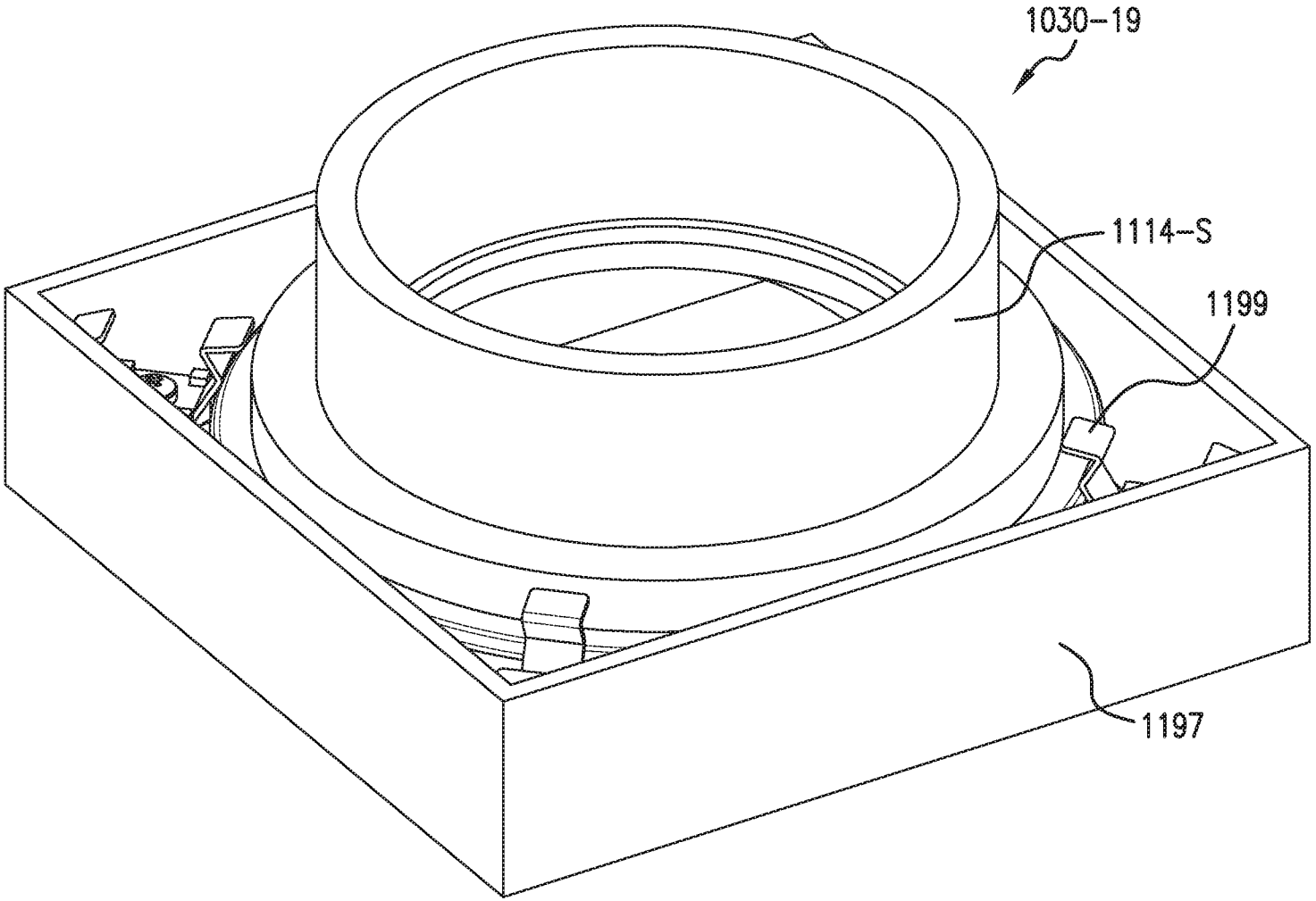

FIG. 33T and FIG. 33S illustrate the adjustable portion 1114-S in the extended state. FIG. 33R and FIG. 33U illustrate the adjustable portion 1114-S in the retracted state.

Once coupled to the light engine 1026 or 1026-2, as the case may be, the casing 1030-19 may be pushed upwardly toward the beam 1006 in order to be disposed closer to the beam 1006. When the casing 1030-19 is pushed upwardly, the adjustable portion 1114-S is set in the retracted state, as shown in FIGS. 33M and 33P.

Since the casing 1030-19 may be coupled to the light engines 1026 and 1026-2 with the adjustable portion 1114-S in the extended state, the sides 1197 of the casing 1030-19 are separated apart from the beam 1006 during the coupling process. Thus, the sides 1197 of the casing 1030-19 avoid contacting (e.g., scratching) the beam 1006 when screwing the adjustable portion 1114-S to the connection ring 1074 through the beam 1006, as shown in FIG. 33N and FIG. 33O.

Accordingly, the casing 1030-19 may be selectively coupled to the light engines 1026 and 1026-2 without scratching the beam 1006.

The inner sidewalls 1195 may taper toward the light-emitting side of the casing 1030-19 in order to reflect and/or spread light downwardly.

As can be appreciated from the above disclosure, a beam according to the present invention may be variously configured to have different lengths, different kinds and different numbers of light engines (e.g., single or dual-sided light engines), lenses, and different types of casings configured to generate, direct, condense, spread and/or diffuse the light.

In addition, a plurality of beams according to the present invention can be electrically and structurally connected to each other through different types of connectors as will be described below.

Figure 34:
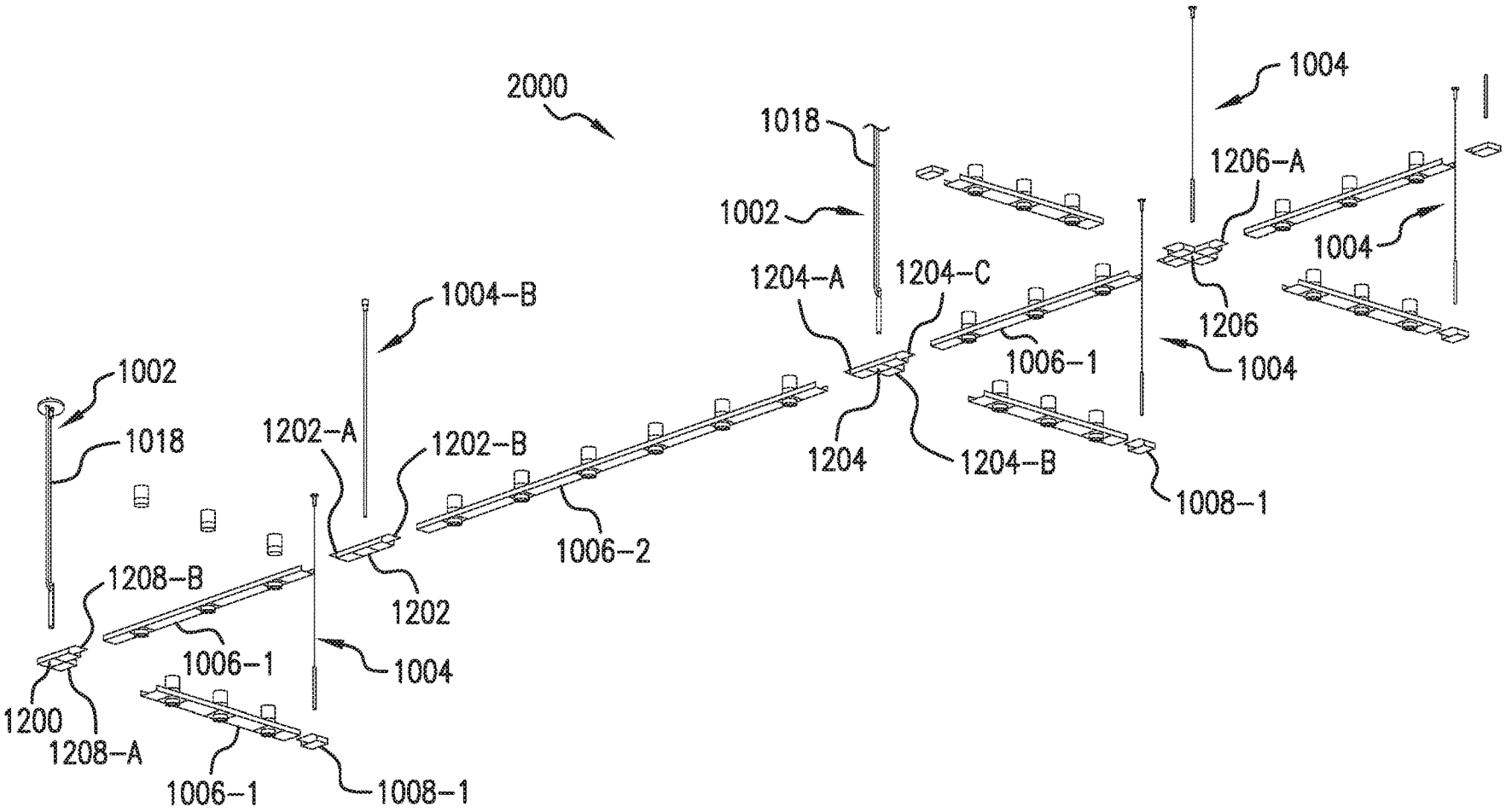
FIG. 34 is an exploded perspective view illustrating a lighting system according to an embodiment.

Referring to FIG. 34, a lighting system 2000 may include a plurality of beams 1006-1, a beam 1006-2, a plurality of suspenders 1002, a plurality of suspenders 1004, a suspender 1004-B, a plurality of connectors 1008-1, a connector 1200, a connector 1202, a connector 1204 and a connector 1206.

Each of the beams 1006-1 may be the same as the beam 1006 described in FIG. 3. The beam 1006-2 may be similar to the beam 1006 of FIG. 3, but may have six dual sided light engines instead of three. Thus, each of the beams 1006-1 and 1006-2 may have a cable 1094 and a cable 1102 extending between their respective ends, as described above for the beam 1006.

Referring to FIG. 34, the plurality of suspenders 1002, 1004 and 1004-B may suspend the beams 1006-1 and 1006-2 from the ceiling. The two suspenders 1002 may provide electrical power to the beams 1006-1 and 1006-2 of the lighting system 2000, as shown in FIG. 34 (see cables 1018 in FIG. 34).

As shown in FIG. 34, the connector 1200 is configured to structurally and electrically connect two beams 1006-1 to each other.

Figure 35A:
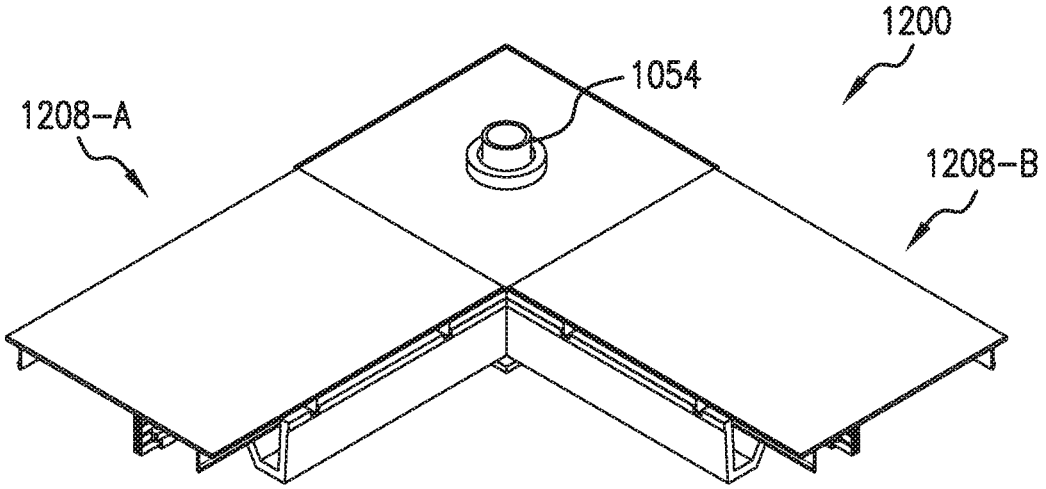
FIGS. 35A-35B are respectively perspective top and bottom views illustrating a connector according to an embodiment.
Figure 35B:
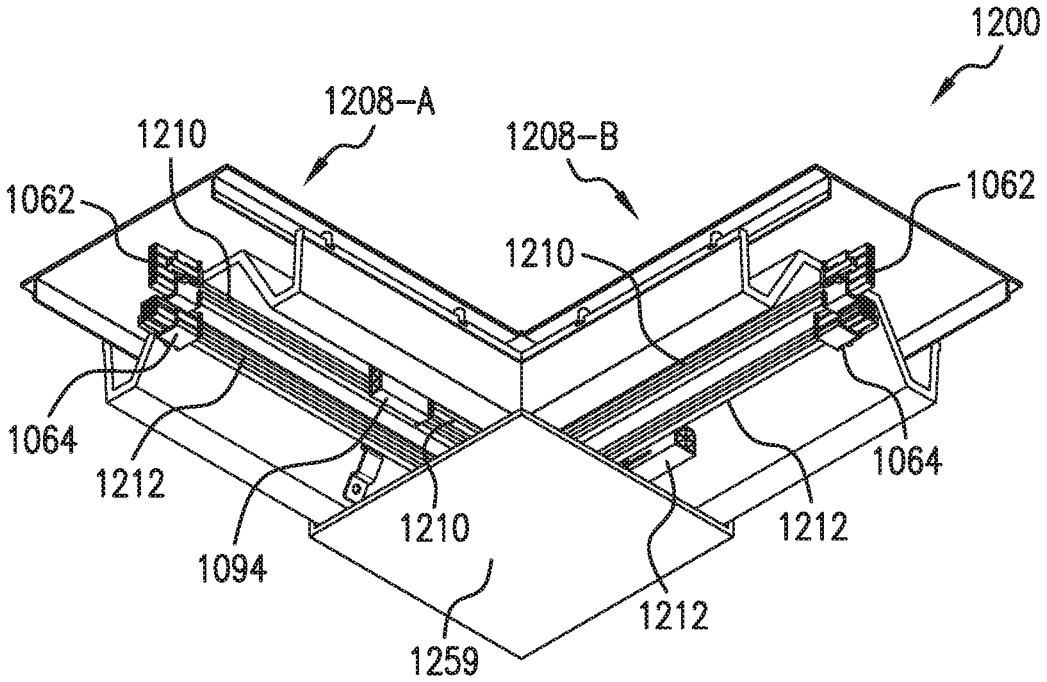

FIGS. 35A and 35B are respectively top and bottom perspective views illustrating the connector 1200 according to an embodiment. The connector 1200 may be referred to as a corner connector.

Referring to FIGS. 35A and 35B, the connector 1200 may have a first wing 1208-A and a second wing 1208-B, a plurality of cables 1210, a plurality of cables 1212, a hollow coupler 1054 for selective connection with the suspender 1002 (see FIG. 34), and a bottom cover 1259.

The connector 1200 may couple, for example two of the beams 1006-1 to each other. Referring to FIG. 34, the first wing 1208-A may be configured to be coupled with an end of one of the two beams 1006-1, and the second wing 1208-B may be configured to be coupled with an end of the other of the two beams 1006-1.

The plurality of cables 1210 and the plurality of cables 1212 of the connector 1200 may be configured to electrically connect the two beams 1006-1 to each other. The cables 1210 are electrically connected in common to each other. The cables 1212 are electrically connected in common to each other. However, the cables 1210 are not electrically connected to the cables 1212.

Referring to FIG. 35B, two of the cables 1210 may have a connector 1062 and one of the cables 1210 may have a connector 1094. Refer to FIG. 5B for a more clear view of the connectors 1062 and 1094.

Figure 35C:
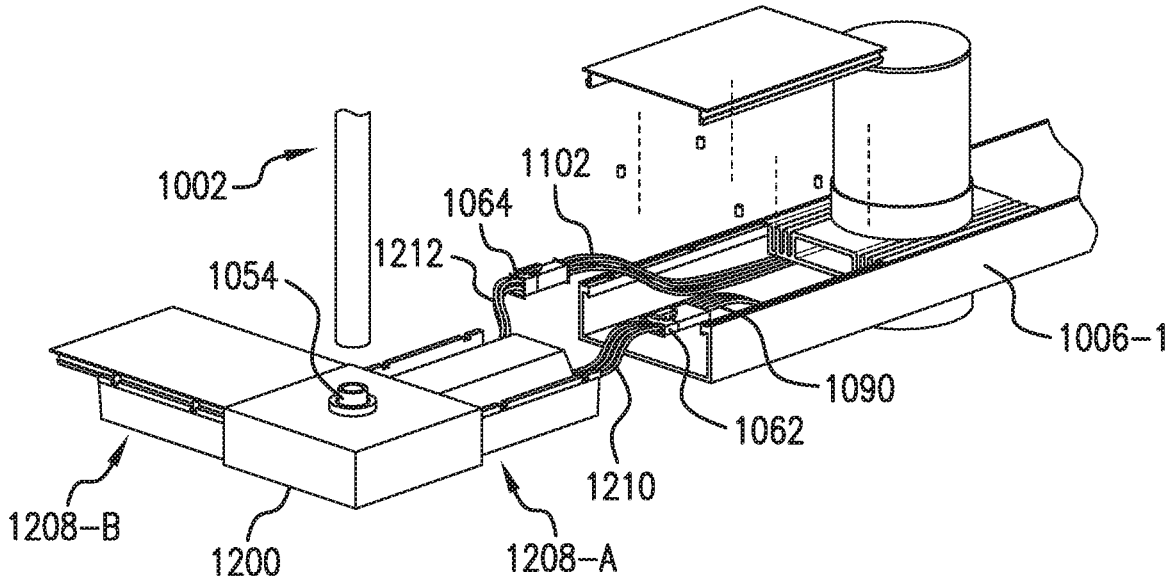
FIGS. 35C-35F are perspective views illustrating a method of electrically and structurally coupling two beams to the connector of FIGS. 35-35B according to an embodiment.

The two cables 1210 that have connectors 1062 are configured to electrically connect the cables 1090 of the two beams 1006-1 to each other. FIG. 35C illustrates that one of the cables 1210, extending through the wing first wing 1208-A, is electrically coupled to the cable 1090 of one of the beams 1006. The other of the cables 1210, extending through the second wing 1208-B, may be coupled to the cable 1090 of the other beam 1006-1.

Thus, the cables 1210 of the connector 1200 may electrically connect the cables 1090 of the two beams 1006-1 to each other for transmitting electrical power and dimming control signals between the cables 1090 of the two beams 1006-1.

Referring to FIG. 35C, the cable 1212 of the first wing 1208-A may be connected to the cable 1102 of one of the beams 1006-1 through a connector 1064. The cable 1212 of the second wing 1208-B may also be connected to the cable 1102 of the other beam 1006-1 through a connector 1064.

Thus, the cables 1212 of the connector 1200 may electrically connect the cables 1102 of the two beams 1006-1 to each other for transmitting electrical power and dimming control between the cables 1102 of the two beams 1006-1.

Figure 35D:
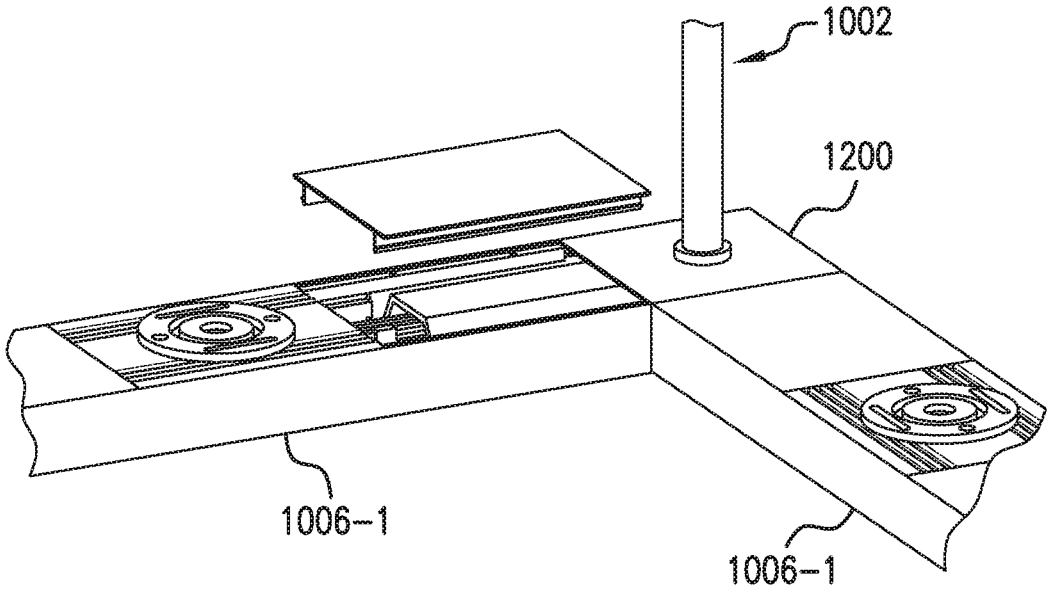
Figure 35E:
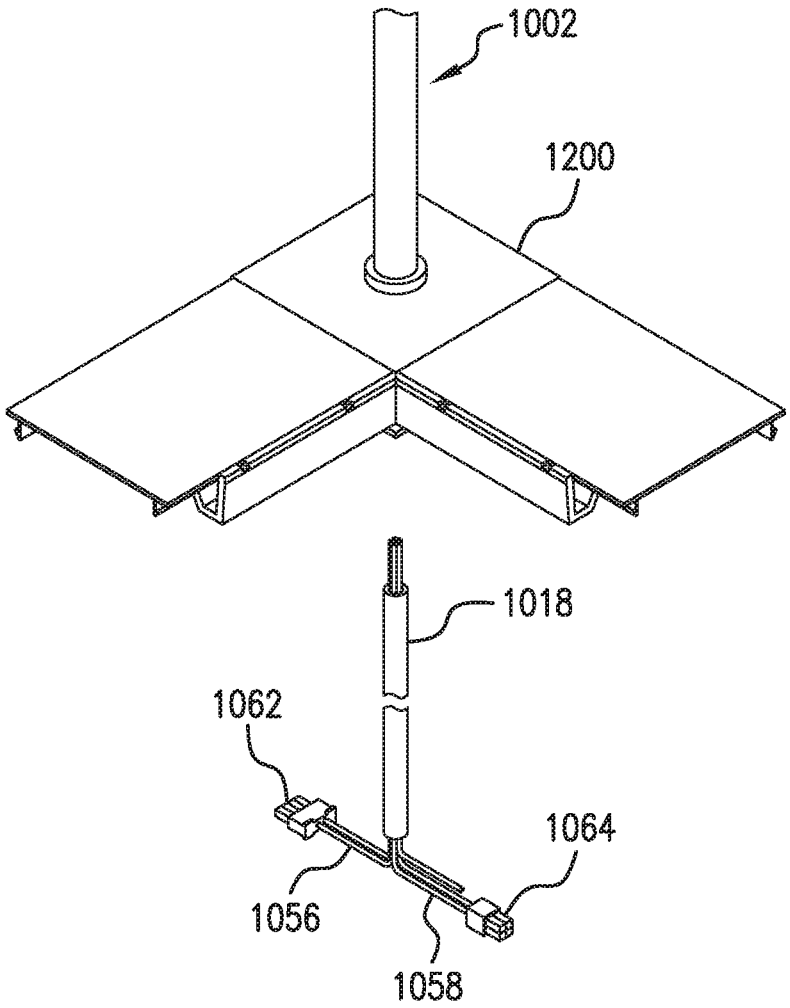

Referring to FIG. 34, the suspender 1002 that is connected to the connector 1200 may include a power cable 1018. FIG. 35E illustrates the suspender 1002 connected to the connector 1200, and its respective cable 1018. Since the suspender 1002 includes the cable 1018 for inputting electrical power and dimming control signals to the lighting system 2000, the cable 1056 (see FIG. 35F), split from the cable 1018, may be connected to the cable 1210 of the connector 1200, and the cable 1058 (see FIG. 35F), split from the cable 1018, may be connected to the cable 1212 of the connector 1200. Thus, electrical power and dimming control signals that are input from the cable 1018 may be transmitted to the beams 1006 through the cables 1210 and 1212 of the connector 1200. FIG. 35D illustrates to suspender 1002, the connector 1200 and the two beams 1006-1 in a connected state.

Figure 35F:
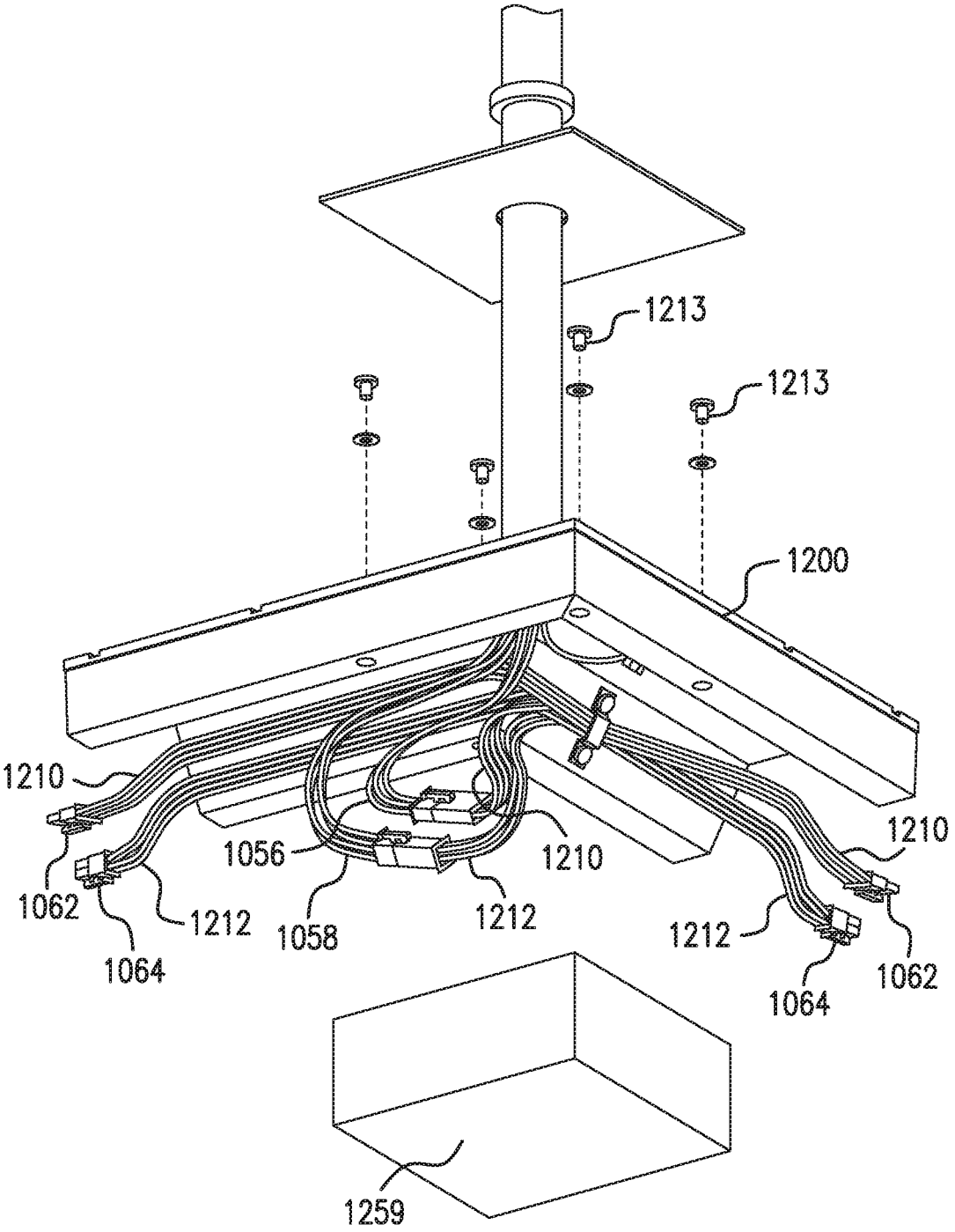

As shown in FIG. 35F, a plurality of screws 1213 may be used to attach the bottom cover 1259 to the connector 1200.

Thus, the connector 1200 may electrically and structurally connect two beams 1006-1 to one another.

Referring to FIG. 34, the connector 1202 one of the beams 1006-1 with the beam 1006-2.

Figure 36A:
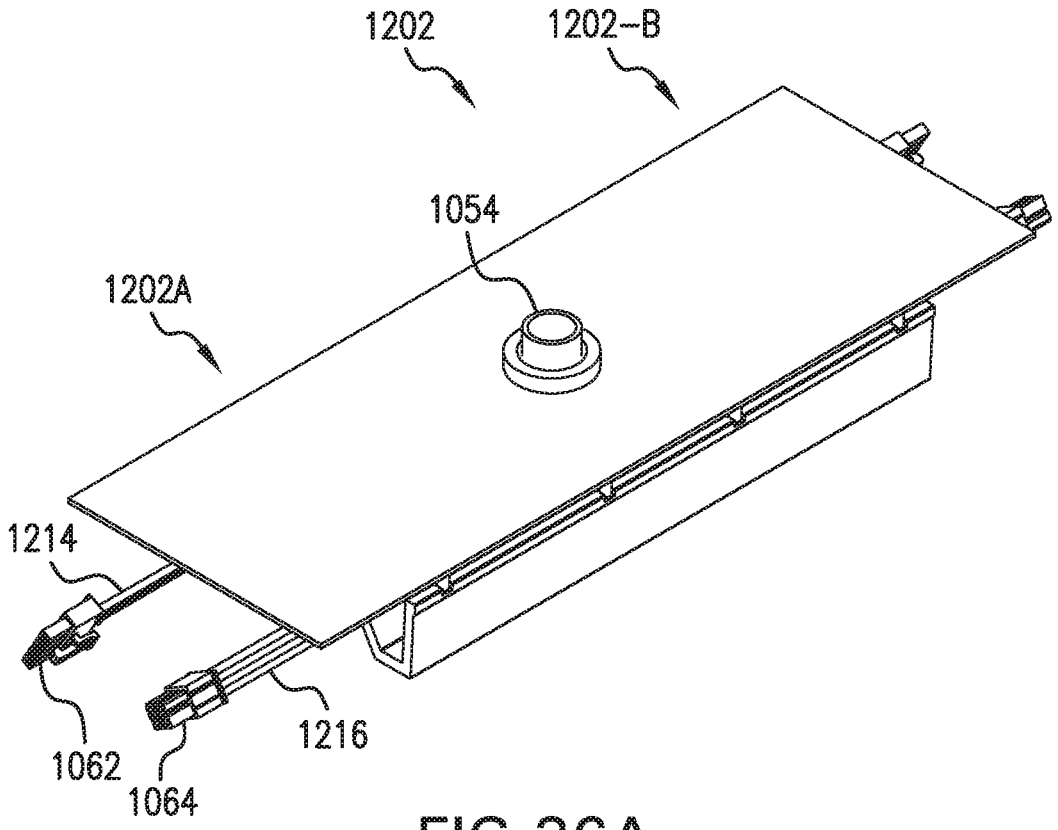
FIGS. 36A-36B are respectively perspective top and bottom views illustrating a connector according to an embodiment.
Figure 36B:
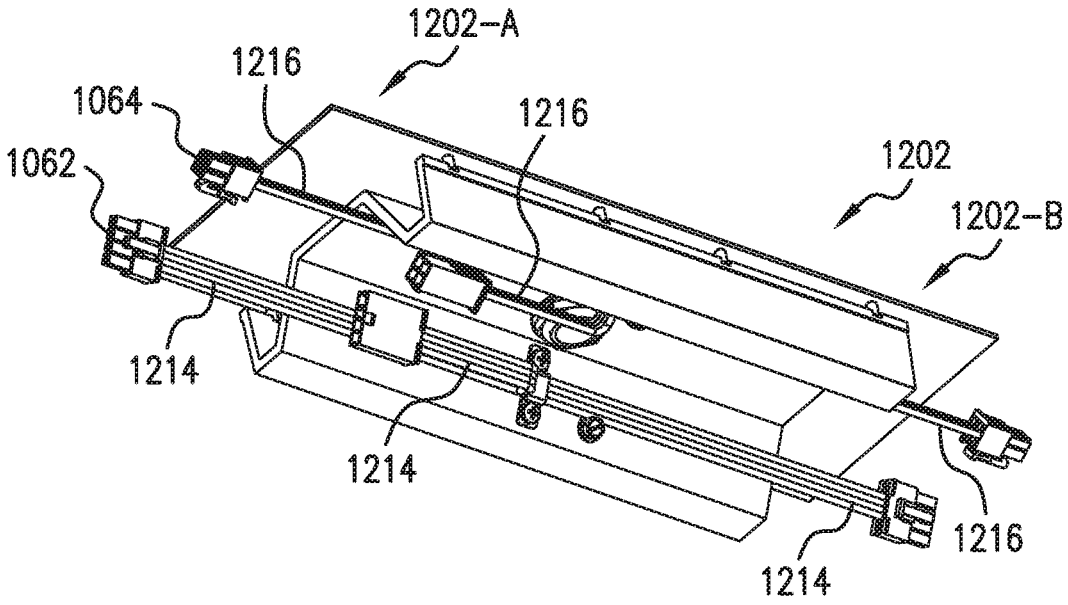

FIGS. 36A and 36B are respectively top and bottom perspective views illustrating the connector 1202 according to an embodiment. The connector 1202 may be referred to as a linear connector.

Referring to FIGS. 36A and 36B, the connector 1202 may have a first wing 1202-A and a second wing 1202-B, a plurality of cables 1214, a plurality of cables 1216, and a hollow coupler 1054 for connection with the suspender 1004-B (see FIG. 34).

The first wing 1202-A may be configured to be coupled with an end of one of the beams 1006-1 (see FIG. 34), and the second wing 1202-B may be configured to be coupled with an end of the beam 1006-2 (see FIG. 34).

The plurality of cables 1214 and the plurality of cables 1216 may be configured to electrically connect the beams 1006-1 and 1006-2 to each other. The cables 1214 are electrically connected in common to each other. The cables 1216 are electrically connected in common to each other. However, the cables 1214 are not electrically connected to the cables 1216.

The first and second wings 1202-A and 1202-B may structurally couple the beams 1006-1 and 1006-2 to each other. The cables 1214 (see FIG. 36B) may electrically connect the cable 1090 of the beam 1006-1 to the cable 1090 of the beam 1006-2. The cables 1216 (see FIG. 36B) may electrically connect the cable 1102 of the beam 1006-1 to the cable 1102 of the beam 1006-2.

One of the cables 1214 may be configured to receive electrical power and dimmer control signals from an external power source, and the other two cables 1214 may transmit the input electrical power and dimmer control signals to the cables 1090 of the connected beams. In addition, one of the cables 1216 may be configured to receive electrical power and dimmer control signals from an external power source, and the other two cables 1216 may transmit the input electrical power and dimmer control signals to the cables 1102 of the connected beams.

The suspender 1004-B (see FIG. 34) may structurally connect the connector 1202 to the ceiling.

Thus, the connector 1202 may electrically and structurally connect one of the beams 1006-1 with the beam 1006-2.

Figure 37A:
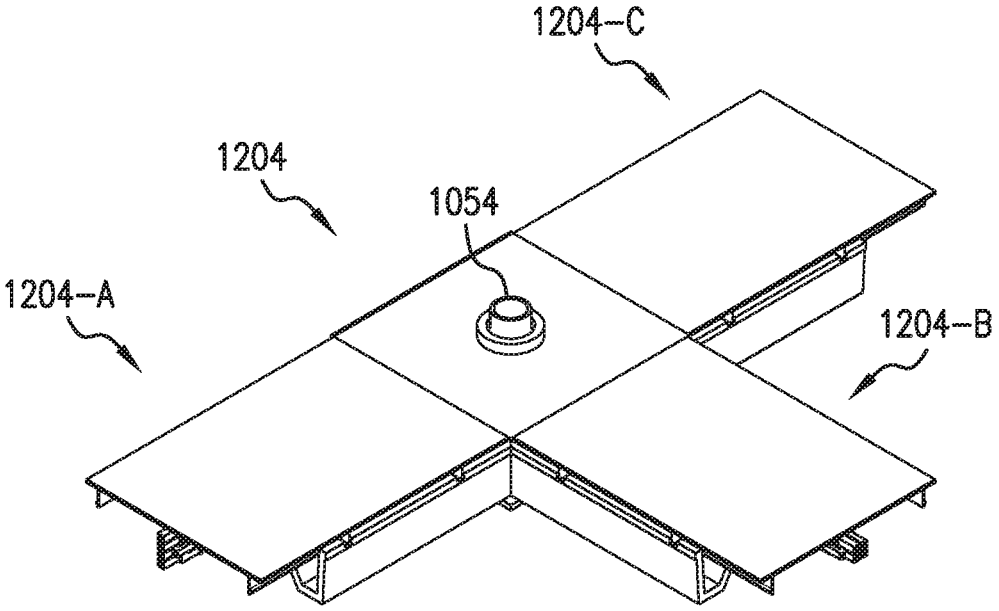
FIGS. 37A-37B are respectively perspective top and bottom views illustrating a connector according to an embodiment.
Figure 37B:
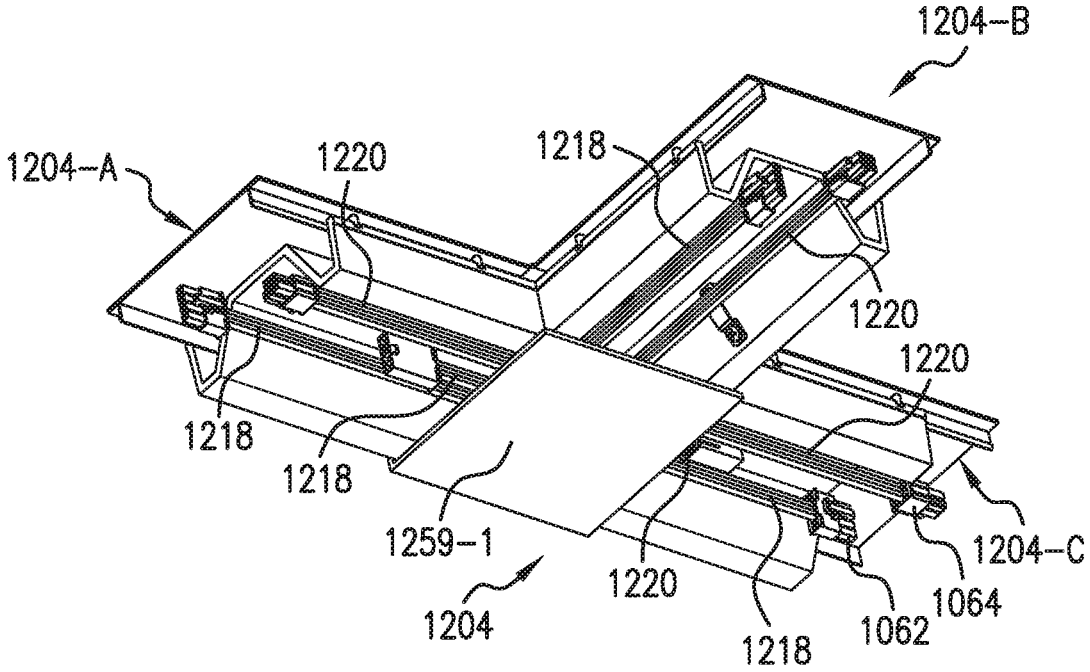

FIGS. 37A and 37B are respectively top and bottom perspective views illustrating the connector 1204 according to an embodiment. The connector 1204 may be referred to as a T connector.

Referring to FIGS. 37A and 37B, the connector 1204 may have a first wing 1204-A, a second wing 1204-B, a third wing 1204-C, a plurality of cables 1218, a plurality of cables 1220, a hollow coupler 1054 for connection with the suspender 1004-B (see FIG. 34), and a bottom cover 1259-1.

The first wing 1204-A may be configured to be coupled with an end of, for example, the beam 1006-2 (see FIG. 34), and the second and third wings 1204-B and 1204C may respectively be configured to be connected to an end of a beam 1006-1 (see FIG. 34).

The plurality of cables 1218 and the plurality of cables 1220 may be configured to electrically connect the two beams 1006-1 and the beam 1006-2 to each other. The cables 1218 are electrically connected in common to each other. The cables 1220 are electrically connected in common to each other. However, the cables 1218 are not electrically connected to the cables 1220.

The first to third wings 1204-A to 1204C may structurally couple the two beams 1006-1 and the beam 1006-2 to each other. The cables 1218 (see FIG. 37B) of the connector 1204 may electrically connect the cable 1090 of each of the two beams 1006-1 and the cable 1090 of the beam 1006-2 to each other. The cables 1220 (see FIG. 37B) of the connector 1204 may electrically connect the cable 1102 of each of the two beams 1006-1 and the cable 1102 of the beam 1006-2 to each other.

One of the cables 1218 may be configured to receive electrical power and dimmer control signals from an external power source, and the other three cables 1218 may transmit the input electrical power and dimmer control signals to the cables 1090 of the connected beams. In addition, one of the cables 1220 may be configured to receive electrical power and dimmer control signals from an external power source, and the other three cables 1220 may transmit the input electrical power and dimmer control signals to the cables 1102 of the connected beams.

The suspender 1002 (see FIG. 34) may structurally connect the connector 1204 to the ceiling.

Thus, the connector 1204 may electrically and structurally connect three beams to each other, for example, two beams 1006-1 with one beam 1006-2.

In addition, as shown in FIG. 34, the suspender 1202 that is connected to the connector 1204 also includes a cable 1018. Since the cable 1018 of the connector 1200 (see FIG. 34) also provides power to the lighting system 2000, the uplights and downlights of the lighting system 2000 may be operated independently. To independently operate the uplights and downlights of the lighting system 2000, the cable 1018 of the connector 1200 may be connected, for example, to the cables 1090 of the two beams 1006-1 to which the connector 1200 is connected. In this case, the cable 1018 of the connector 1204 may be connected to the cables 1102 of the two beams 1006-1 and to the cable 1102 of the beam 1006-2 to which the connector 1204 is connected.

Figure 38A:
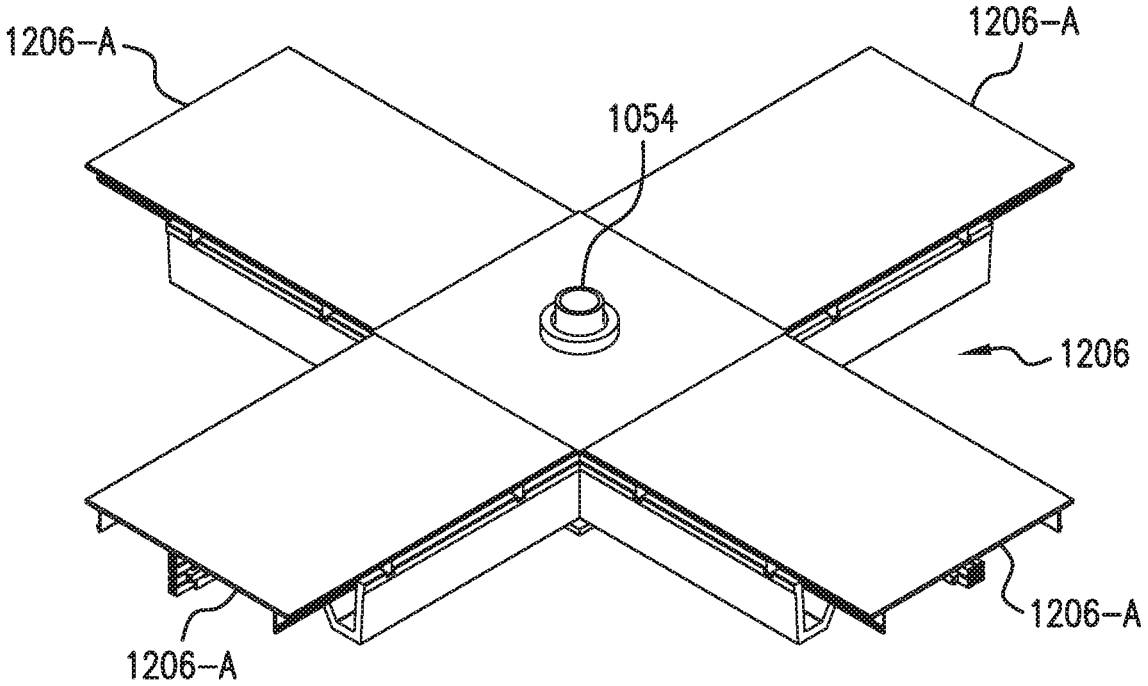
FIGS. 38A-38B are respectively perspective top and bottom views illustrating a connector according to an embodiment.
Figure 38B:
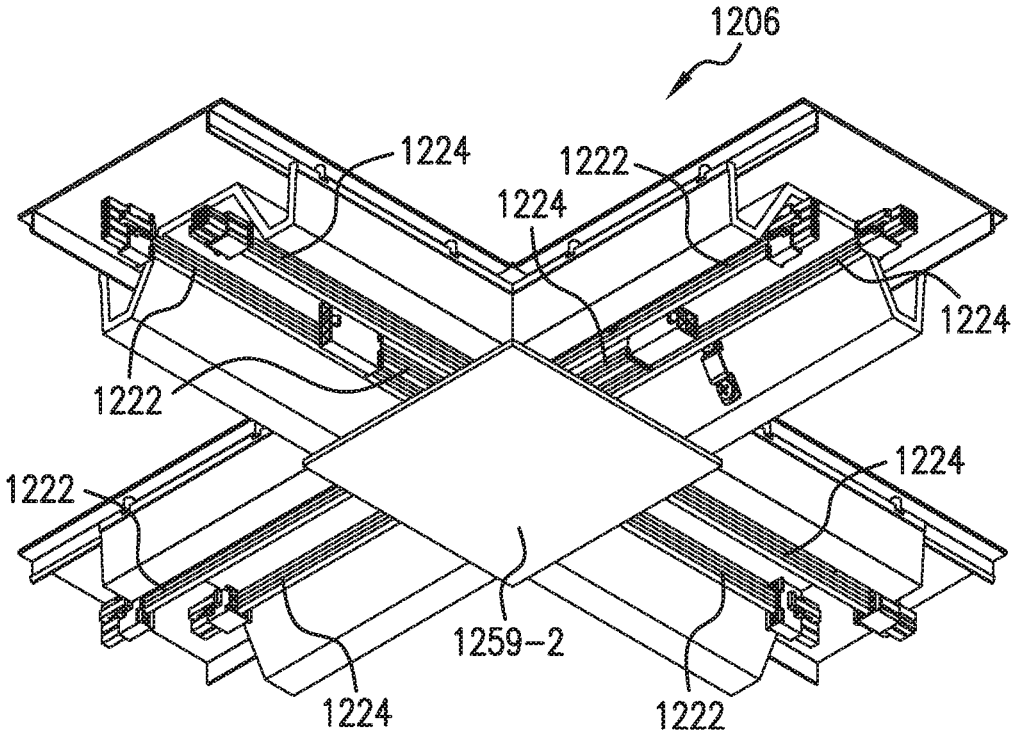

FIGS. 38A and 38B are respectively top and bottom perspective views illustrating the connector 1206 according to an embodiment. The connector 1206 may be referred to as an X connector.

Referring to FIGS. 38A and 38B, the connector 1206 may have a plurality of wings 1206-A, a plurality of cables 1222, a plurality of cables 1224, a hollow coupler 1054 for connection with the suspender 1004 (see FIG. 34), and a bottom cover 1259-2.

Each of the wings 1206-A may be configured to be coupled with an end of, for example, a beam 1006-1. As illustrated in FIG. 34, the connector 1206 may be configured to couple, for example, four beams 1006-1 to each other.

The plurality of cables 1222 and the plurality of cables 1224 may be configured to electrically connect the plurality of beams 1006-1 to each other. The cables 1222 are electrically connected in common to each other. The cables 1224 are electrically connected in common to each other. However, the cables 1222 are not electrically connected to the cables 1224.

The wings 1206-A may structurally couple, for example, four beams 1006-1 to each other. The cables 1222 (see FIG. 38B) may electrically connect the cable 1090 of each of the four beams 1006-1 to one another. The cables 1224 (see FIG. 38B) may electrically connect the cable 1102 of each of the four beams 1006-1 to one another.

One of the cables 1222 may be configured to receive electrical power and dimmer control signals from an external power source, and the other four cables 1222 may transmit the input electrical power and dimmer control signals to the cables 1090 of the connected beams. In addition, one of the cables 1224 may be configured to receive electrical power and dimmer control signals from an external power source, and the other three cables 1224 may transmit the input electrical power and dimmer control signals to the cables 1102 of the connected beams.

The suspender 1004 (see FIG. 34) may structurally connect the connector 1206 to the ceiling.

Thus, the connector 1206 may electrically and structurally connect up to four beams to each other, for example, four beams 1006-1.

Thus, with reference to FIG. 34, the connectors 1200, 1202, 1204 and 1206 connect all of the beams 1006-1 and 1006-2 structurally and electrically to each other.

Figure 39:
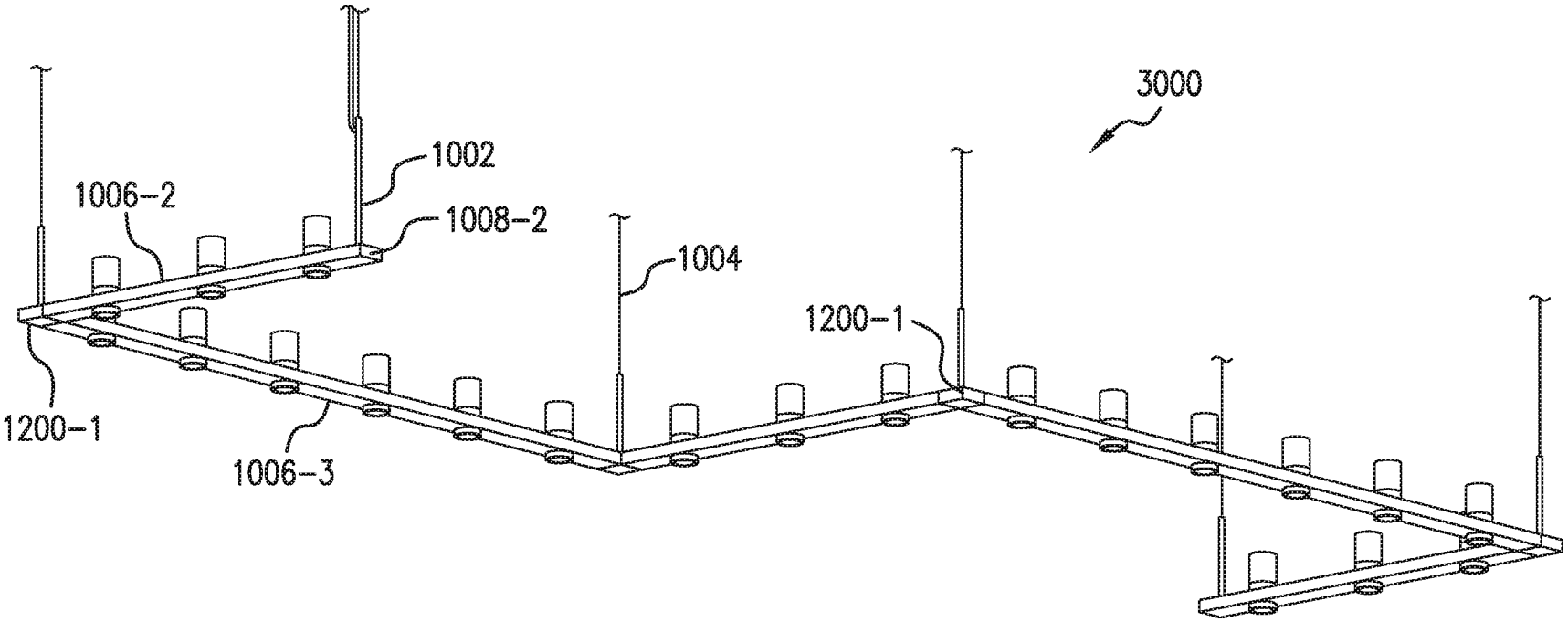
FIG. 39 is a perspective view illustrating a lighting system according to an embodiment.
Figure 4O:
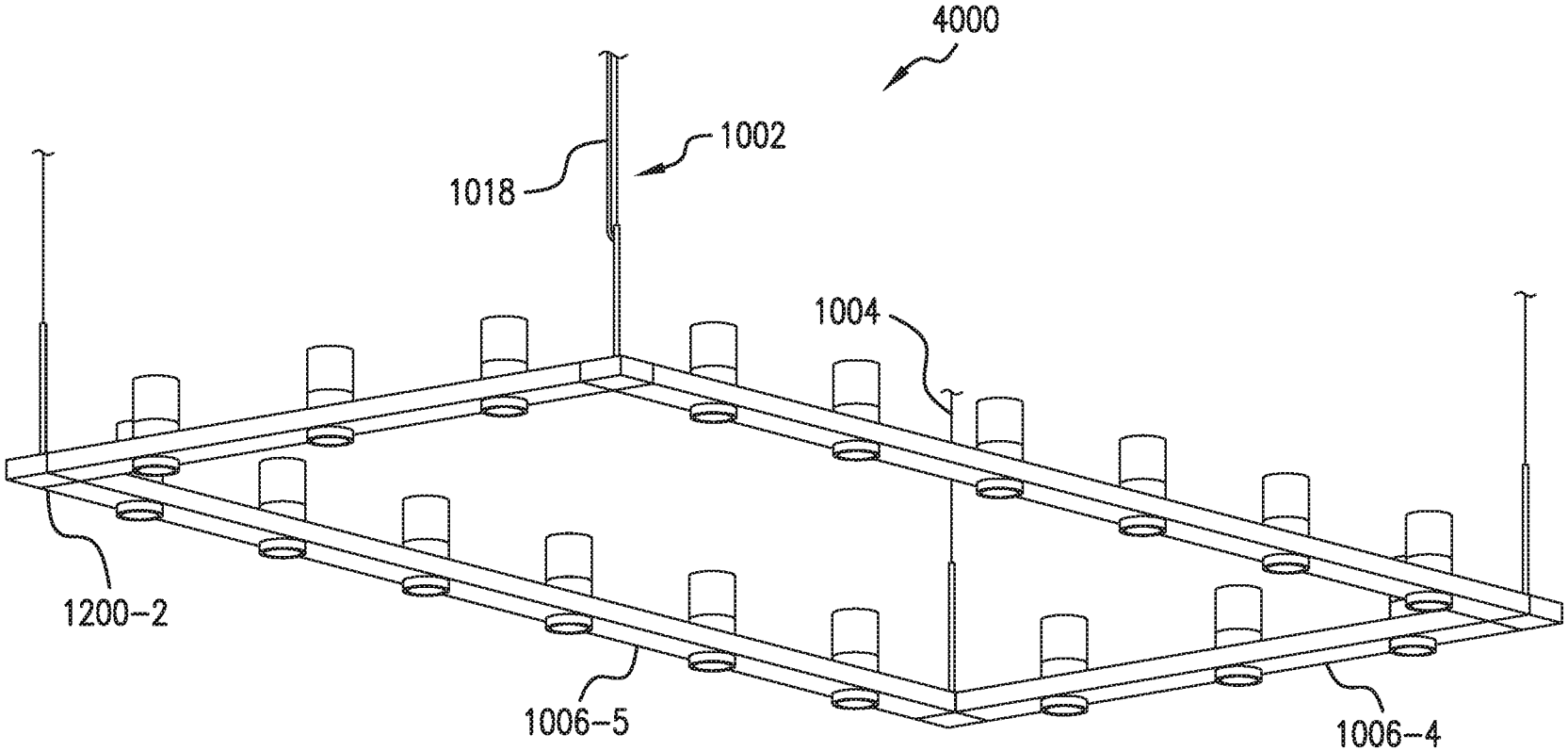

Referring to FIG. 39, a lighting system 3000, according to an embodiment, may include a plurality of beams 1006-2, a plurality of beams 1006-3, a plurality of connectors 1008-1, a plurality of connectors 1200-1, a suspender 1002 and a plurality of suspenders 1004. As shown in FIG. 39, the beams 1006-2 and 1006-3 may be arranged in an S-like configuration.

Since each of the beams 1006-2 and 1006-3 may be electrically and structurally connected to one another through the connectors 1200-1, the lighting system 3000 may be fed with electricity and dimmer control signals from only one cable 1018 (not shown).

Referring to FIG. 40, a lighting system 4000, according to an embodiment, may include a plurality of beams 1006-4, a plurality of beams 1006-5, a plurality of connectors 1200-2, a suspender 1002 and a plurality of suspenders 1004. Referring to FIG. 40, the beams 1006-4 and 1006-5 may be arranged in a closed loop.

Referring to FIG. 40, since each of the beams 1006-4 and 1006-5 may be electrically and structurally connected to one another through the connectors 1200-2, the lighting system 4000 may be fed with electricity and dimmer control signals from only one cable 1018.

In an alternate embodiment, a lighting system may include at least one beam with dual sided light engines and at least one beam with single sided light engines. The beam with single sided light engines may have both cables 1090 and 1102 for transferring power and dimming control signals to the other beams of the lighting system. Thus, a beam with single sided light engines may transmit power and electrical signals to a beam with dual sided light engines.

Based on the teachings of this specification, it is readily apparent that the suspenders, connectors and beams of the present invention may be configurable in a plurality of ways to form a lighting system that fulfills lighting, structural and architectural needs. A lighting system of the present invention may have uplights and downlights, which may be independently operated due to the novel configuration of the light engines, circuitry and wiring of the lighting system.

In addition, a lighting system of the present invention may be powered from only a single external power cable since the connectors transmit electricity between the beams. Thus, the lighting system of the present invention has a simplified wiring scheme. In addition, the beams and connectors may be easily coupled to each other in the field, facilitating the installation of the lighting system, and facilitation a reconfiguration of the lighting system when desired.

In addition, since one connector may electrically connect a plurality of beams with dual and/or single sided light engines to each other as well as structurally support the plurality of beams from a single ceiling support point, the lighting system of the present invention has a reduced number of lighting structures, a reduced number of ceiling hangers, and a reduced number of external power feed cables for powering the lighting system.

Accordingly, a lighting system of the present invention may be installed rapidly and cost-efficiently.

While the present invention has been particularly shown and described with reference to exemplary embodiments thereof, it will be apparent to those of ordinary skill in the art that various changes in form and detail may be made therein without departing from the spirit and scope of the present invention.

What is claimed is:

1. A light engine configured to emit light, comprising:

a body comprising a plurality of sides including a first side having a first surface and a second side having a second surface, the second side being mirror opposite to the first side with the first side extending along a first plane and the second side extending along a second plane that is spaced from the first plane;

a first light source disposed on the first surface of the first side of the body and extending away from the first surface of the first side in a first direction;

a first pair of wires having a first end and a second end, the first light source being connected to the first pair of wires between the first end and the second end and configured to receive electrical power through the first pair of wires;

a second light source disposed on the second surface of the second side of the body and extending away from the second surface in a second direction that is mirror opposite the first direction; and a second pair of wires having a first end and a second end, the second light source being connected to the second pair of wires between the first end and the second end of the second pair of wires and configured to receive electrical power through the second pair of wires.

2. The light engine of claim 1, further comprising a first plug and a second plug, wherein the first plug is connected to the first end of the first pair of wires and to the first end of the second pair of wires and the second plug is connected to the second end of the first pair of wires and to the second end of the second pair of wires.

3. The light engine of claim 2, wherein the first plug and the second plug are selectively coupleable with one another.

4. The light engine of claim 3, wherein the first plug includes a first pair of prongs connected to the first end of the first pair of wires and a second pair of prongs connected to the first end of the second pair of wires, the second plug includes a first pair of prongs connected to the second end of the first pair of wires and a second pair of prongs connected to the second end of the second pair of wires, wherein, when the first plug and the second plug are coupled to one another, the first pair of prongs of the first plug is electrically connected to the first pair of prongs of the second plug and the second pair of prongs of the first plug is electrically connected to the second pair of prongs of the second plug such that the first pair of wires is not electrically connected to the second set of wires.

5. The light engine of claim 1, further comprising a connection ring disposed on the first surface of the body, wherein the connection ring is configured to be selectively coupled to a casing, the casing being configured to diffuse or reflect light emitted from the first light source.

6. The light engine of claim 5, wherein the connection ring is threaded.

7. The light engine of claim 1, wherein the body is made at least partially of a metal.

8. The light engine of claim 1, wherein the body includes a plurality of fins configured to dissipate heat.

9. The light engine of claim 1, wherein the body further comprises an opening extending along a length of the body between the first surface and the second surface and the first pair of wires and the second pair of wires extend through the opening.

10. The light engine of claim 1, wherein the plurality of sides include a third side located between the first side and the second side that has an internal surface and an external surface and a fourth side that is located between the first side and the second and spaced from the third side that has an internal surface and an external surface, and wherein a first flange extends from the internal surface of the third side and a second flange extends from the internal surface of the fourth side.

* * * * *